US010930210B2

(12) United States Patent
Lee et al.

(10) Patent No.: US 10,930,210 B2
(45) Date of Patent: Feb. 23, 2021

(54) ORGANIC LIGHT-EMITTING DIODE DISPLAY CAPABLE OF REDUCING KICKBACK EFFECT

(71) Applicant: LG Display Co., Ltd., Seoul (KR)

(72) Inventors: Hyunsuk Lee, Gyeonggi-do (KR); Junyoung Kwon, Busan (KR); Seungtae Jin, Seoul (KR)

(73) Assignee: LG Display Co., Ltd., Seoul (KR)

( * ) Notice: Subject to any disclaimer, the term of this patent is extended or adjusted under 35 U.S.C. 154(b) by 570 days.

(21) Appl. No.: 15/472,503

(22) Filed: Mar. 29, 2017

(65) Prior Publication Data

US 2017/0287390 A1 Oct. 5, 2017

(30) Foreign Application Priority Data

Mar. 29, 2016 (KR) ..... 10-2016-0037711
Apr. 29, 2016 (KR) ..... 10-2016-0052663
May 27, 2016 (KR) ..... 10-2016-0065766

(51) Int. Cl.
*G09G 3/3233* (2016.01)

(52) U.S. Cl.
CPC ... *G09G 3/3233* (2013.01); *G09G 2300/0861* (2013.01); *G09G 2310/0251* (2013.01); *G09G 2310/0262* (2013.01); *G09G 2320/0295* (2013.01); *G09G 2320/0693* (2013.01)

(58) Field of Classification Search
None
See application file for complete search history.

(56) References Cited

U.S. PATENT DOCUMENTS 7,545,351 B2 * 6/2009 Shin ..... G09G 3/325 345/76
2015/0002558 A1 * 1/2015 Kumeta ..... G09G 3/3233 345/690
2016/0086546 A1 * 3/2016 Noh ..... G09G 3/3258 345/80

* cited by examiner

*Primary Examiner* — David D Davis
(74) *Attorney, Agent, or Firm* — Morgan, Lewis & Bockius LLP

(57) ABSTRACT

An OLED display includes a plurality of pixel lines each connected to a plurality of pixels, the plurality of pixel lines including at least two adjacent pixel lines, each pixel including a driving TFT, a first switching TFT, a second switching TFT, and an emission control TFT connected to the driving TFT. The OLED display also includes a first scan driver controlling the first switching TFTs for the two pixel lines. The OLED display also includes a second scan driver controlling the second switching TFTs for the two pixel lines. The OLED display also includes a third scan driver configured so that all of the emission control TFTs for the two pixel lines are turned on in a programming period, maintain a turn-on state for a portion of an emission period, and can adjust an on-time duty of the emission period after the portion of time.

18 Claims, 31 Drawing Sheets

ORGANIC LIGHT-EMITTING DIODE DISPLAY CAPABLE OF REDUCING KICKBACK EFFECT

CROSS-REFERENCE TO RELATED APPLICATIONS

This application claims the priority of Korean Application No. 10-2016-0037711, filed on Mar. 29, 2016; No. 10-2016-0052663, filed on Apr. 29, 2016; and No. 10-2016-0065766, filed on May 27, 2016, the entirety of which is hereby incorporated by reference.

BACKGROUND

1. Technical Field

The present disclosure relates to organic light-emitting diode display and a method of driving the same.

2. Discussion of the Related Art

An active matrix organic light-emitting diode (OLED) display includes a plurality of organic light-emitting diodes (OLEDs) capable of emitting light by themselves. The active matrix OLED display has many advantages, such as fast response time, high emission efficiency, high luminance, wide viewing angle, and the like.

An OLED serving as a self-emitting element includes an anode electrode, a cathode electrode, and an organic compound layer between the anode electrode and the cathode electrode. The organic compound layer typically includes a hole injection layer (HIL), a hole transport layer (HTL), an emission layer (EML), an electron transport layer (ETL), and an electron injection layer (EIL). When a voltage is applied to the anode electrode and the cathode electrode, holes passing through the hole transport layer (HTL) and electrons passing through the electron transport layer (ETL) move to the emission layer (EML) and combine, thereby forming excitons. As a result, the emission layer (EML) generates visible light.

An OLED display includes a plurality of pixels, each including an OLED and a driving thin film transistor (TFT), in a matrix and adjusts a luminance of an image implemented on the pixels based on a grayscale of image or video data. The driving TFT controls a driving current flowing in the OLED, depending on a voltage between a gate electrode and a source electrode of the driving TFT. An amount of light emitted by the OLED is determined depending on the driving current of the OLED, and the luminance of the image is determined depending on the amount of light emitted by the OLED. In general, when a driving TFT operates in a saturation region, a driving current $I_{ds}$ flowing between a drain electrode and a source electrode of the driving TFT is expressed by the following Equation 1.

$$I_{ds}=(1/2)*(\mu*C*(W/L))*(V_{gs}-V_{th})^2 \quad \text{[Equation 1]}$$

In Equation 1, μ is electron mobility, "C is a capacitance of a gate insulating layer, "W" is a channel width of the driving TFT, and "L" is a channel length of the driving TFT. In addition, $V_{gs}$ is a voltage (or a potential difference) between a gate node and a source node of the driving TFT, and $V_{th}$ is a threshold voltage (or a critical voltage) of the driving TFT. The gate node-to-source node voltage $V_{gs}$ of the driving TFT corresponds to a voltage differential between a data voltage and a reference voltage. The data voltage is an analog voltage corresponding to a grayscale of video data, and the reference voltage is a fixed voltage. Therefore, the gate node-to-source node voltage $V_{gs}$ of the driving TFT is programmed or set depending on the data voltage. Then, the driving current $I_{ds}$ is determined based on the programmed gate node-to-source node voltage $V_{gs}$.

In a display drive, one frame period includes a programming period in which the gate node-to-source node voltage $V_{gs}$ of the driving TFT is programmed or set, and an emission period in which the OLED emits light by the driving current determined by the programmed gate node-to-source node voltage $V_{gs}$. During the programming period, the data voltage may be applied to one of the gate electrode and the source electrode of the driving TFT through a first switching TFT provided in the pixel, and the reference voltage may be applied to the other of the gate electrode and the source electrode of the driving TFT through a second switching TFT provided in the pixel. To this end, the first switching TFT and the second switching TFT may be turned on during the programming period and may be turned off during the emission period subsequent to the programming period. Further, an emission control TFT controlling a current path between the driving TFT and an input terminal of a high potential driving voltage may be provided in the pixel. The emission control TFT may be turned off during the programming period, and thus may cut off the current path between the driving TFT and the input terminal of the high potential driving voltage, thereby preventing the abnormal emission of the OLED. The emission control TFT may be turned on during the emission period subsequent to the programming period, and thus may connect the input terminal of the high potential driving voltage to the driving TFT, thereby allowing the driving current to flow in the OLED during the emission period.

SUMMARY

Accordingly, the present disclosure is directed to an organic light-emitting diode (OLED) display and a method of driving the same that substantially obviate one or more of the issues due to limitations and disadvantages of the related art.

An aspect of the present disclosure is to provide OLED display and a method of driving the same capable of reducing or preventing an effect of kickback and capable of compensating for or preventing luminance distortion when a pulse duty drive is performed in an emission period for an image display.

An aspect of the present disclosure is to provide an OLED display and a method of driving the same capable of reducing a portion of a bezel area occupied by a driving circuit, that compensates for luminance distortion and luminance uniformity between pixels.

Another aspect of the present disclosure is to provide an OLED display and a method of driving the same capable of reducing a size of a gate driver included in an OLED display panel.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts as embodied and broadly described, an organic light-emitting diode (OLED) display may include a plurality of pixel lines each connected to a plurality of pixels. The plurality of pixel lines include at least an $n^{th}$ pixel line and a $(n+1)^{th}$ pixel line, where n is a natural number, and each pixel includes a driving TFT, a first switching TFT connected to the driving TFT, a second switching TFT connected to the driving TFT, and an emission control TFT connected to the driving TFT. The OLED display may also include a first scan driver configured to control the first switching TFTs included in pixels corresponding to the $n^{th}$ pixel line and the $(n+1)^{th}$ pixel line. The OLED display may also include a second scan driver configured to control the second switching TFTs included in the pixels corresponding to the $n^{th}$ pixel line and the $(n+1)^{th}$ pixel line. The OLED display may also include a third scan driver configured such that all of the emission control TFTs included in the pixels corresponding to the $n^{th}$ pixel line and the $(n+1)^{th}$ pixel line are turned on in a programming period, maintain a turn-on state for a portion of time of an emission period following the programming period, and are able to adjust an on-time duty of the emission period after the portion of time.

Furthermore, an organic light-emitting diode (OLED) display including a programming period and an emission period, may include a first switching TFT between a gate node of a driving thin film transistor (TFT) and a data line. The first switching TFT is configured to supply a data voltage to the gate node in the programming period. The OLED display may also include a second switching TFT between a source node of the driving TFT and a reference line. Also, the second switching TFT is configured to bypass a transient current, that is supplied through the driving TFT, to the reference line in the programming period. The OLED display may also include an emission control TFT between a drain node of the driving TFT and a high potential driving voltage supply line. Also, the emission control TFT is configured to supply a high potential driving voltage to the drain node in the programming period. The OLED display may also include a storage capacitor between the gate node and the source node. Also, the storage capacitor is configured to charge a gate node-to-source node voltage of the driving TFT in the programming period. The OLED display may also include an organic light-emitting diode connected to the source node. Also, the OLED is configured to maintain a non-emission state in the programming period.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain various principles of the disclosure.

FIG. 13 is applied.

Figure 1:
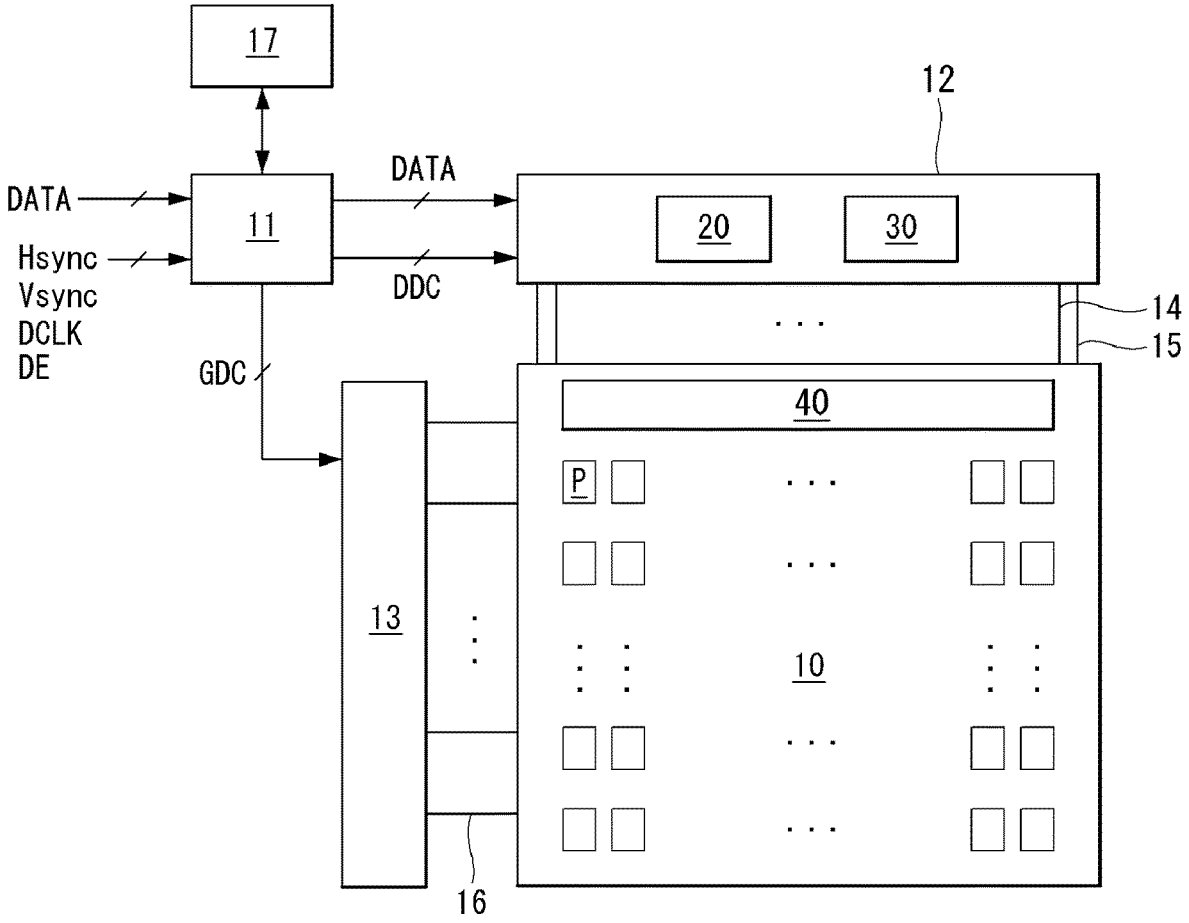
FIG. 1 is a block diagram illustrating an organic light-emitting diode (OLED) display according to an example embodiment.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to some embodiments of the present disclosure, examples of which are illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

In the description of embodiments, when a structure is described as being positioned "on or above" or "under or below" another structure, this description should be construed as including a case in which the structures contact each other as well as a case in which a third structure is disposed therebetween.

The present inventors have conducted research and development to commercialize an organic light-emitting diode (OLED) display capable of providing improved image quality. The present inventors have conducted research and development on an OLED display capable of performing a pulse duty drive having various advantages. The present inventors conducted various experiments to implement a pulse duty drive and recognized the problem that a display luminance may be distorted because pixels of an OLED display are affected by kickback resulting from a parasitic capacitance existing in thin film transistors (TFTs) during an emission period.

For example, a parasitic capacitance exists between various electrodes of TFTs of a pixel due to a stack structure of the electrodes. A drain electrode of a driving TFT coupled to a gate electrode of a switching TFT may be affected by kickback resulting from a parasitic capacitance when the switching TFT is turned off during an emission period. A potential of the drain electrode of the driving TFT is lowered due to an effect of the kickback, and rises to a high potential driving voltage when an emission control TFT is turned on. In this instance, a potential of a gate electrode of the driving TFT may also rise. This is because a parasitic capacitance exists between the gate electrode and the drain electrode of the driving TFT. When the potential of the gate electrode of the driving TFT programmed during a programming period is changed in the emission period, a gate node-to-source node voltage $V_{gs}$ of the driving TFT is changed. In this instance, the present inventors have recognized the problem that a luminance of the OLED display is distorted because an amount of driving current $I_{ds}$ passing through the driving TFT is changed.

For example, the present inventors have recognized the problem that, when a first switching TFT is turned off in the emission period in which a pulse duty drive is performed, e.g., a luminance distortion, for example, a hump on a luminance-grayscale curve, is generated by the effect of the kickback resulting from the parasitic capacitance in a state where the driving TFT is not connected to an input terminal of the high potential driving voltage and is floated. The present inventors have recognized the problem that luminance uniformity between pixels of an OLED display is reduced due to a variation in electrical characteristics between the pixels as well as a kickback phenomenon.

For example, the present inventors have recognized that electrical characteristics, such as a threshold voltage and electron mobility, of the driving TFT of each pixel may be a factor determining an amount of driving current Ids of the driving TFT. For example, a variation in the electrical characteristics of the driving TFTs is generated by various causes, such as process characteristics and time-varying characteristics. Thus, the present inventors have recognized the problem that, when the same data voltage is applied to pixels including driving TFTs having different electric characteristics, the luminance uniformity between the pixels is reduced.

The present inventors have conducted research and development on a narrow bezel technology capable of reducing a width of a peripheral portion of a pixel area of an OLED display while providing excellent image quality. The present inventors designed compensation circuits to improve the luminance distortion and a reduction in the luminance uniformity between pixels. However, when these compensation circuits were added, they recognized various problems that might make it difficult to implement a narrow bezel. For example, the present inventors have recognized the problem that an area of a gate driver and a bezel area are increased when the gate driver is implemented as a compensation circuit compensating for a variation in electric characteristics between driving TFTs of pixels and a driving circuit capable of controlling an emission control TFT.

Further, to solve a variation in electric characteristics between driving TFTs of pixels, when a sensor is provided in a source driver and is configured to sense a voltage of a particular node connected to a source electrode of the driving TFT or sense a driving current flowing in the driving TFT, the present inventors have recognized that the sensor should include a plurality of sensing units connected to a plurality of output channels and analog-to-digital converters (ADCs) connected to the sensing units.

In particular, the sensing units and the ADCs should be provided in the source driver as many as the number of output channels of the source driver. However, because a circuit size of each of the sensing unit and the ADC is relatively larger than other digital circuits, the number of output channels of the source driver increases and a distance between the output channels decreases as a resolution and pixel per inch (ppi) of the OLED display increase.

Accordingly, the present inventors have recognized the problem that an area of the sensor is increased as the resolution and the pixel per inch of the OLED display increase. In other words, if various circuits are designed to solve the problems of the luminance distortion and a reduction in the luminance uniformity between the pixels of the OLED display, a difficulty in implementing the narrow bezel is further increased.

FIG. 1 is a block diagram illustrating an organic light-emitting diode (OLED) display according to an example embodiment.

An OLED display according to an example embodiment is described below with reference to FIG. 1. An OLED display according to an example embodiment may at least include a display panel 10, a timing controller 11, a source driver 12, and a gate driver 13. The display panel 10 may include a plurality of pixels P, a plurality of data lines 14, a plurality of reference lines 15, and a plurality of gate line units 16.

The pixels P of the display panel 10 may be disposed in a matrix to form a pixel array. Each pixel P may be connected to one of the data lines 14 supplied with a data voltage, one of the reference lines 15 supplied with a reference voltage, and one of the gate line units 16. Each pixel P may be configured to receive a high potential driving voltage and a low potential driving voltage from a voltage generator. For example, the voltage generator may supply the high potential driving voltage through a high potential driving voltage line or a pad, and may supply the low potential driving voltage through a low potential driving voltage line or a pad.

In some embodiments, the OLED display may include at least one external compensation circuit. An external compensation circuit technology may sense electrical characteristics of driving thin film transistor (TFTs) included in the pixels P and correct input digital video data DATA in accordance with a sensed value. For example, a sensor may be configured to compensate for a luminance variation between the pixels P resulting from the electrical characteristics (for example, a threshold voltage and electron mobility of the driving TFT) of the driving TFT. In some embodiments, the display panel 10 may further include a switch array 40. However, embodiments are not limited thereto.

The source driver 12 may include a data voltage supply unit 20 supplying the data voltage to the display panel 10. The data voltage supply unit 20 of the source driver 12 may include a plurality of digital-to-analog converters (DACs). In a display drive, the data voltage supply unit 20 may convert the corrected digital video data DATA of an input image received from the timing controller 11 into a display data voltage through the DACs. In a sensing drive, the data voltage supply unit 20 of the source driver 12 may generate a sensing data voltage through the DACs under the control of the timing controller 11. In the sensing drive, the sensing data voltage may be applied to a gate electrode of the driving TFT included in each pixel P. In some embodiments, the source driver 12 may further include a sensor 30. However, embodiments are not limited thereto.

The timing controller 11 may be configured to receive the digital video data DATA and timing signals, such as a vertical sync signal Vsync, a horizontal sync signal Hsync, a dot clock signal DCLK, and a data enable signal DE from a host system. The timing controller 11 may be configured to generate a data control signal DDC for controlling operation timing of the source driver 12 and a gate control signal GDC for controlling operation timing of the gate driver 13 based on the received signals.

The data control signal DDC may include a source start pulse, a source sampling clock, and a source output enable signal, and the like. The source start pulse may control start timing of data sampling of the source driver 12. The source sampling clock may be a clock signal that controls timing of data sampling based on a rising edge or a falling edge. The source output enable signal may control output timing of the source driver 12. The gate control signal GDC may include a gate start pulse, a gate shift clock, and the like. The gate start pulse may be applied to a gate stage of the gate driver 13 for generating a first output and controls the gate stage. The gate shift clock may be a clock signal that is commonly input to gate stages and shifts the gate start pulse. For example, the timing controller 11 may differently generate control signals DDC and GDC for the display drive and control signals DDC and GDC for the sensing drive. However, embodiments are not limited thereto.

The timing controller 11 may be configured to control the sensing drive and the display drive. The sensing drive may sense the electrical characteristics of the driving TFT of the pixel P, and may update a compensation value based on the sensed electrical characteristics. The display drive may display an input image to which the compensation value is reflected. For example, the timing controller 11 may be configured to control the sensing drive and the display drive in accordance with to a particular control sequence. However, embodiments are not limited thereto.

For example, the sensing drive may be performed in a vertical blanking interval during the display drive, in a power-on sequence interval before the beginning of the display drive, or in a power-off sequence interval after the end of the display drive under the control of the timing controller 11. However, embodiments are not limited thereto. For example, the sensing drive may be performed during the display drive.

The vertical blanking interval is a time for which digital video data DATA is not written, and is arranged between vertical active periods in which digital video data DATA of one frame is written. The power-on sequence interval is a transient time between the turn-on of driving power and the beginning of image display. The power-off sequence interval is a transient time between the end of image display and the turn-off of driving power. However, the sensing drive is not limited to these intervals.

For example, the timing controller 11 may detect a standby mode, a sleep mode, a low power mode, etc. in accordance with a particular sensing process, and may control all of operations for the sensing drive. For example, the sensing drive may be performed in a state (e.g., the standby mode, the sleep mode, the low power mode, etc.) where only a screen of the OLED display is turned off while the system power is being applied. However, embodiments are not limited thereto.

In the sensing drive, the timing controller 11 may be configured to calculate a compensation parameter capable of compensating for a change in electrical characteristics of the driving TFT of the pixel P based on digital sensing values input from the source driver 12. For example, the OLED display may include a storage memory 17, or may be configured to communicate with the storage memory 17. The compensation parameter may be stored in the storage memory 17. The compensation parameter stored in the storage memory 17 can be updated each time the sensing drive is performed. Thus, time-varying characteristics of the driving TFT can be easily compensated. However, embodiments are not limited thereto.

In the display drive, the timing controller 11 may read the compensation parameter from the storage memory 17, and may correct the digital video data DATA of the input image based on the compensation parameter. The timing controller 11 may supply the corrected digital video data DATA to the source driver 12.

Figure 2:
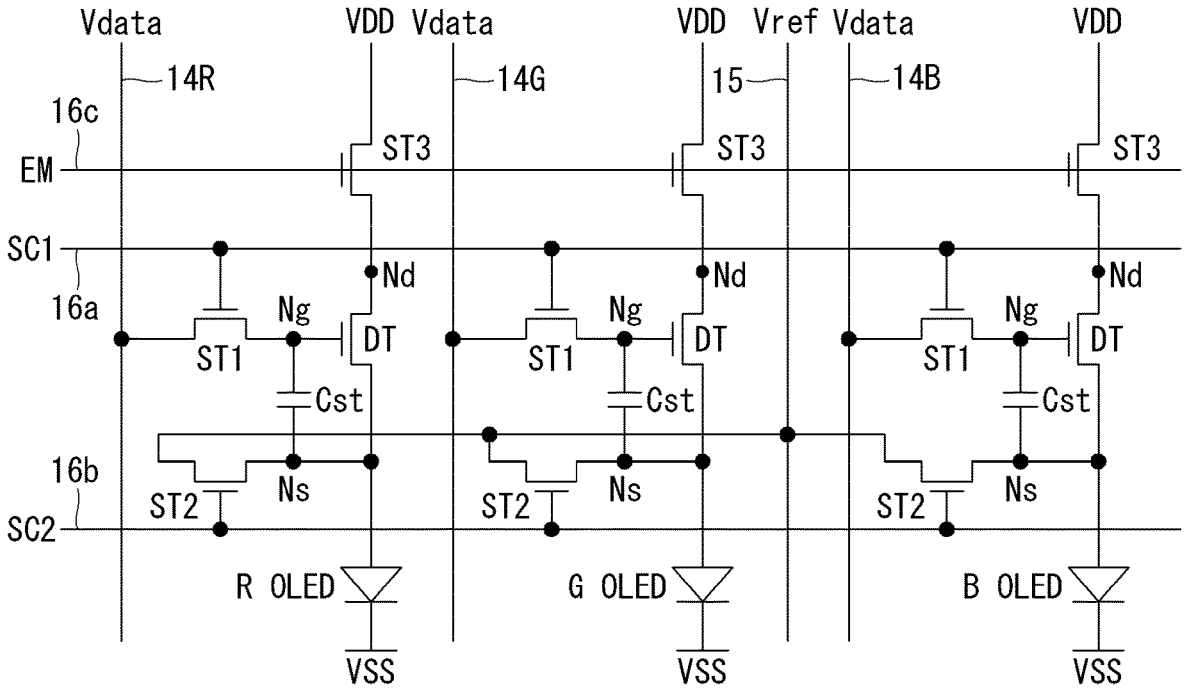
FIG. 2 is a circuit diagram of pixels included in a display panel of an OLED display according to an example embodiment.

FIG. 2 is a circuit diagram of pixels included in a display panel of an OLED display according to an example embodiment.

The pixels P included in the display panel 10 of the OLED display according to an embodiment are described below with reference to FIG. 2. The pixel array of the display panel 10 may include a first pixel, a second pixel, and a third pixel. The pixel array of the display panel 10 may include a first data line 14R corresponding to the first pixel, a second data line 14G corresponding to the second pixel, and a third data line 14B and at least one reference line 15 corresponding to the third pixel.

The pixel array of the display panel 10 may include a plurality of first gate lines 16*a* supplied with a first scan control signal SC1, a plurality of second gate lines 16*b* supplied with a second scan control signal SC2, and a plurality of third gate lines 16*c* supplied with an emission control signal EM. In addition, the first gate line 16*a*, the second gate line 16*b*, and the third gate line 16*c* may be referred to as the gate line units 16 shown in FIG. 1.

Each of the first to third pixels of the pixel array may include an OLED, a driving TFT DT, a first switching TFT ST1, a second switching TFT ST2, an emission control TFT ST3, and a storage capacitor $C_{st}$. The first to third pixels are substantially the same as one another, except for a detailed configuration of the OLED. The OLED is a light-emitting element that is connected between a source node $N_s$ connected to a source electrode of the driving TFT DT and an input terminal of a low potential driving voltage VSS, and emits light in accordance with a driving current. The OLED of the first pixel may be a red (R) OLED configured to display red. The OLED of the second pixel may be a green (G) OLED configured to display green. The OLED of the third pixel may be a blue (B) OLED configured to display blue. Embodiments are not limited to this color configuration.

The driving TFT DT may include a gate electrode connected to a gate node $N_g$, a drain electrode connected to a drain node $N_d$, and the source electrode connected to the source node $N_s$. The driving TFT DT is a driving element controlling a magnitude of the driving current in accordance with a gate node-to-source node voltage $V_{gs}$.

The first switching TFT ST1 may include a gate electrode connected to the first gate line 16*a*, a drain electrode connected to the corresponding data line 14R, 14G, or 14B, and a source electrode connected to the gate node $N_g$. The first switching TFT ST1 may be turned on in response to the first scan control signal SC1 from the first gate line 16*a*, and may electrically connect the corresponding data line 14R, 14G, or 14B to the gate node $N_g$. Hence, the first switching TFT ST1 may apply a data voltage $V_{data}$ to the gate node $N_g$.

The second switching TFT ST2 may include a gate electrode connected to the second gate line 16*b*, a drain electrode connected to the reference line 15, and a source electrode connected to the source node $N_s$. The second switching TFT ST2 may be turned on in response to the second scan control signal SC2 from the second gate line 16*b*, and may electrically connect the reference line 15 to the source node $N_s$. Hence, the second switching TFT ST2 may apply a reference voltage $V_{ref}$ to the source node $N_s$.

The storage capacitor $C_{st}$ may be connected between the gate node $N_g$ and the source node $N_s$, and may uniformly hold the gate node-to-source node voltage $V_{gs}$ of the driving TFT DT during an emission period. The emission control TFT ST3 may include a gate electrode connected to the third gate line 16*c*, a drain electrode connected to an input terminal of a high potential driving voltage VDD, and a source electrode connected to the drain node $N_d$. The emission control TFT ST3 may be turned on in response to the emission control signal EM from the third gate line 16*c*, and may apply the high potential driving voltage VDD to the drain node $N_d$.

The first to third pixels may be configured to be connected to at least one reference line 15. For example, as shown in FIG. 2, the first pixel, the second pixel, and the third pixel may be configured to share one reference line 15 with one another. According to the above-described configuration, because the number of reference lines 15 can be reduced, there is an advantage in that an aperture ratio of the pixel array can increase. For example, because the number of reference lines 15 may be reduced, more pixels can be arranged in the same area. Thus, there is an advantage in that a resolution can be increased. However, embodiments are not limited thereto. For example, the number of reference lines and the number and types of pixels sharing the reference line may be variously modified. According to the above-described configuration, the pixel array of the OLED display according to the example embodiment may include a circuit capable of compensating for luminance uniformity between the pixels.

Figure 3:
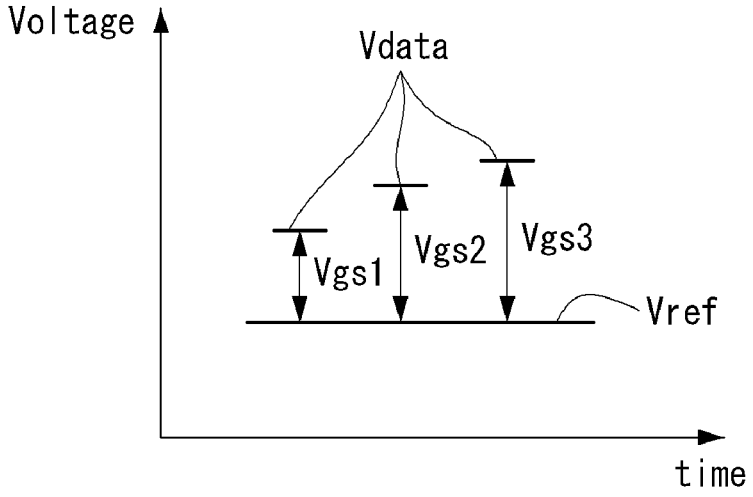
FIG. 3 is a graph illustrating a difference between gate node-to-source node voltages of a driving thin film transistor (TFT) depending on a data voltage in pixels of a display panel of an OLED display according to the example embodiment shown in FIG. 2.

FIG. 3 is a graph illustrating a difference between gate node-to-source node voltages of a driving TFT depending on a data voltage in pixels of a display panel of an OLED display according to the example embodiment shown in FIG. 2.

A gate node-to-source node voltage $V_{gs}$ set to a pixel P of an OLED display according to an example embodiment is described below with reference to FIG. 3. Pixels P of the pixel array of the display panel 10 shown in FIG. 2 may receive the data voltages $V_{data}$ controlled in accordance with a gamma grayscale representation manner in which a luminance increases in proportion to a magnitude of the data voltage $V_{data}$. The gamma grayscale representation manner may be configured to control the data voltage $V_{data}$ applied to the gate node $N_g$ within a voltage range greater than the reference voltage $V_{ref}$ of a fixed level applied to the source node $N_s$. The gamma grayscale representation manner may be characterized in that a driving current of the OLED and an amount of light emitted by the OLED increase when the data voltage $V_{data}$ increases, because the gate node-to-source node voltage $V_{gs}$ programmed in the driving TFT DT may increase as the data voltage $V_{data}$ increases.

For example, that three different data voltages $V_{data}$ may be applied to one pixel P. When a minimum data voltage $V_{data}$ is applied to the pixel P, a gate node-to-source node voltage $V_{gs}$ of the pixel P may be a first gate node-to-source node voltage $V_{gs1}$ on the left side of FIG. 3. When a middle data voltage $V_{data}$ is applied to the pixel P, the gate node-to-source node voltage $V_{gs}$ of the pixel P may be a second gate node-to-source node voltage $V_{gs2}$ in the center of FIG. 3. When a maximum data voltage $V_{data}$ is applied to the pixel P, the gate node-to-source node voltage $V_{gs}$ of the pixel P may be a third gate node-to-source node voltage $V_{gs3}$ on the right side of FIG. 3.

Figure 4:
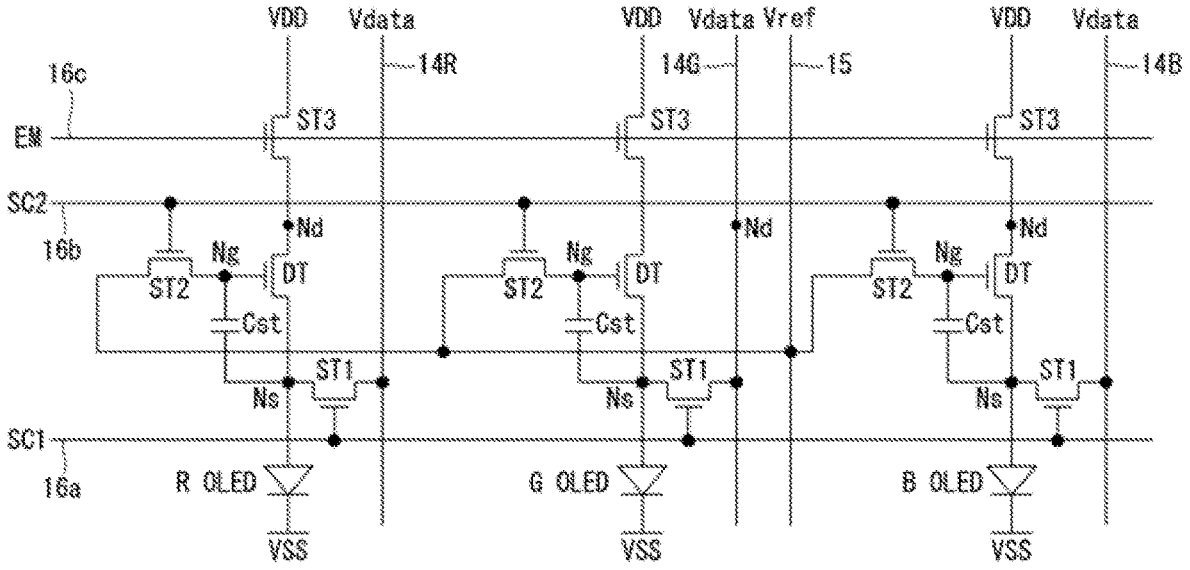
FIG. 4 is a circuit diagram of pixels included in a display panel of an OLED display according to an example embodiment.

FIG. 4 is a circuit diagram of pixels included in a display panel of an OLED display according to an example embodiment.

Pixels of an OLED display according to an example embodiment are described below with reference to FIG. 4. Configuration of an OLED display according to the FIG. 4 example is substantially the same as configuration of the OLED display according to the FIG. 2 example, except that a source electrode of a first switching TFT ST1 is not connected to a gate node $N_g$, and is connected to a source node $N_s$; and a source electrode of a second switching TFT ST2 is not connected to a source node $N_s$, and is connected to a gate node $N_g$. Therefore, duplicate description will be omitted for convenience of explanation.

The OLED display according to FIG. 4 is described below. A first switching TFT ST1 may include a gate electrode connected to a first gate line 16*a*, a drain electrode connected to a corresponding data line 14R, 14G, or 14B, and a source electrode connected to a source node $N_s$. The first switching TFT ST1 may be turned on in response to a first scan control signal SC1 from the first gate line 16*a*, and may electrically connect the corresponding data line 14R, 14G, or 14B to the source node $N_s$. Hence, the first switching TFT ST1 may apply a data voltage $V_{data}$ to the source node $N_s$.

The second switching TFT ST2 may include a gate electrode connected to a second gate line 16*b*, a drain electrode connected to a reference line 15, and a source electrode connected to a gate node $N_g$. The second switching TFT ST2 may be turned on in response to a second scan control signal SC2 from the second gate line 16*b*, and may electrically connect the reference line 15 to the gate node $N_g$. Hence, the second switching TFT ST2 may apply a reference voltage $V_{ref}$ to the gate node $N_g$. According to the above-described configuration, a pixel array of the OLED display according to an example embodiment may include a circuit capable of compensating for luminance uniformity between pixels.

Figure 5:
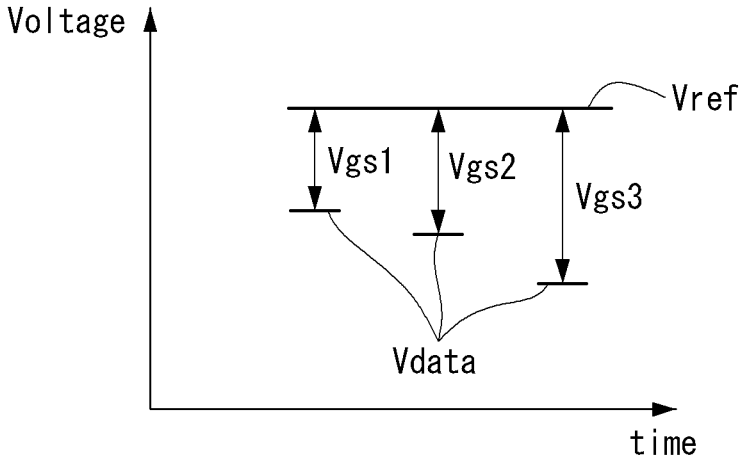
FIG. 5 is a graph illustrating a difference between gate node-to-source node voltages of a driving TFT depending on a data voltage in pixels of the display panel of an OLED display of FIG. 4.

FIG. 5 is a graph illustrating a difference between gate node-to-source node voltages of a driving TFT depending on a data voltage in pixels of the display panel of an OLED display of FIG. 4.

A gate node-to-source node voltage $V_{gs}$ set to a pixel P of an OLED display according to an example embodiment is described below with reference to FIG. 5. Pixels P of the pixel array of the display panel 10 shown in FIG. 4 may receive the data voltages $V_{data}$ controlled in accordance with an inverse gamma grayscale representation manner in which a luminance decreases in proportion to a magnitude of the data voltage $V_{data}$. The inverse gamma grayscale representation manner may be configured to control the data voltage $V_{data}$ applied to the source node $N_s$ within a voltage range less than the reference voltage $V_{ref}$ of a fixed level applied to the gate node $N_g$. The inverse gamma grayscale representation manner may be characterized in that a driving current and an amount of light emitted by the OLED decrease when the data voltage $V_{data}$ increases because the gate node-to-source node voltage $V_{gs}$ programmed in the driving TFT DT decreases as the data voltage $V_{data}$ increases.

For example, three different data voltages $V_{data}$ may be applied to one pixel P. When a maximum data voltage $V_{data}$ is applied to the pixel P, a gate node-to-source node voltage $V_{gs}$ of the pixel P may be a first gate node-to-source node voltage $V_{gs1}$ on the left side of FIG. 5. When a middle data voltage $V_{data}$ is applied to the pixel P, the gate node-to-source node voltage $V_{gs}$ of the pixel P may be a second gate node-to-source node voltage $V_{gs2}$ in the center of FIG. 5. When a minimum data voltage $V_{data}$ is applied to the pixel P, the gate node-to-source node voltage $V_{gs}$ of the pixel P may be a third gate node-to-source node voltage $V_{gs3}$ on the right side of FIG. 5.

FIGS. 2 and 4 illustrate that all of the TFTs included in the pixels may be implemented as n-type TFTs, by way of example. However, embodiments are not limited thereto. For example, the TFTs included in the pixels may be implemented as p-type TFTs, and may also be implemented in a hybrid manner in which n-type TFTs and p-type TFTs are combined. For example, a hybrid TFT may be used, in which an n-type oxide semiconductor TFT and a p-type polysilicon TFT are combined.

In addition, all of semiconductor layers of TFTs included in a pixel may be made of amorphous silicon, may be made of polysilicon, and may be made of oxide. Further, semiconductor layers of TFTs included in a pixel may be made of at least one of amorphous silicon, polysilicon, and oxide. Further, some TFTs of a pixel may include a polysilicon semiconductor layer, and remaining TFTs of the pixel may include an oxide semiconductor layer. The oxide TFT including the oxide semiconductor layer may have a good off-current characteristic. The "good off-current characteristic" means that a leakage current is small in an off-state. Thus, the oxide TFT may be used for a TFT (e.g., the first and second switching TFTs) that may be turned on for a short period of time of one frame, and may continuously maintain a turn-off state for a remaining time of one frame. A polysilicon TFT including a polysilicon semiconductor layer may have high electron mobility. The "high electron mobility" means that a current transfer performance per unit time is good. Thus, the polysilicon TFT may be used for a driving TFT serving as a driving element and an emission control TFT directly applying electric power to a driving TFT. However, embodiments are not limited to these examples.

Figure 6:
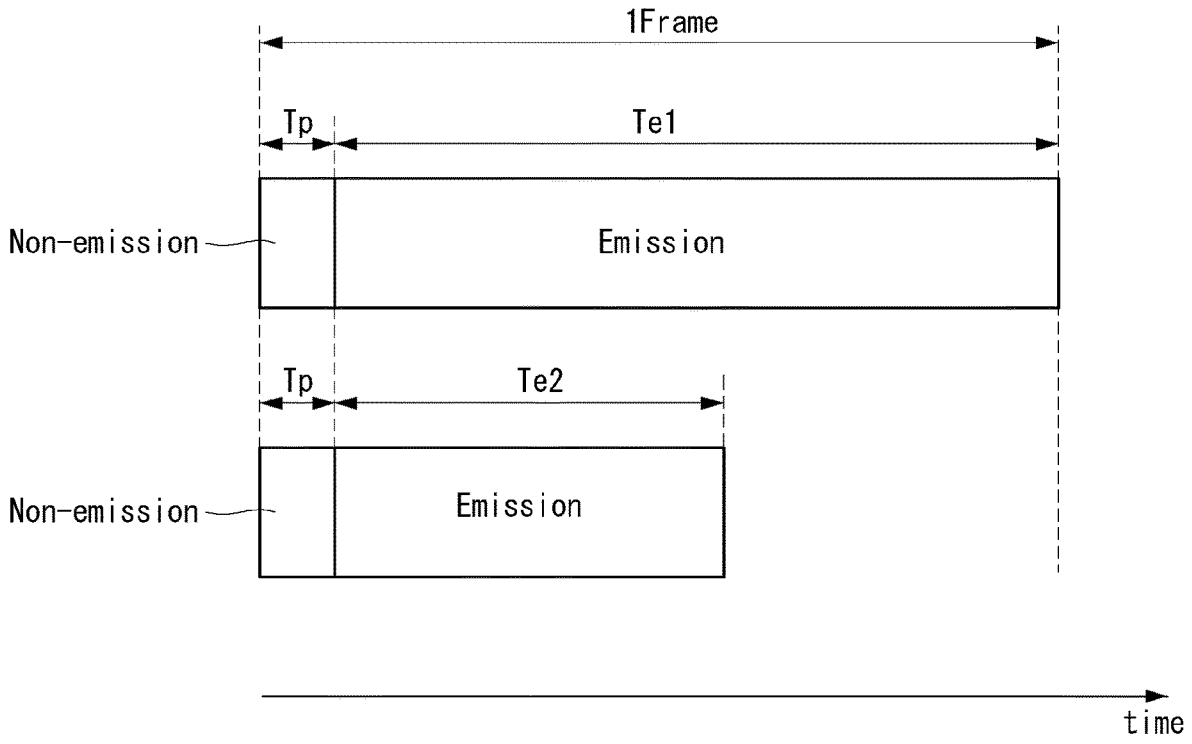
FIG. 6 is a diagram illustrating a driving method of controlling an on-duty of an emission control TFT in an emission period of pixels of FIGS. 2 and 4.

FIG. 6 is a diagram illustrating a driving method of controlling an on-duty of an emission control TFT in an emission period of pixels of FIGS. 2 and 4.

A driving method according to an example embodiment is described below with reference to FIG. 6. A length of an emission period of one frame may be adjusted by adjusting an on-duty of an emission control signal EM. In FIG. 6, "$T_{e1}$" indicates an emission period when the on-duty of the emission control signal EM is adjusted to be relatively long, and "$T_{e2}$" indicates an emission period when the on-duty of the emission control signal EM is adjusted to be relatively short.

The emission control TFT ST3 included in the pixel of FIGS. 2 and 4 may perform a pulse duty drive by the emission control signal EM. The pulse duty drive may control an on-time (e.g., the emission period) of the emission control TFT ST3 in one frame, and thus, can provide various additional functions.

For example, when a grayscale is represented by only N-bit video data, only 2N gray levels may be represented. On the other hand, when a grayscale is represented by N-bit video data and a pulse duty, gray levels greater than 2N may be represented. For example, the grayscale can be represented in more detail. However, the OLED displays according to embodiments are not limited thereto.

For example, the emission control signal EM may be transitioned several times during one frame. For example, the emission control signal EM in the emission periods $T_{e1}$ and $T_{e2}$ shown in FIG. 6 may have a pulse form in which an on-state and an off-state are repeated several times. According to the above-described configuration, there may be an advantage in that a flicker can be reduced when the on-duty is implemented. However, the OLED displays according to embodiments are not limited thereto.

For example, there may be an advantage in that a maximum luminance of the OLED display can be controlled by the pulse duty drive. For example, there may be an advantage in that the length of the emission period can be controlled in consideration of brightness of external light or power consumption. Further, an illuminance sensor for measuring the external light may be added, and an algorithm for measuring the power consumption may be added. However, the OLED displays according to embodiments are not limited thereto.

For example, an emission period of each of the third gate lines 16*c* of the OLED display may be controlled by the pulse duty drive. For example, one third gate line 16*c* may simultaneously control emission periods of pixels connected to the one third gate line 16*c*. Thus, emission periods of one third gate line 16*c* and another third gate line 16*c* adjacent to the one third gate line 16*c* may be differently controlled and may be differently controlled in each frame. According to the above-described configuration, there may be an advantage in that pixels connected to each the third gate lines 16*c* can individually achieve the detailed grayscale representation and/or a reduction in the power consumption in each frame. However, the OLED displays according to embodiments are not limited thereto.

For example, the emission control signal EM may at least include a particular off-period (e.g., a reset period) by applying a principle of the pulse duty drive. According to the above-described configuration, even when the pulse duty drive is not used, the emission control signal EM may be transitioned to an off-level during a particular period of one frame. Therefore, degradation of a positive bias stress of the emission control TFT ST3 generated by continuously maintaining the emission control signal EM at an on-level can be reduced. For example, a bias stress applied to the emission control TFT ST3 can be reduced using the off-period (e.g., the reset period) of the emission control signal EM. However, the OLED displays according to embodiments are not limited thereto.

The following example embodiments will be described and regarded as applying at least one of the above-described pulse duty driving methods.

Figure 7:
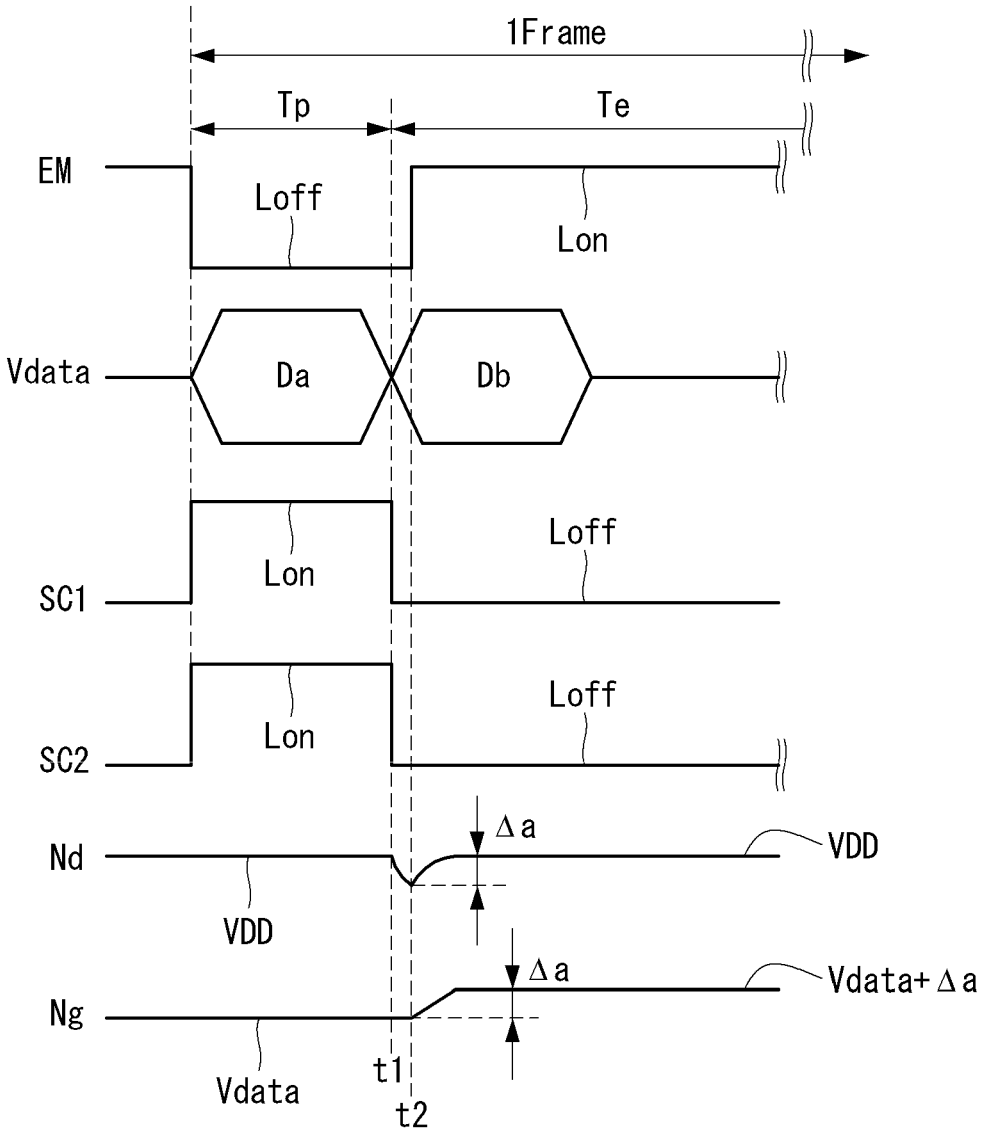
FIG. 7 is a comparative example and is a waveform diagram capable of driving the pixel array of FIG. 2.
Figure 8:
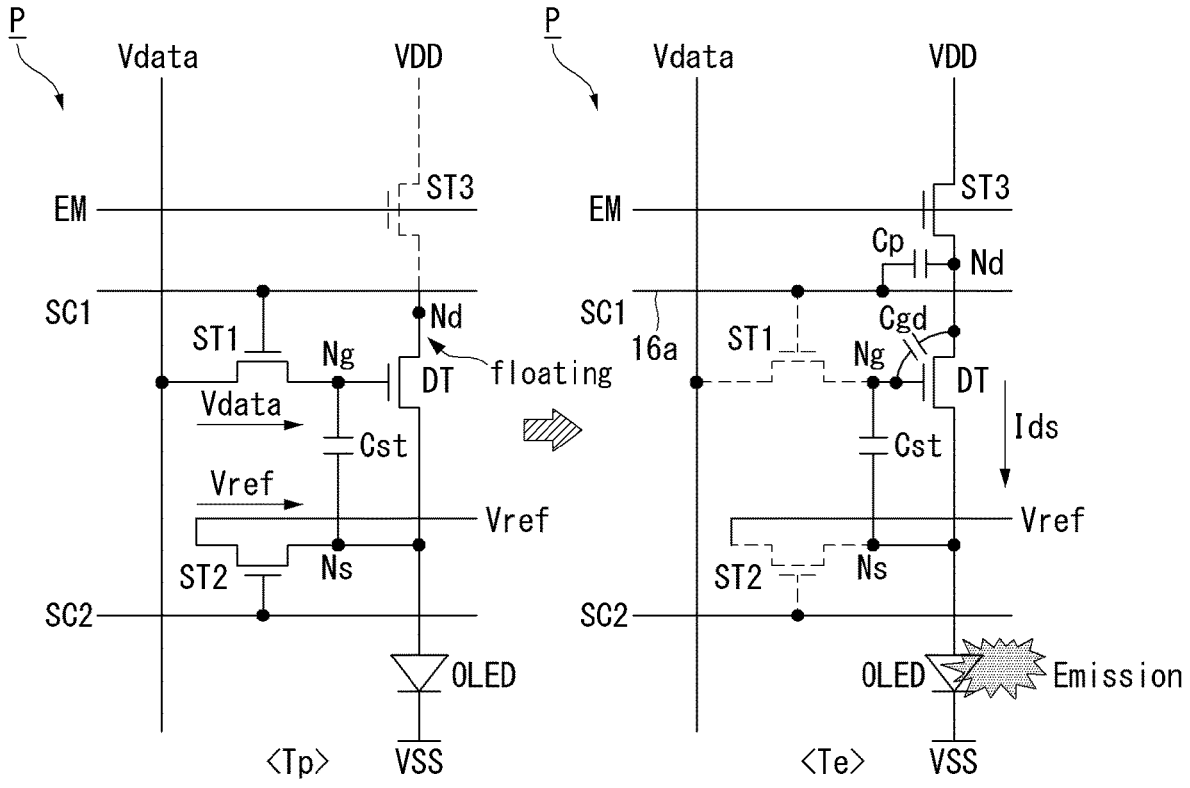
FIG. 8 is a comparative example and is a circuit diagram corresponding to FIG. 7.

FIG. 7 is a comparative example and is a waveform diagram capable of driving the pixel array of FIG. 2. FIG. 8 is a comparative example and is a circuit diagram corresponding to FIG. 7.

According to a comparative example, when a switching TFT is turned off in an emission period, a problem of luminance distortion is generated by an effect of kickback. More specifically, a principle that the luminance distortion occurs when an existing driving waveform as shown in FIG. 7 is applied to the pixel P shown in FIG. 2 will be described.

The principle is described with reference to FIGS. 7 and 8. In a display drive, one frame period includes a programming period $T_p$ in which the gate node-to-source node voltage $V_{gs}$ of the driving TFT DT is set (or programmed), and an emission period $T_e$ in which the OLED emits light by a driving current corresponding to the programmed gate node-to-source node voltage $V_{gs}$.

During the programming period $T_p$, the first switching TFT ST1 may be turned on in response to the first scan control signal SC1 of an on-level $L_{on}$, and may apply the data voltage $V_{data}$ (e.g., of a voltage level $D_a$) to the gate node $N_g$; and the second switching TFT ST2 may be turned on in response to the second scan control signal SC2 of an on-level $L_{on}$, and may apply the reference voltage $V_{ref}$ to the source node $N_s$. Hence, the gate node-to-source node voltage $V_{gs}$ of the driving TFT DT may be programmed to ($V_{data}-V_{ref}$). During the programming period $T_p$, the emission control TFT ST3 may be turned off in response to the emission control signal EM of an off-level $L_{off}$, and may float the drain node $N_d$. Hence, a current can be prevented or reduced from flowing through the driving TFT DT.

At a time $t_1$ of the emission period $T_e$, the first and second scan control signals SC1 and SC2 for the display drive may be transitioned from the on-level $L_{on}$ to the off-level $L_{off}$. Hence, the first switching TFT ST1 and the second switching TFT ST2 may be turned off at the time $t_1$, and may maintain a turn-off state during the emission period $T_e$. At a time $t_2$ of the emission period $T_e$ later than the time $t_1$, the emission control signal EM may be transitioned from the off-level $L_{off}$ to the on-level $L_{on}$, and may turn on the emission control TFT ST3.

Because the emission control signal EM may have the off-level $L_{off}$ at the time $t_1$ of the emission period $T_e$, the drain node $N_d$ may be in a floating state by the emission control TFT ST3 that may be turned off at the time $t_1$. Thus, when the first switching TFT ST1 is turned off at the time $t_1$, the drain node $N_d$ may be affected by the kickback due to a parasitic capacitance $C_p$ between the gate electrode of the first switching TFT ST1 and the drain node $N_d$. For example, a potential of the drain node $N_d$ may decrease from the high potential driving voltage VDD by Δa in synchronization with the falling of the first scan control signal SC1 at the time $t_1$. Subsequently, when the emission control TFT ST3 is turned on at the time $t_2$, the potential of the drain node $N_d$ may increase by Δa, and thus, may be restored to the high potential driving voltage VDD.

A parasitic capacitance $C_{gd}$ may exist between the gate node $N_g$ and the drain node $N_d$ of the driving TFT DT, and the gate node $N_g$ may be in a floating state at the time $t_2$. Therefore, when a potential of the drain node $N_d$ changes at the time $t_2$, a potential of the gate node $N_g$ may also increase by approximately Δa. For example, in the emission period $T_e$, the potential of the gate node $N_g$ may change to a voltage level ($V_{data}$+Δa) that is greater than the data voltage $V_{data}$ by approximately Δa.

When the potential of the gate node $N_g$ of the driving TFT DT, that may be programmed in the programming period $T_p$, changes in the emission period $T_e$ as described above, the gate node-to-source node voltage $V_{gs}$ may be distorted. This may be recognized as a change in the luminance. As a result, if the driving TFT DT is not connected to the input terminal of the high potential driving voltage VDD, and is in a floating state when the first switching TFT ST1 is turned off in the emission period $T_e$, the luminance distortion may be caused by the effect of kickback resulting from the parasitic capacitance.

Figure 9:
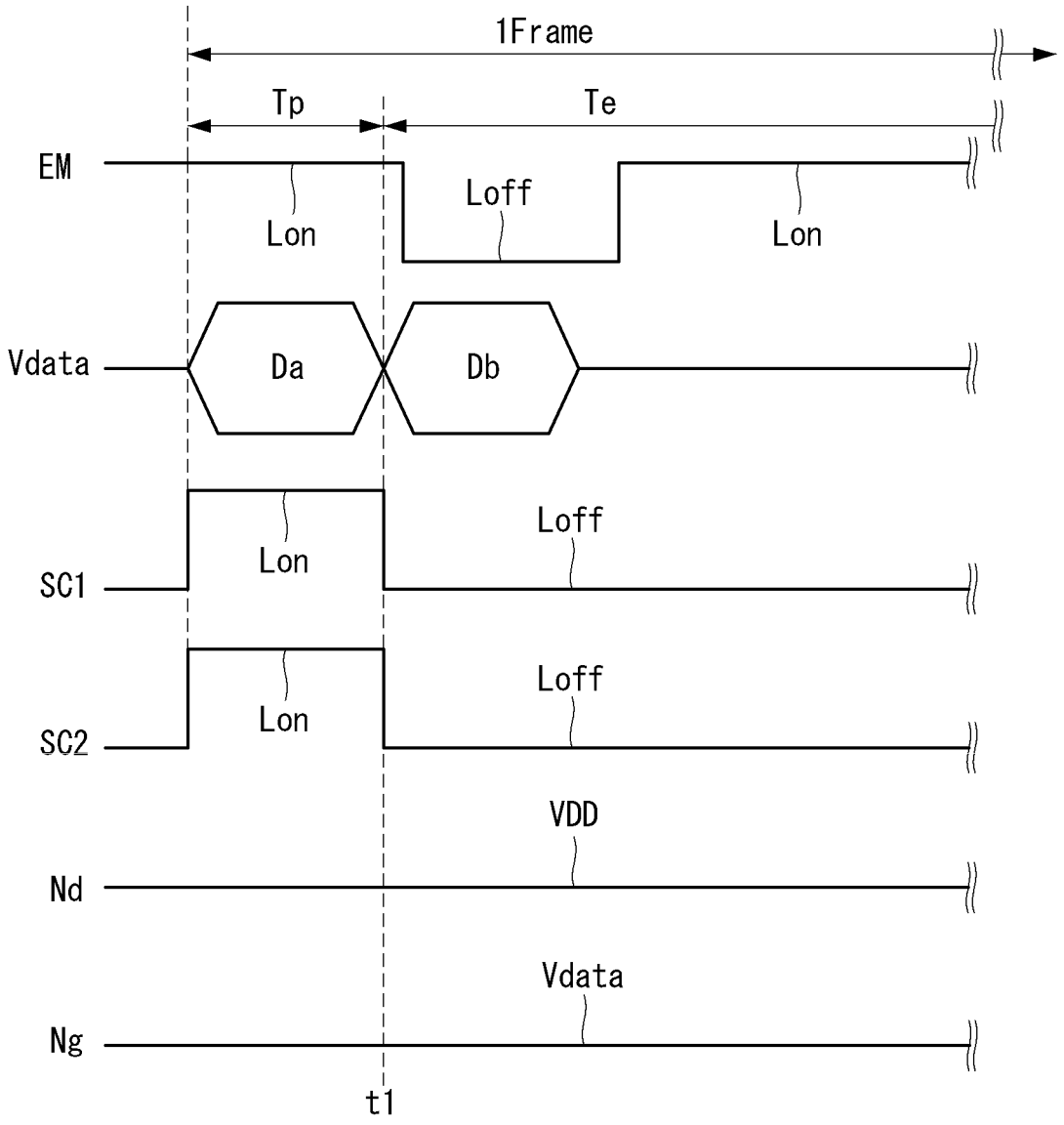
FIG. 9 is a waveform diagram illustrating a method of driving an OLED display according to an example embodiment.
Figure 10:
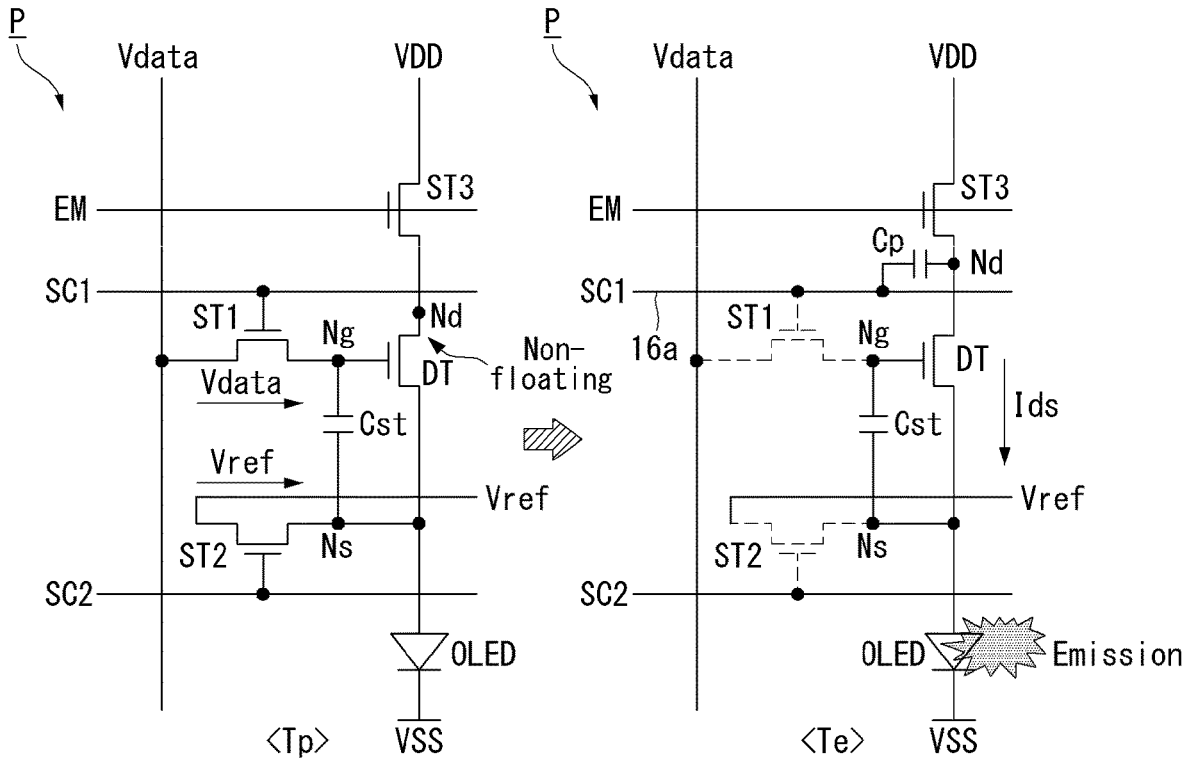
FIG. 10 is a circuit diagram illustrating a drive of a pixel array of FIG. 2 in accordance with a driving method of FIG. 9.

FIG. 9 is a waveform diagram illustrating a method of driving an OLED display according to an example embodiment. FIG. 10 is a circuit diagram illustrating a drive of the pixel array of FIG. 2 in accordance with the driving method of FIG. 9.

A method of driving an OLED display according to an example embodiment is described below with reference to FIGS. 9 and 10. During the programming period $T_p$, the first switching TFT ST1 may be turned on in response to the first scan control signal SC1 of an on-level $L_{on}$, and may apply the data voltage $V_{data}$ (e.g., of a voltage level $D_a$) to the gate node $N_g$, and the second switching TFT ST2 may be turned on in response to the second scan control signal SC2 of an on-level $L_{on}$, and may apply the reference voltage $V_{ref}$ to the source node $N_s$. Hence, the gate node-to-source node voltage $V_{gs}$ of the driving TFT DT may be programmed to ($V_{data}$−$V_{ref}$).

During the programming period $T_p$, the emission control TFT ST3 may be turned on in response to the emission control signal EM of an on-level $L_{on}$. Hence, the emission control TFT ST3 may reduce or prevent the floating of the drain node $N_d$, and may connect the drain node $N_d$ to the input terminal of the high potential driving voltage VDD.

According to the above-described configuration, because the drain node $N_d$ may not be in a floating state, there may be an advantage in that the kickback generated in the driving method illustrated in FIGS. 7 and 8 may not occur. However, during the programming period $T_p$, the high potential driving voltage VDD may be applied to the drain node $N_d$ through the emission control TFT ST3. For example, because the drain electrode of the driving TFT DT may be connected to the input terminal of the high potential driving voltage VDD, a transient current may flow in the driving TFT DT during the programming period $T_p$. For example, the transient current is a phenomenon that may occur when the emission control TFT ST3 is turned on during the programming period Tp to compensate for the kickback phenomenon.

Thus, so that the OLED display according to an embodiment can compensate for the kickback phenomenon, and at the same time compensate for an erroneous operation (e.g., erroneous emission) of the OLED resulting from the transient current, the OLED electrically connected to the source node $N_s$ may be configured to receive the reference voltage $V_{ref}$ that may be less than an operating point voltage (e.g., a threshold voltage) of the OLED. For example, the reference voltage $V_{ref}$ may be less than the operating point voltage. Further, a minimum of data voltage $V_{data}$ may be greater than the reference voltage $V_{ref}$.

In addition, as described above, the pixel array of the OLED display according to an embodiment shown in FIG. 10 uses the gamma grayscale representation shown in FIG. 3. According to the above-described configuration, there may be an advantage in that the transient current may not be applied to the OLED, and may be sunk to the reference line 15. For example, the reference voltage $V_{ref}$ may be referred to as a voltage for bypassing the transient current. The undesired transient current does not flow in the anode electrode of the OLED by the voltage for bypassing the transient current, and may flow in the reference line 15 through the second switching TFT ST2.

Further, the data voltage $V_{data}$ may be configured to correspond to the voltage for bypassing the transient current. For example, the reference voltage $V_{ref}$ may be set to a value capable of preventing the transient current that may flow in the OLED. In this instance, because the gate node-to-source node voltage $V_{gs}$ of the driving TFT DT may be ($V_{data}$−$V_{ref}$), the data voltage $V_{data}$ may be set to correspond to the voltage for bypassing the transient current so that the gate node-to-source node voltage $V_{gs}$ can be set. According to the above-described configuration, the data voltage $V_{data}$ may be set to correspond to the voltage for bypassing the transient current, and may allow the OLED display to display a desired luminance.

At the time $t_1$ of the emission period $T_e$, the first and second scan control signals SC1 and SC2 may be transitioned from the on-level $L_{on}$ to the off-level $L_{off}$. Hence, the first switching TFT ST1 and the second switching TFT ST2 may be turned off at the time $t_1$, and may maintain the turn-off state during the emission period $T_e$. At the time $t_1$, the emission control signal EM may be maintained at the on-level $L_{on}$, and may continuously turn on the emission control TFT ST3.

At the time $t_1$ of the emission period $T_e$, because the emission control signal EM may have the on-level $L_{on}$, the electrical connection between the drain node $N_d$ and the input terminal of the high potential driving voltage VDD may be maintained. Thus, even when the first switching TFT ST1 is turned off at the time $t_1$, the drain node $N_d$ may not be affected by the kickback. For example, even when the falling of the first scan control signal SC1 is generated at the time $t_1$, the potential of the drain node $N_d$ may hold a level of the high potential driving voltage VDD. Because the potential of the drain node $N_d$ may not change at the time $t_1$, the potential of the gate node $N_g$ may not change, and may hold the programmed data voltage $V_{data}$. When the first switching TFT ST1 is turned off in the emission period $T_e$, the effect of kickback resulting from the parasitic capacitance can be reduced or prevented if the electrical connection between the input terminal of the high potential driving voltage VDD and the driving TFT DT is maintained. As a result, the luminance distortion can be prevented or compensated.

In other words, the OLED display according to an embodiment may be configured such that the emission control signal EM may be maintained at the on-level $L_{on}$ for a particular time from the time $t_1$ at which the first switching TFT ST1 may be turned off. For example, the emission control signal EM may be delayed in a state of the on-level for a particular time from the time $t_1$, and then may be turned off.

For example, a delay time may be equal to or greater than one horizontal period. One horizontal period means one clock period, e.g., of a dot clock, which may be a driving frequency of a driver for driving the emission control signal EM of the OLED display. However, embodiments are not limited thereto.

According to the above-described configuration, because the emission control TFT ST3 can maintain the turn-on state at the time $t_1$ at which the first switching TFT ST1 is turned off, the effect of kickback can be efficiently reduced or prevented.

Thus, the emission control signal EM may be at the off-level $L_{off}$ after the particular time passed from the time $t_1$. In addition, after the particular time passed from the time $t_1$, the emission control signal EM may have a particular duty in accordance with the pulse duty drive illustrated in FIG. 6.

According to the above-described configuration, embodiments of the present disclosure can reduce or prevent the effect of kickback resulting from the parasitic capacitance, compensate for the luminance distortion, and perform the pulse duty drive.

Figure 11:
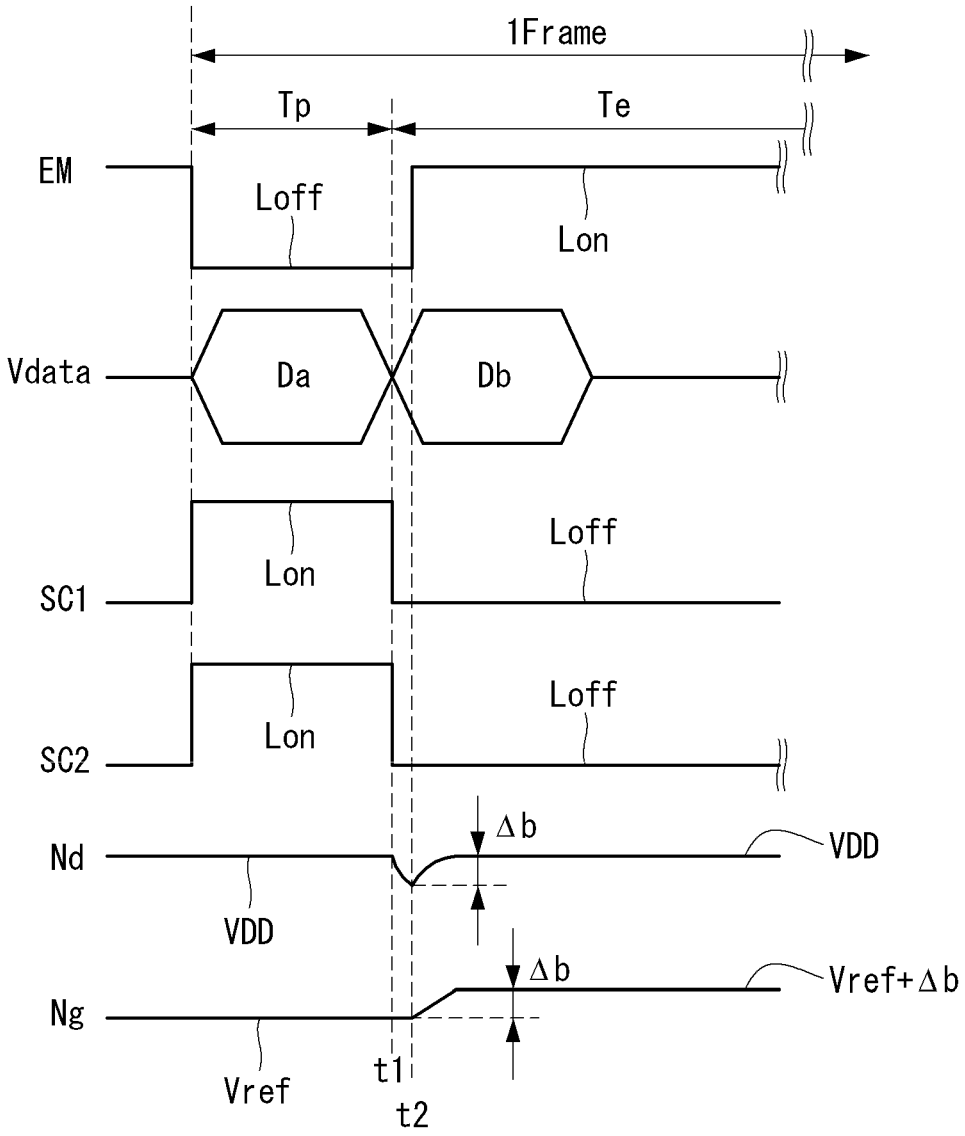
FIG. 11 is a comparative example and is a waveform diagram capable of driving the pixel array of FIG. 4.
Figure 12:
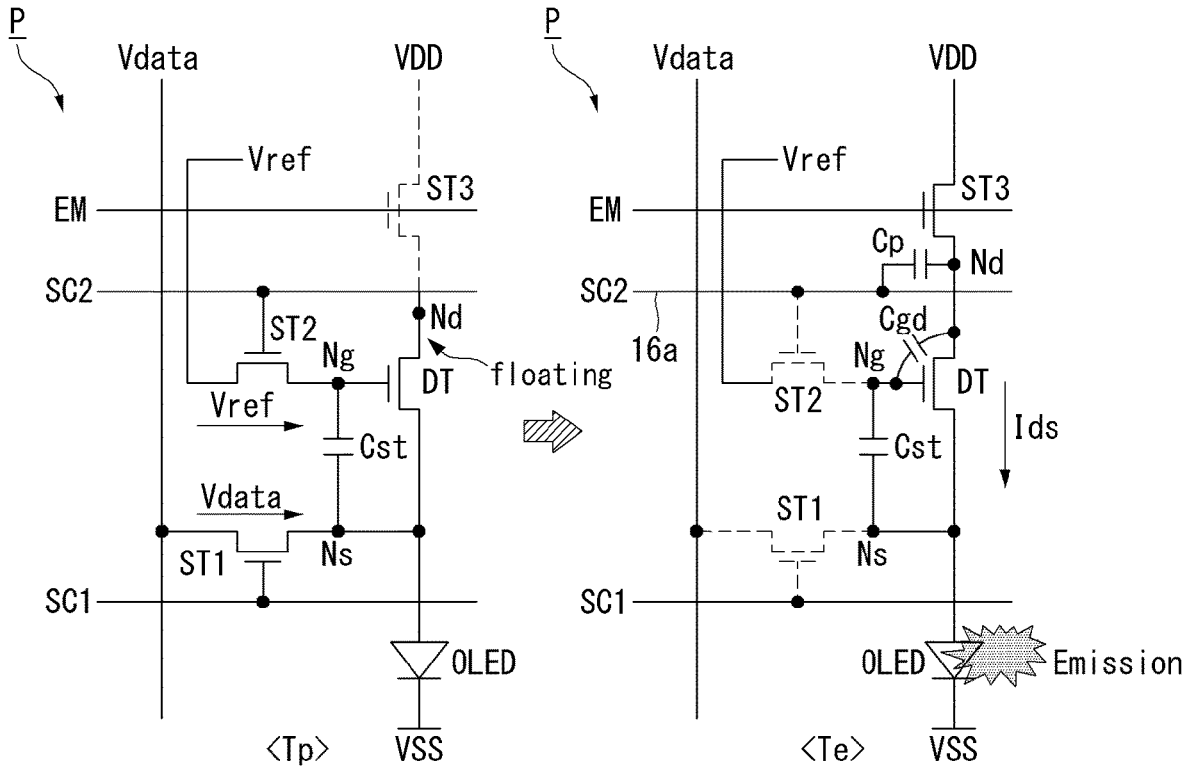
FIG. 12 is a comparative example and is a circuit diagram corresponding to FIG. 11.

FIG. 11 is a comparative example and is a waveform diagram capable of driving the pixel array of FIG. 4. FIG. 12 is a comparative example and is a circuit diagram corresponding to FIG. 11.

According to a comparative example, when a switching TFT is turned on in an emission period, luminance distortion is generated by an effect of kickback. More specifically, a principle that the luminance distortion that occurs when an existing driving waveform as shown in FIG. 11 is applied to the pixel P shown in FIG. 4 will be described.

The principle is described with reference to FIGS. 11 and 12. In a display drive, one frame period includes a programming period $T_p$ in which the gate node-to-source node voltage $V_{gs}$ of the driving TFT DT is set (or programmed), and an emission period $T_e$ in which the OLED emits light by a driving current corresponding to the programmed gate node-to-source node voltage $V_{gs}$. During the programming period $T_p$, the second switching TFT ST2 is turned on in response to the second scan control signal SC2 of an on-level $L_{on}$ and applies the reference voltage $V_{ref}$ to the gate node $N_g$, and the first switching TFT ST1 is turned on in response to the first scan control signal SC1 of an on-level $L_{on}$ and applies the data voltage $V_{data}$ (e.g., of a voltage level $D_a$) to the source node $N_s$. Hence, the gate node-to-source node voltage $V_{gs}$ of the driving TFT DT is programmed to ($V_{ref}$–$V_{data}$). During the programming period $T_p$, the emission control TFT ST3 is turned off in response to the emission control signal EM of an off-level $L_{off}$ and floats the drain node $N_d$. Hence, a current can be prevented or reduced from flowing through the driving TFT DT.

At a time $t_1$ of the emission period $T_e$, the first and second scan control signals SC1 and SC2 for the display drive are transitioned from the on-level $L_{on}$ to the off-level $L_{off}$. Hence, the first switching TFT ST1 and the second switching TFT ST2 are turned off at the time $t_1$ and maintain a turn-off state during the emission period $T_e$. At a time $t_2$ of the emission period $T_e$ later than the time $t_1$, the emission control signal EM is transitioned from the off-level $L_{off}$ to the on-level $L_{on}$ and turns on the emission control TFT ST3.

Because the emission control signal EM has the off-level $L_{off}$ at the time $t_1$ of the emission period $T_e$, the drain node $N_d$ is in a floating state by the emission control TFT ST3 that is turned off at the time $t_1$. Thus, when the second switching TFT ST2 is turned off at the time $t_1$, the drain node $N_d$ is affected by the kickback due to a parasitic capacitance $C_p$ between the gate electrode of the second switching TFT ST2 and the drain node $N_d$. For example, a potential of the drain node $N_d$ decreases from the high potential driving voltage VDD by Δb in synchronization with the falling of the second scan control signal SC2 at the time $t_1$. Subsequently, when the emission control TFT ST3 is turned on at the time $t_2$, the potential of the drain node $N_d$ increases by Δb, and thus, is restored to the high potential driving voltage VDD.

A parasitic capacitance $C_{gd}$ exists between the gate node $N_g$ and the drain node $N_d$ of the driving TFT DT, and the gate node $N_g$ is in a floating state at the time $t_2$. Therefore, when a potential of the drain node $N_d$ changes at the time $t_2$, a potential of the gate node $N_g$ also increases by approximately Δb. For example, in the emission period $T_e$, the potential of the gate node $N_g$ changes to a voltage level ($V_{ref}$+Δb) that is greater than the reference voltage $V_{ref}$ by approximately Δb.

When the potential of the gate node $N_g$ of the driving TFT DT, that is programmed in the programming period $T_p$, changes in the emission period $T_e$ as described above, the gate node-to-source node voltage $V_{gs}$ is distorted. This is recognized as a change in the luminance. As a result, if the driving TFT DT is not connected to the input terminal of the high potential driving voltage VDD, and is in a floating state when the second switching TFT ST2 is turned off in the emission period $T_e$, the luminance distortion may be caused by the effect of kickback resulting from the parasitic capacitance.

Figure 13:
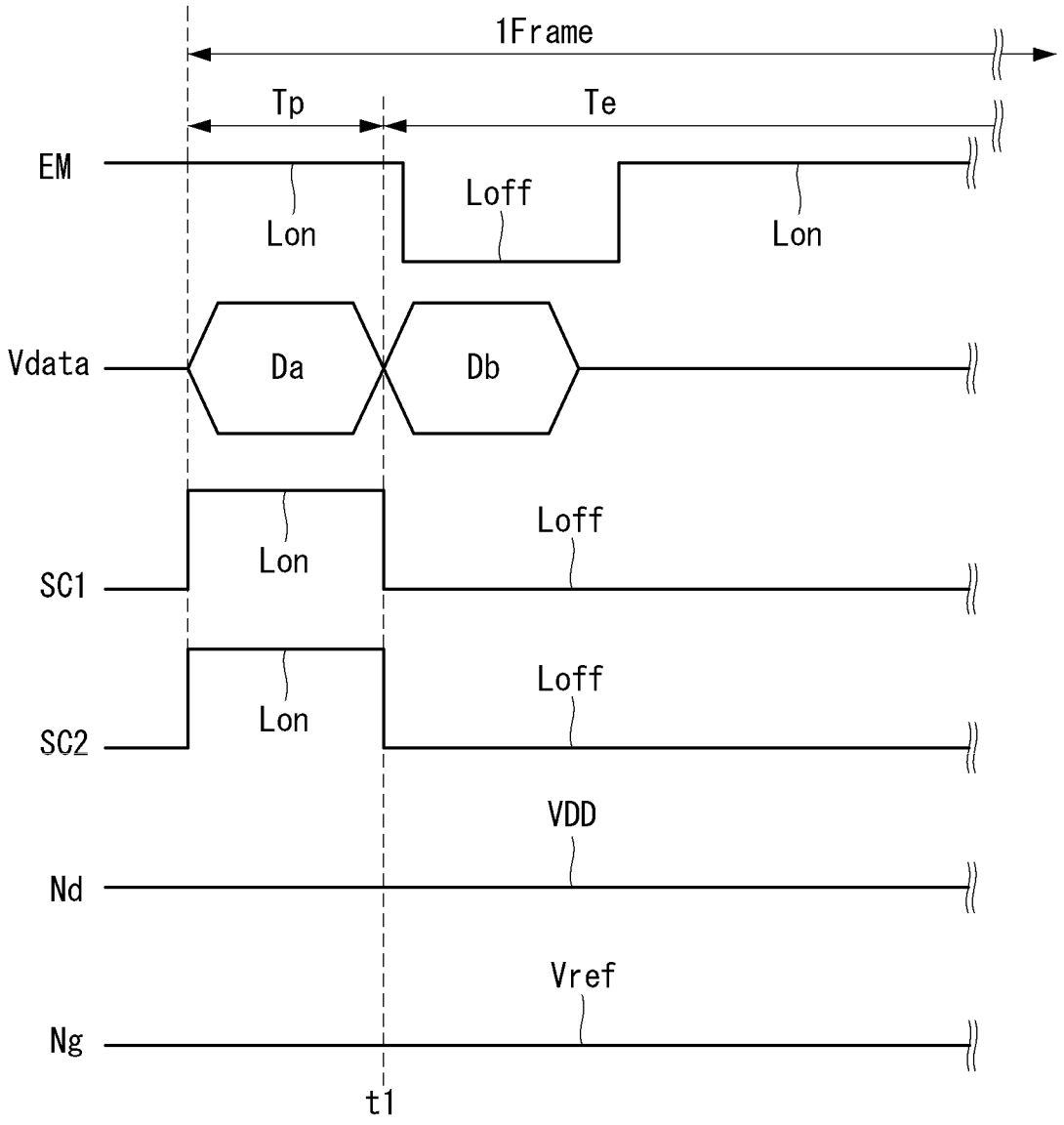
FIG. 13 is a waveform diagram illustrating a method of driving an OLED display according to an example embodiment.
Figure 14:
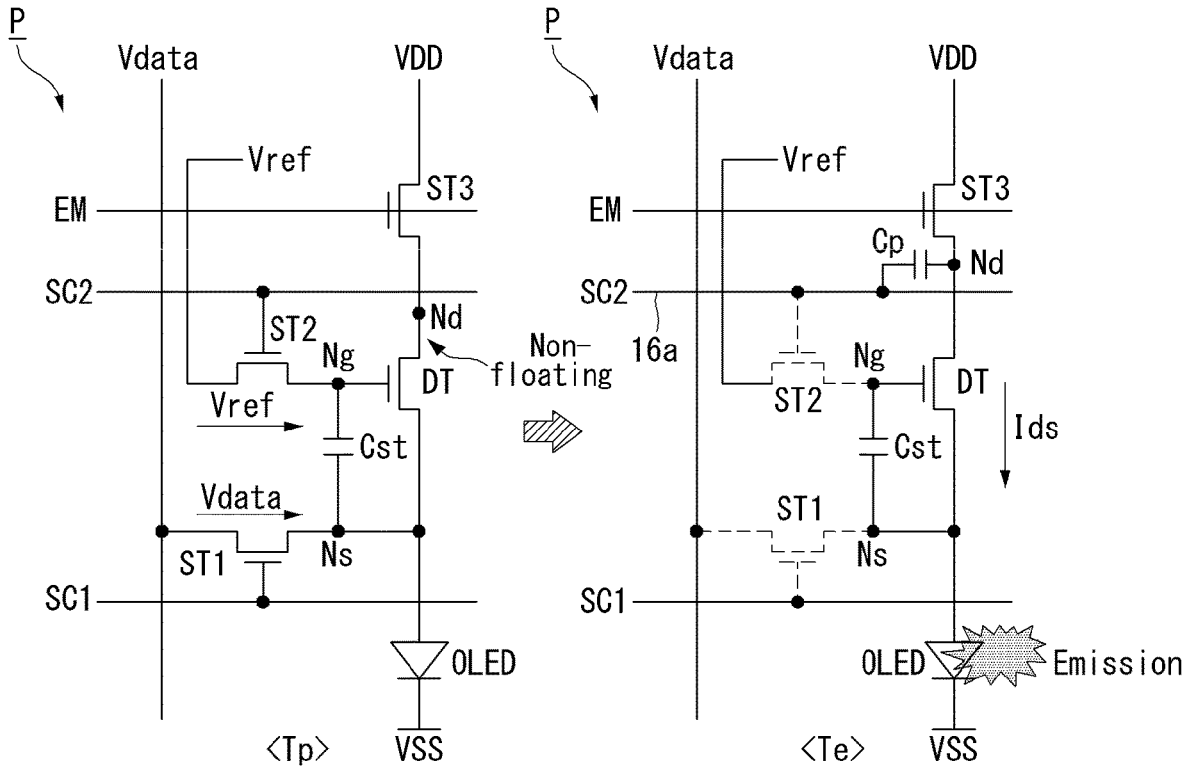
FIG. 14 is a circuit diagram illustrating a drive of a pixel array of FIG. 4 in accordance with the driving method of FIG. 13.

FIG. 13 is a waveform diagram illustrating a method of driving an OLED display according to an example embodiment. FIG. 14 is a circuit diagram illustrating a drive of the pixel array of FIG. 4 in accordance with the driving method of FIG. 13.

A method of driving an OLED display according to an example embodiment is described below with reference to FIGS. 13 and 14. During the programming period $T_p$, the first switching TFT ST1 may be turned on in response to the first scan control signal SC1 of an on-level $L_{on}$, and may apply the data voltage $V_{data}$ (e.g., of a voltage level $D_a$) to the source node $N_s$, and the second switching TFT ST2 may be turned on in response to the second scan control signal SC2 of an on-level $L_{on}$, and may apply the reference voltage $V_{ref}$ to the gate node $N_g$. Hence, the gate node-to-source node voltage $V_{gs}$ of the driving TFT DT may be programmed to ($V_{ref}$–$V_{data}$).

During the programming period Tp, the emission control TFT ST3 may be turned on in response to the emission control signal EM of an on-level $L_{on}$. Hence, the emission control TFT ST3 may reduce or prevent the floating of the drain node $N_d$, and may connect the drain node $N_d$ to the input terminal of the high potential driving voltage VDD.

According to the above-described configuration, because the drain node $N_d$ may not be in a floating state, there may be an advantage in that the kickback generated in the driving method illustrated in comparative examples of FIGS. 11 and 12 may not occur. However, because the high potential driving voltage VDD may be applied to the drain node $N_d$ through the emission control TFT ST3 during the programming period $T_p$, a transient current may flow in the driving TFT DT during the programming period $T_p$. For example, the transient current is a phenomenon that may occur when the emission control TFT ST3 is turned on during the programming period $T_p$ to compensate for the kickback phenomenon.

Thus, so that the OLED display according to an example embodiment can compensate for the kickback phenomenon and at the same time compensate for an erroneous operation (e.g., erroneous emission) of the OLED resulting from the transient current, the OLED electrically connected to the source node $N_s$ may be configured to receive the data voltage Vdata that may be less than an operating point voltage (e.g., a threshold voltage) of the OLED. For example, a maximum data voltage $V_{data}$ may be configured to be less than the operating point voltage. Further, the reference voltage $V_{ref}$ may be configured to be greater than the maximum data voltage $V_{data}$.

In addition, as described above, the pixel array of the OLED display according to an example embodiment shown in the FIG. 14 example may use the inverse gamma gray-scale representation shown in the FIG. 5 example.

According to the above-described configuration, there may be an advantage in that the transient current may not be applied to the OLED, and may be sunk to the data line 14. For example, the data voltage $V_{data}$ may be referred to as a voltage for bypassing the transient current. The undesired transient current may not flow in the anode electrode of the OLED by the voltage for bypassing the transient current, and may flow in the data line 14 through the first switching TFT ST1.

Further, the reference voltage $V_{ref}$ may be configured to correspond to the voltage for bypassing the transient current. For example, the data voltage $V_{data}$ may be set to a value capable of reducing or preventing the transient current that may flow in the OLED. In this instance, because the gate node-to-source node voltage $V_{gs}$ of the driving TFT DT may be ($V_{ref}$–$V_{data}$), the reference voltage $V_{ref}$ may be set to correspond to the voltage for bypassing the transient current so that the gate node-to-source node voltage $V_{gs}$ can be set. According to the above-described configuration, the reference voltage $V_{ref}$ may be set to correspond to the voltage for bypassing the transient current, and can allow the OLED display to display a desired luminance.

At the time $t_1$ of the emission period $T_e$, the first and second scan control signals SC1 and SC2 may be transitioned from the on-level $L_{on}$ to the off-level $L_{off}$. Hence, the first switching TFT ST1 and the second switching TFT ST2 may be turned off at the time $t_1$, and may maintain the turn-off state during the emission period $T_e$. At the time $t_1$, the emission control signal EM may be maintained at the on-level $L_{on}$, and may continuously turn on the emission control TFT ST3.

At the time $t_1$ of the emission period $T_e$, because the emission control signal EM may have the on-level $L_{on}$, the electrical connection between the drain node $N_d$ and the input terminal of the high potential driving voltage VDD may be maintained. Thus, even when the second switching TFT ST2 is turned off at the time $t_1$, the drain node $N_d$ may not be affected by the kickback. For example, even when the falling of the second scan control signal SC2 is generated at the time $t_1$, the potential of the drain node $N_d$ may hold a level of the high potential driving voltage VDD. Because the potential of the drain node $N_d$ may not change at the time $t_1$, the potential of the gate node $N_g$ may not change, and may hold the programmed reference voltage $V_{ref}$. When the second switching TFT ST2 is turned off in the emission period $T_e$, the effect of kickback resulting from the parasitic capacitance can be reduced or prevented if the electrical connection between the input terminal of the high potential driving voltage VDD and the driving TFT DT is maintained. As a result, the luminance distortion can be prevented or compensated.

In other words, the OLED display according to another example embodiment may be configured such that the emission control signal EM may be maintained at the on-level $L_{on}$ for a particular time from the time $t_1$, at which the second switching TFT ST2 may be turned off. For example, the emission control signal EM may be delayed in a state of the on-level for a particular time from the time $t_1$. For example, a delay time may be greater than or equal to one horizontal period. However, embodiments are not limited thereto.

In addition, a time at which a signal is turned off, for example, the time $t_1$ at which the first switching TFT ST1 may be turned off, may be described as a transition time of the first scan control signal SC1. For example, the time $t_1$ at which the second switching TFT ST2 may be turned off, may be described as a transition time of the second scan control signal SC2. Thus, the emission control signal EM may maintain the on-level at the transition time of the first scan control signal SC1 and at the transition time of the second scan control signal SC2.

According to the above-described configuration, because the emission control TFT ST3 can maintain the turn-on state at the time $t_1$ at which the second switching TFT ST2 is turned off, the effect of kickback can be efficiently reduced or prevented. Thus, the emission control signal EM may be at the off-level $L_{off}$ after a particular time passed from the time $t_1$. In addition, after the particular time passed from the time $t_1$, the emission control signal EM may have a particular duty in accordance with the pulse duty drive illustrated in FIG. 6. According to the above-described configuration, embodiments of the present disclosure may reduce or prevent the effect of kickback resulting from the parasitic capacitance, may compensate for the luminance distortion, and may perform the pulse duty drive.

In some embodiments, the reference voltage $V_{ref}$ may be set in additional consideration of a contrast ratio. For example, in an inverse gamma grayscale manner, a minimum data voltage $V_{data}$ that the source driver 12 can output may be less than the reference voltage $V_{ref}$. In this case, when the reference voltage $V_{ref}$ decreases, the gate node-to-source node voltage $V_{gs}$ of the driving TFT DT may be $(V_{ref}-V_{data})$. Therefore, a range of the gate node-to-source node voltage $V_{gs}$ may decrease at a grayscale range, for example, at gray levels of 0 to 255. Thus, if a maximum reference voltage $V_{ref}$ excessively decreases, the grayscale may not be completely represented, or a maximum luminance may be reduced. For example, because the contrast ratio may be reduced, the reference voltage $V_{ref}$ may be set in consideration of the minimum data voltage $V_{data}$. However, embodiments are not limited thereto. According to the above-described configuration, a reduction in the contrast ratio and the kickback phenomenon can be simultaneously compensated.

In some embodiments, a delay circuit may be disposed at an output terminal of an emission driver, and the emission control signal EM may be delayed by a desired amount. This scheme may be implemented in a simple manner without redesigning the emission driver. For example, the delay circuit can be applied to all of embodiments.

Figure 15A:
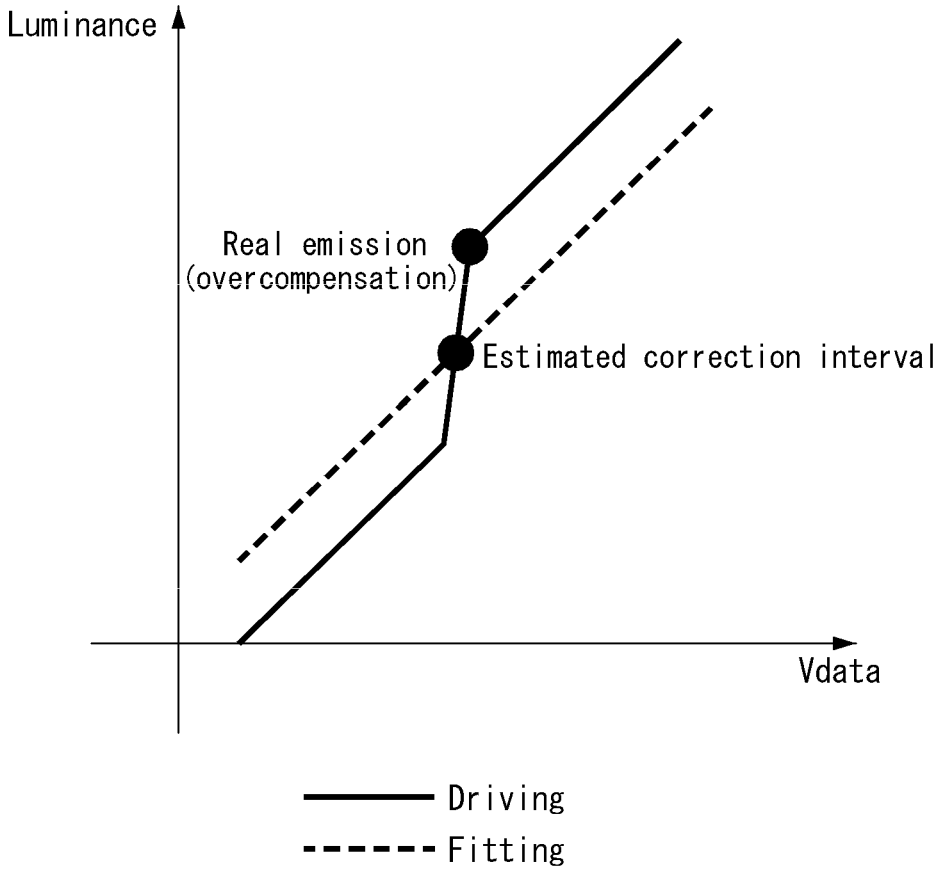
FIG. 15A is a graph illustrating that luminance distortion is generated by a kickback phenomenon when external compensation is applied to comparative examples.

FIG. 15A is a graph illustrating that luminance distortion is generated by a kickback phenomenon when external compensation is applied to comparative examples.

With reference to FIG. 15A, the x-axis indicates the data voltage $V_{data}$. The data voltage $V_{data}$ may be configured to correspond to the grayscale. The y-axis indicates a luminance of the OLED that may emit light corresponding to the input data voltage $V_{data}$.

The solid line labeled "Driving" is indicates that an erroneous operation is generated by a kickback phenomenon when external compensation is applied to comparative examples. The dotted line labeled "Fitting" indicates that the kickback phenomenon may be well-compensated by embodiments.

As shown in FIG. 15A, when the external compensation is applied to the comparative examples (see, e.g., FIGS. 7, 8, 11, and 12) that are affected by the kickback phenomenon, the luminance is undercompensated or overcompensated depending on a level of the data voltage $V_{data}$. Hence, the luminance distortion may increase. For example, a nonlinear interval exists between the undercompensation and the overcompensation. In particular, when the data voltage $V_{data}$ is similar to a threshold voltage of the driving TFT, the nonlinear interval may be generated.

Figure 15B:
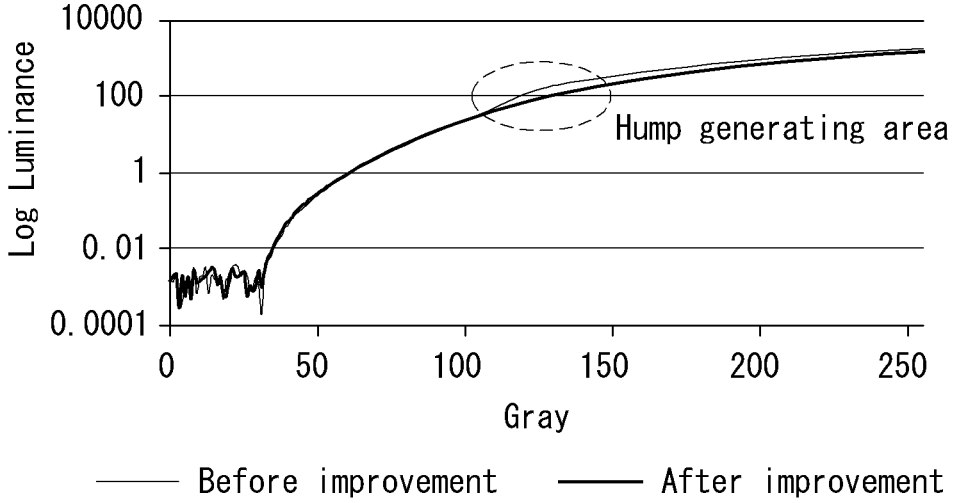
FIG. 15B is a graph illustrating that a hump of a luminance-grayscale curve is reduced or prevented when the driving waveform of FIG. 9

FIG. 15B is a graph illustrating that a hump of a luminance-grayscale curve is reduced or prevented when the driving waveform of FIG. 9 or FIG. 13 is applied.

With reference to FIG. 15B, the x-axis indicates a grayscale, and the y-axis indicates a log luminance. In the FIG. 15B example, a luminance-grayscale curve may be referred to as a "gamma" curve. A gamma curve before the improvement includes a hump generated at particular gray levels when the comparative examples (see, e.g., FIGS. 7, 8, 11, and 12) are affected by the kickback phenomenon. For example, the hump may be generated at gray levels at which a magnitude of the data voltage $V_{data}$ is similar to the threshold voltage of the driving TFT.

In a gamma curve after the improvement, a luminance hump appearing on the gamma curve was removed in example embodiments (see, e.g., FIGS. 9, 10, 13, and 14) of the present disclosure. Thus, the luminance distortion can be prevented or reduced.

For example, an example embodiment and another example embodiment of the present disclosure are again described below. An OLED display according to an example embodiment including a programming period and an emission period may include a first switching TFT disposed between a gate node of a driving TFT and a data line, and configured to supply a data voltage to the gate node in the programming period; a second switching TFT disposed between a source node of the driving TFT and a reference line and configured to bypass a transient current, that is supplied through the driving TFT, to the reference line in the programming period; an emission control TFT disposed between a drain node of the driving TFT and a high potential driving voltage supply line and configured to supply a high potential driving voltage to the drain node in the programming period; a storage capacitor disposed between the gate node and the source node and configured to charge a gate node-to-source node voltage of the driving TFT in the programming period; and an OLED connected to the source node and configured to maintain a non-emission state in the programming period.

The OLED display according to an example embodiment may further include a first gate line configured to supply a first scan control signal to a gate electrode of the first switching TFT; a second gate line configured to supply a second scan control signal to a gate electrode of the second switching TFT; and a third gate line configured to supply an emission control signal to a gate electrode of the emission control TFT.

When the first scan control signal, the second scan control signal, and the emission control signal are simultaneously turned on, the data voltage may be applied to one electrode of the storage capacitor corresponding to the gate node, a reference voltage may be applied to the other electrode of the storage capacitor corresponding to the source node through the reference line, and the transient current may be bypassed to the reference line by the reference voltage that may be less than an operating point voltage of the OLED.

During the programming period, the emission control TFT may be turned on. During the emission period, the emission control TFT may be turned off after a particular time. The drain node may not be in a floating state in the programming period, and may not be in a floating state for at least a particular time of the emission period, thereby reducing kickback.

In the emission period, the emission control TFT may maintain a turn-off state for a particular time from the particular time, and then may be turned on. In the emission period, the emission control TFT may be turned on and turned off one or more times. In the emission period, the emission control TFT may operate in a pulse duty drive in which a variable duty can be adjusted.

The OLED display according to an example embodiment may further include a plurality of pixel lines including the driving TFT, the first switching TFT, the second switching TFT, the emission control TFT, the storage capacitor, and the OLED. A duty of a pulse duty drive of each pixel line may be adjusted. The pulse duty drive may perform at least one of a representation function of gray levels equal to or more than N-bit video data, a flicker reduction function, an adjustment function of a maximum luminance, and a reduction function of a stress of the emission control TFT.

The reference voltage may be a voltage for bypassing the transient current, and the data voltage may be set corresponding to the voltage for bypassing the transient current. The gate node-to-source node voltage of the driving TFT DT may operate in a gamma grayscale manner.

The first switching TFT may include an oxide semiconductor layer, and a second switching TFT may include an oxide semiconductor layer. The first switching TFT may further include one of an amorphous silicon semiconductor layer and a polysilicon semiconductor layer, and a second switching TFT may further include one of an amorphous silicon semiconductor layer and a polysilicon semiconductor layer.

An OLED display according to an example embodiment including a programming period and an emission period may include a second switching TFT that may be disposed between a gate node of a driving TFT and a reference line, and may be configured to supply a reference voltage to a gate node in the programming period; a first switching TFT that may be disposed between a source node of the driving TFT and a data line, and may be configured to bypass a transient current, supplied to the driving TFT, to the data line in the programming period while supplying a data voltage to the source node; an emission control TFT that may be disposed between a drain node of the driving TFT and a high potential driving voltage supply line, and may be configured to supply a high potential driving voltage to the drain node in the programming period; a storage capacitor that may be disposed between the gate node and the source node, and may be configured to charge a gate node-to-source node voltage of the driving TFT in the programming period; and an OLED that may be connected to the source node, and may operate to maintain a non-emission state in the programming period.

The OLED display according to an example embodiment may further include a first gate line configured to supply a first scan control signal to a gate electrode of the first switching TFT; a second gate line configured to supply a second scan control signal to a gate electrode of the second switching TFT; and a third gate line configured to supply an emission control signal to a gate electrode of the emission control TFT.

When the first scan control signal, the second scan control signal, and the emission control signal are simultaneously turned on, the reference voltage may be applied to one electrode of the storage capacitor corresponding to the gate node, the data voltage may be applied to the other electrode of the storage capacitor corresponding to the source node, and the transient current may be bypassed to the data line by the data voltage that may be less than an operating point voltage of the OLED.

During the programming period, the emission control TFT may be turned on. In the emission period, the emission control TFT may be turned off after a particular time. The drain node may not be in a floating state in the programming period, and may not be in a floating state for at least a particular time of the emission period, thereby reducing kickback.

In the emission period, the emission control TFT may maintain a turn-off state for a particular time from the particular time, and then may be turned on. In the emission period, the emission control TFT may be turned on and turned off one or more times. In the emission period, the emission control TFT may operate in a pulse duty drive in which a variable duty can be adjusted.

The OLED display according to an example embodiment may further include a plurality of pixel lines including the driving TFT, the first switching TFT, the second switching TFT, the emission control TFT, the storage capacitor, and the OLED. A duty of a pulse duty drive of each pixel line may be adjusted. The pulse duty drive may perform at least one of a representation function of gray levels equal to or more than N-bit video data, a flicker reduction function, an adjustment function of a maximum luminance, and a reduction function of a stress of the emission control TFT.

The reference voltage may be greater than a contrast ratio reduction voltage capable of reducing a contrast ratio of the OLED display. The data voltage may be a voltage for bypassing the transient current, and the reference voltage may be set corresponding to the voltage for bypassing the transient current. The gate node-to-source node voltage of the driving TFT DT may operate in an inverse gamma grayscale manner.

An OLED display according to example embodiments may include a driving TFT configured to adjust an amount of current supplied to an OLED by a potential difference between voltages applied to a first electrode and a second electrode of a storage capacitor; a first switching TFT configured to input a first voltage to the first electrode of the storage capacitor; a second switching TFT configured to input a second voltage to the second electrode of the storage capacitor; and an emission control TFT configured to adjust an emission duty of the OLED while supplying a high potential driving voltage to the driving TFT.

After the emission control TFT is turned off when the first switching TFT and the second switching TFT are turned on, the emission control TFT may maintain a turn-on state for a particular period of time to thereby compensate for kick-back. The OLED display may operate in a gamma grayscale manner or om an inverse gamma grayscale manner.

Figure 16:
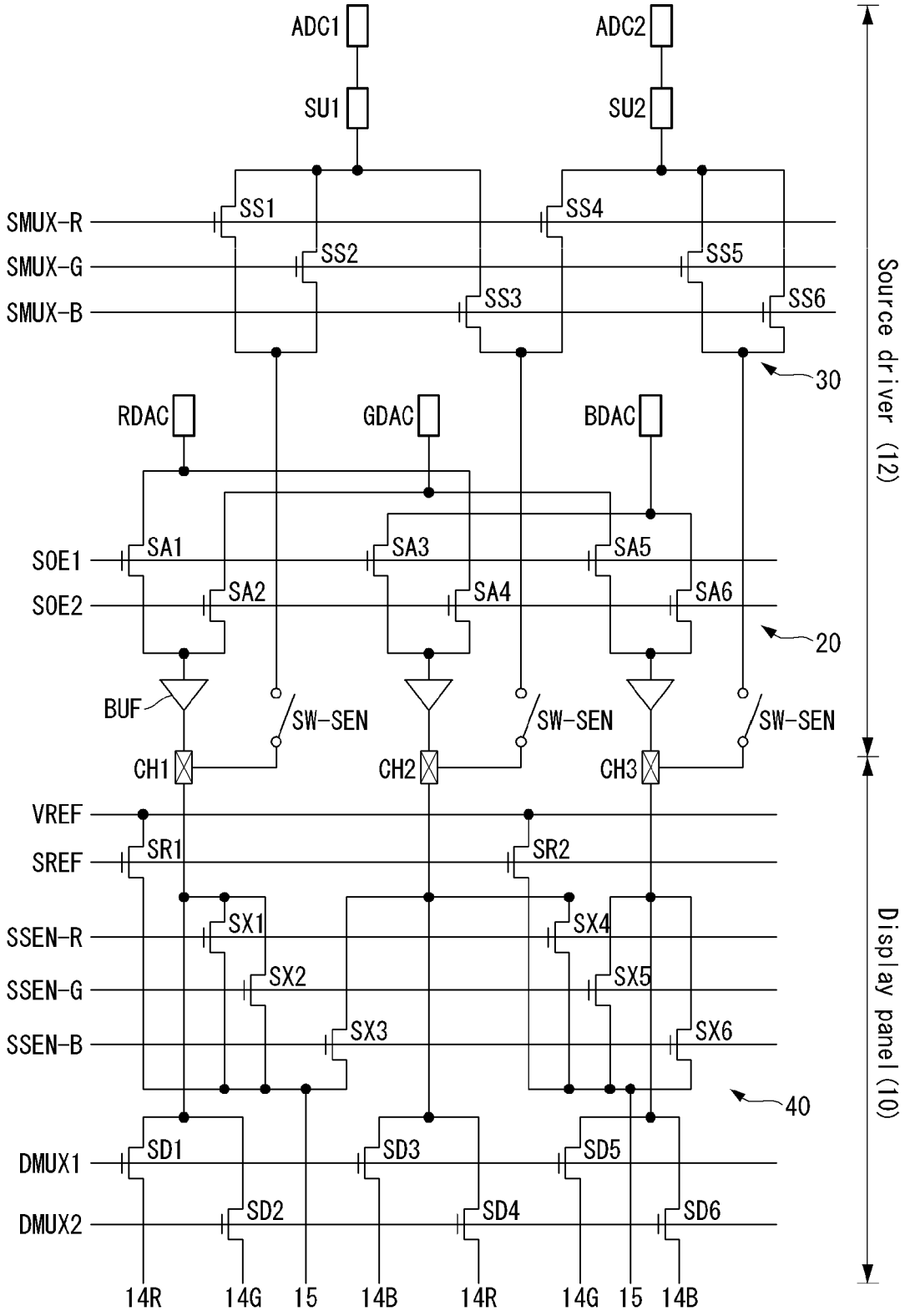
FIG. 16 is a circuit diagram illustrating a configuration of a source driver and configuration of a switch array of a display panel capable of being coupled to the pixel of FIG. 10.

FIG. 16 is a circuit diagram illustrating configuration of a source driver and configuration of a switch array of a display panel capable of being coupled to the pixel of FIG. 10.

With reference to FIG. 16, a source driver 12 and a switch array 40 of a display panel 10 of an OLED display according to an example embodiment are described below. The OLED display according to an example embodiment may include the display panel 10 further including the switch array 40 and the source driver 12 further including a sensor 30. The OLED display according to an example embodiment may be configured to selectively perform a display drive and a sensing drive.

The source driver 12 may include a data voltage supply unit 20 for supplying a data voltage $V_{data}$ to the display panel 10 and the sensor 30 for sensing pixels P of the display panel 10. However, embodiments are not limited thereto. For example, the data voltage supply unit 20 and the sensor 30 may be physically separated from each other.

The data voltage supply unit 20 may include a plurality of DACs RDAC, GDAC, and BDAC and first multiplexer (mux) switches SA1 to SA6. In the display drive, the data voltage supply unit 20 may generate a display data voltage, and may supply the display data voltage to output channels CH1 to CH3. In the sensing drive, the data voltage supply unit 20 may generate a sensing data voltage, and may supply the sensing data voltage to the output channels CH1 to CH3.

The first mux switches SA1 to SA6 may be switched on in response to first mux control signals SOE1 and SOE2, and may connect the DACs RDAC, GDAC, and BDAC to the output channels CH1 to CH3. For example, the odd-numbered mux switches SA1, SA3, and SA5 of the first mux switches SA1 to SA6 may be simultaneously turned on in response to the 1-1 mux control signal SOE1, and may simultaneously perform the connection between the DAC RDAC and the first output channel CH1, the connection between the DAC BDAC and the second output channel CH2, and the connection between the DAC GDAC and the third output channel CH3. Further, the even-numbered mux switches SA2, SA4, and SA6 of the first mux switches SA1 to SA6 may be simultaneously turned on in response to the 1-2 mux control signal SOE2, and may simultaneously perform the connection between the DAC GDAC and the first output channel CH1, the connection between the DAC RDAC and the second output channel CH2, and the connection between the DAC BDAC and the third output channel CH3. In addition, a buffer BUF may be included for stabilizing the data voltage. However, embodiments are not limited thereto.

In other words, the plurality of DACs RDAC, GDAC, and BDAC connected to the output channels CH1 to CH3 may be switched on in response to the first mux control signals SOE1 and SOE2. Thus, because the output channels CH1 to CH3 can selectively output different image signals, the number of output channels can be reduced.

The sensor 30 may include second mux switches SS1 to SS6 operating in response to second mux control signals SMUX-R, SMUX-G, and SMUX-B, a plurality of sensing units SU1 and SU2, and a plurality of ADCs ADC1 and ADC2.

For example, the sensor 30 may operate only in the sensing drive, and may stop operating in the display drive. In one example, the sensor 30 may include sensing switches SW-SEN capable of controlling the sensing drive, and may be controlled depending on turn-on and turn-off states of the sensing switches SW-SEN. The output channels CH1 to CH3 may be connected to the second mux switches SS1 to SS6 of the sensor 30 by the sensing switches SW-SEN. However, embodiments are not limited thereto.

In the sensing drive, the sensor 30 may sense a voltage of a source electrode of a driving TFT through reference lines 15 of the display panel 10 or may directly sense a driving current of the driving TFT through the reference lines 15 of the display panel 10. The sensor 30 may be turned on only in the sensing drive, and may further include the sensing switches SW-SEN connecting the second mux switches SS1 to SS6 to the output channels CH1 to CH3.

The second mux switches SS1 to SS6 may be switched on in response to the second mux control signals SMUX-R, SMUX-G, and SMUX-B. Hence, the second mux switches SS1 to SS6 may time-divide, e.g., six sensing inputs supplied through the three output channels CH1 to CH3, and may sequentially apply the time-divided sensing inputs to the two sensing units SU1 and SU2.

The second mux switches SS1 and SS4 may be simultaneously turned on in response to the 2-1 mux control signal SMUX-R, and may simultaneously perform the connection between the first output channel CH1 and the first sensing unit SU1 and the connection between the second output channel CH2 and the second sensing unit SU2. The second mux switches SS2 and SS5 may be simultaneously turned on in response to the 2-2 mux control signal SMUX-G, and may simultaneously perform the connection between the first output channel CH1 and the first sensing unit SU1 and the connection between the third output channel CH3 and the second sensing unit SU2. The second mux switches SS3 and SS5 may be simultaneously turned on in response to the 2-3 mux control signal SMUX-B, and may simultaneously perform the connection between the second output channel CH2 and the first sensing unit SU1 and the connection between the third output channel CH3 and the second sensing unit SU2.

For example, the sensing units SU1 and SU2 may be configured as voltage sensing units. Thus, the sensor 30 may be configured to sense a voltage of the source electrode of the driving TFT through the reference lines 15 of the display panel 10 in the sensing drive. The voltage sensing unit may include a sample and hold circuit and senses the voltage of the source electrode of the driving TFT (e.g., the voltage of the source electrode of the driving TFT stored in a line capacitor of a sensing line) in accordance with the driving current of the driving TFT. However, embodiments are not limited thereto.

For example, the sensing units SU1 and SU2 may be configured as current sensing units. Thus, the sensor 30 may be configured to directly sense the driving current of the driving TFT through the reference lines 15 of the display panel 10 in the sensing drive. The current sensing unit may further include a current integrator at a previous stage of a sample and hold circuit, and may directly sense the driving current of the driving TFT flowing in the sensing line. However, embodiments are not limited thereto.

The ADCs ADC1 and ADC2 may convert analog sensing values sampled by the sensing units SU1 and SU2 into digital sensing values. The switch array 40 may include third mux switches SD1 to SD6, fourth mux switches SX1 to SX6, and reference voltage supply switches SR1 and SR2. The switch array 40 may be formed in a bezel area outside a pixel array of the display panel 10. The bezel area may indicate an area excluding the pixel array from the display panel 10. For example, the bezel area may be referred to as a "non-pixel" or "non-display" area of the display panel 10.

The third mux switches SD1 to SD6 may be involved in outputting the data voltage generated in the DACs to data lines 14 of the display panel 10 together with the first mux switches SA1 to SA6 in the display drive and the sensing drive. The third mux switches SD1 to SD6 may be switched on in response to third mux control signals DMUX1 and DMUX2, and may connect one output channel (e.g., CH1, CH2, or CH3) of the data voltage supply unit 20 to two data lines (e.g., 14R and 14G, 14B, and 14R; or 14G and 14B) in a time-division manner. The odd-numbered mux switches SD1, SD3, and SD5 of the third mux switches SD1 to SD6 may be simultaneously turned on in response to the 3-1 mux control signal DMUX1, and may respectively connect the output channels CH1, CH2, and CH3 of the data voltage supply unit 20 to odd-numbered data lines 14R, 14B, and 14G. Further, the even-numbered mux switches SD2, SD4, and SD6 of the third mux switches SD1 to SD6 may be simultaneously turned on in response to the 3-2 mux control signal DMUX2, and may respectively connect the output channels CH1, CH2, and CH3 of the data voltage supply unit 20 to even-numbered data lines 14G, 14R, and 14B.

The fourth mux switches SX1 to SX6 may be involved in transferring sensing inputs from the reference lines 15 to the sensing units SU1 and SU2 together with the second mux switches SS1 to SS6 in the sensing drive. Thus, the fourth mux switches SX1 to SX6 may be turned on and off at timings similar to the second mux switches SS1 to SS6.

The fourth mux switches SX1 to SX6 may be switched on in response to fourth mux control signals SSEN-R, SSEN-G, and SSEN-B. Hence, the fourth mux switches SX1 to SX6 may time-divide, e.g., six sensing inputs supplied through the two reference lines 15, and may apply the time-divided sensing inputs to the three output channels CH1 to CH3. To this end, the fourth mux switches SX1 and SX4 may be simultaneously turned on in response to the 4-1 mux control signal SSEN-R, and may connect the reference lines 15 to the first and second output channels CH1 and CH2. The fourth mux switches SX2 and SX5 may be simultaneously turned on in response to the 4-2 mux control signal SSEN-G, and may connect the reference lines 15 to the first and third output channels CH1 and CH3. The fourth mux switches SX3 and SX6 may be simultaneously turned on in response to the 4-3 mux control signal SSEN-B, and may connect the reference lines 15 to the second and third output channels CH2 and CH3.

The reference voltage supply switches SR1 and SR2 may be simultaneously switched on in response to a reference voltage control signal SREF in the display drive and the sensing drive, and may output a reference voltage $V_{ref}$ to the reference lines 15. Because the reference voltage supply switches SR1 and SR2 and the fourth mux switches SX1 to SX6 may be commonly connected to the reference lines 15, they may be turned on at different timings. Reference power lines connected to a reference power source VREF may be disposed in the bezel area outside the pixel array of the display panel 10. The reference voltage supply switches SR1 and SR2 may control the electrical connection between the reference power source VREF and the reference lines 15 in response to the reference voltage control signal SREF.

According to the above-described configuration, embodiments may have an advantage of a reduction in the number of sensing units SU1 and SU2 and the number of ADCs ADC1 and ADC2. For example, the number of sensing units SU1 and SU2 can be less than the number of output channels of the source driver 12, and the number of ADCs ADC1 and ADC2 can be less than the number of output channels of the source driver 12. Further, embodiments may have an advantage of a reduction in the number of output channels of the data voltage supply unit 20 through the switch array 40. In addition, embodiments can simplify the sensor 30 of the source driver 12 to cope with high resolution display devices.

For example, embodiments may cope with the high resolution display devices through the third mux switches SD1 to SD6 and the first mux switches SA1 to SA6 without increasing the size of the source driver 12, and may also simplify the sensor 30 in such a state. Therefore, embodiments may be more efficiently applied to small-sized devices with a high resolution, such as mobile products.

Because the source driver 12 may have a fixed size, there may be a limit in which the size of the source driver 12 cannot be infinitely increased as a resolution increases. Further, because the source driver 12 may correspond to a relatively expensive component in the display device, an increase in the size of the source driver 12 resulting from an increase in the number of output channels of the source driver 12 may be disadvantageous in terms of price competitiveness.

In some embodiments, the third mux switches SD1 to SD6 of the switch array 40 may be configured such that the output channels of the data voltage supply unit 20 and the data lines 14 may be connected to each other in a ratio of 1:N, where N is a positive integer equal to or greater than 2. Thus, embodiments may have an advantage capable of coping with the high resolution display devices without increasing the size of the data voltage supply unit 20. However, embodiments are not limited thereto.

In some embodiments, the OLED display may be configured to exclude the switch array 40. For example, the OLED display, not including the switch array 40, may be configured to exclude the first mux switches SA1 to SA6 and the third mux switches SD1 to SD6. Further, there may be advantages in that the sensing units, the ADCs, the DACs, the buffers, and the output channels can be adjusted, and a sensing speed can increase. However, embodiments are not limited thereto.

In some embodiments, the OLED display may be configured to exclude the sensor 30. For example, the OLED display not including the sensor 30 may be configured to exclude the second mux switches, the sensing units, the ADCs, the reference voltage supply switches, the sensing switches, and the fourth mux switches. Thus, there may be an advantage in that the switch array 40 can reduce the number of output channels of the source driver 12 through only the configuration of the first mux switches SA1 to SA6 and the third mux switches SD1 to SD6. However, embodiments are not limited thereto. In some embodiments, the OLED display may include at least one of the sensor 30 and the switch array 40.

Figure 17:
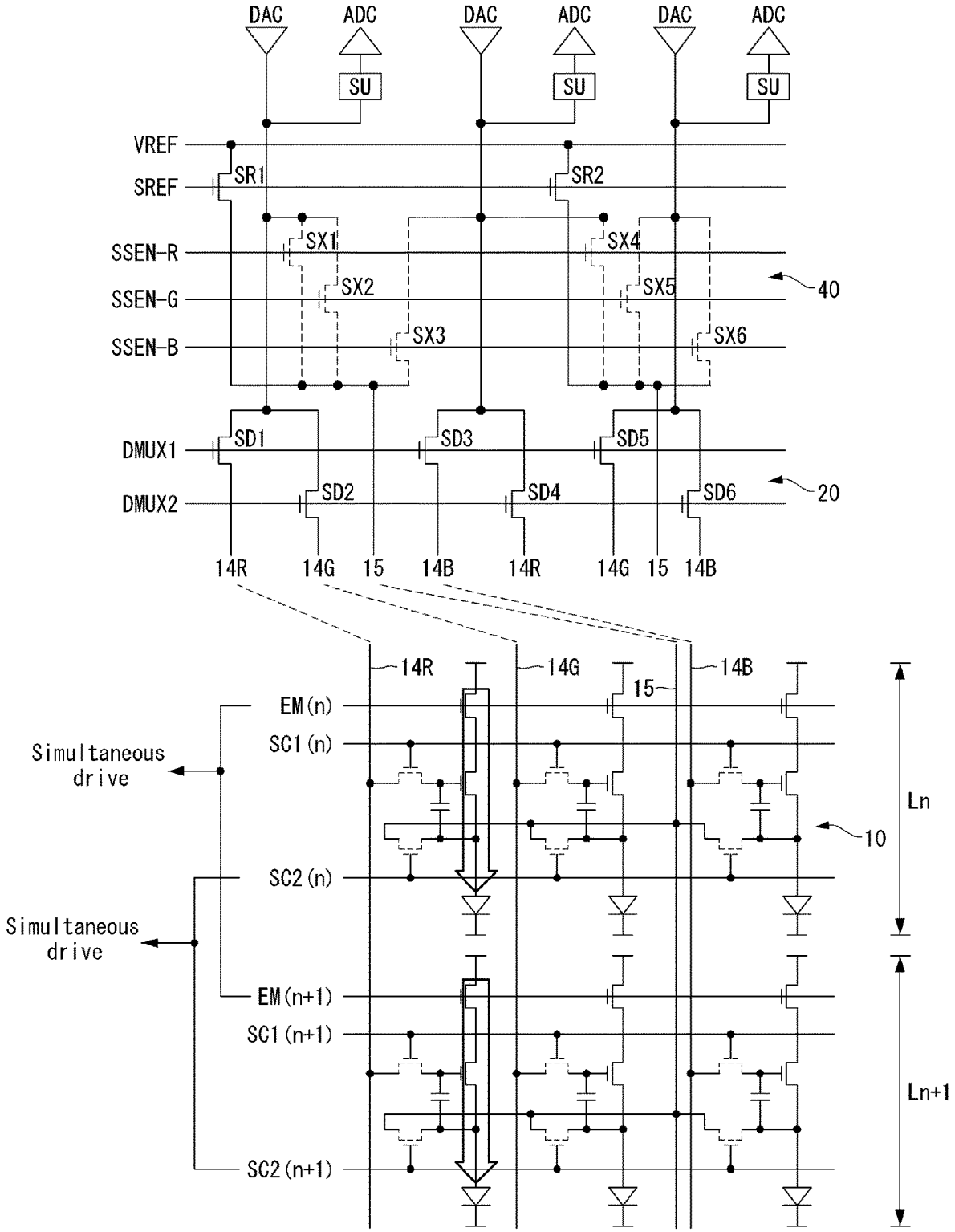
FIG. 17 is a circuit diagram illustrating a display drive in accordance with a pixel of FIG. 10 and a source driver of FIG. 16.
Figure 18:
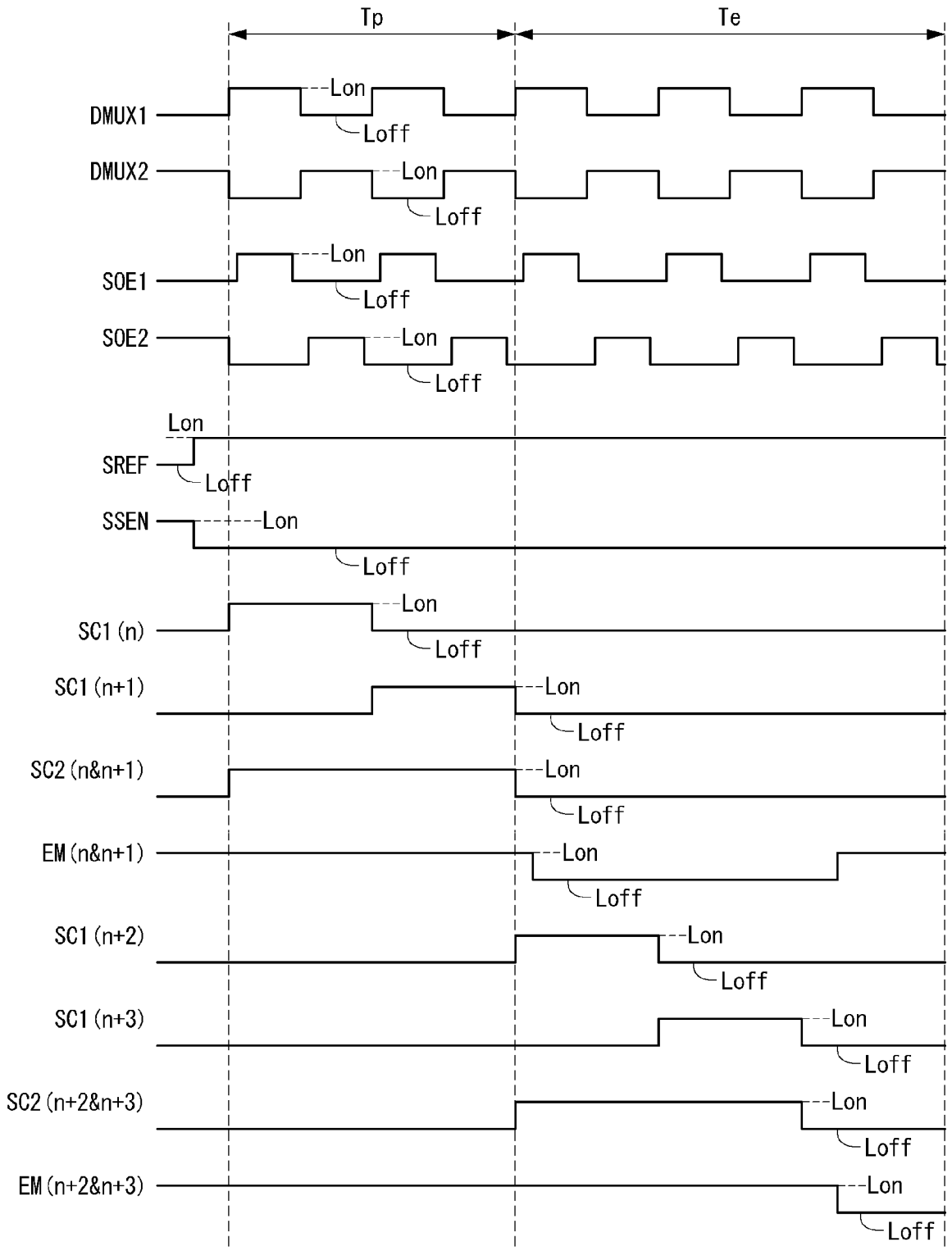
FIG. 18 is a waveform diagram illustrating operation of the display drive of FIG. 17.

FIG. 17 is a circuit diagram illustrating a display drive in accordance with the pixel of FIG. 10 and the source driver of FIG. 16. FIG. 18 is a waveform diagram illustrating operation of the display drive of FIG. 17.

A display device of an OLED display according to an example embodiment is described below with reference to FIGS. 17 and 18. The OLED display according to an example embodiment may be configured to control an emission operation every two adjacent pixel lines in a display drive. In a display drive, a display data voltage, that may be input to an $n^{th}$ pixel line $L_n$ (where n is a natural number), and a display data voltage, that may be input to a $(n+1)^{th}$ pixel line ($L_n$+1), may time-divided by an operation of first mux switches SA1 to SA6 in response to first mux control signals SOE1 and SOE2 and an operation of third mux switches SD1 to SD6 in response to third mux control signals DMUX1 and DMUX2, and may be supplied to data lines 14R, 14G, and 14B.

Reference voltage supply switches SR1 and SR2 may be turned on in response to a reference voltage control signal SREF. Thus, a reference voltage $V_{ref}$ may be supplied to reference lines 15. In this instance, fourth mux switches SX1 to SX6 may maintain a turn-off state by fourth mux control signals SSEN-R, SSEN-G, and SSEN-B. Further, sensing switches SW-SEN may be turned off in response to a sensing drive control signal SSEN when the reference voltage control signal SREF is turned on. However, embodiments are not limited thereto. For example, embodiments may be configured such that the display drive is able to be performed by applying various control signals to various lines.

In the display drive, an emission control signal EM may be simultaneously applied to two adjacent pixel lines, the reference voltage $V_{ref}$ may be simultaneously applied to the two adjacent pixel lines, and a data voltage $V_{data}$ may be sequentially applied to the two adjacent pixel lines. For example, an emission driver 13C may be configured to simultaneously supply the emission control signal EM to the two adjacent pixel lines.

The display drive is described below using the $n^{th}$ pixel line $L_n$ and the $(n+1)^{th}$ pixel line ($L_n$+1) that may be adjacent to each other, as an example. To perform the display drive, a first scan control signal SC1($n$) may be applied to the $n^{th}$ pixel line $L_n$, and a first scan control signal SC1($n$+1) may be applied to the $(n+1)^{th}$ pixel line $L_n$+1. Further, second scan control signals SC2($n$) and SC2($n$+1) may be commonly applied to the $n^{th}$ and $(n+1)^{th}$ pixel lines $L_n$ and $L_n$+1, and emission control signals EM(n) and EM(n+1) may be commonly applied to the $n^{th}$ and $(n+1)^{th}$ pixel lines $L_n$ and $L_n$+1.

In a programming period $T_p$, the second scan control signals SC2($n$) and SC2($n$+1) may be turned on corresponding to a turn-on section of the first scan control signal SC1($n$) applied to the $n^{th}$ pixel line $L_n$, and to a turn-on section of the first scan control signal SC1($n$+1) applied to the $(n+1)^{th}$ pixel line $L_n$+1. For example, in the display drive, a second scan driver 13B may be configured to supply the second scan control signals SC2($n$) and SC2($n$+1) that may be turned on during the turn-on section of the first scan control signal SC1($n$) applied to the $n^{th}$ pixel line $L_n$, and to the turn-on section of the first scan control signal SC1($n$+1) applied to the $(n+1)^{th}$ pixel line $L_n$+1.

In addition, a time at which the programming period $T_p$ of the OLED display according to an example embodiment ends may be defined as a time at which the second scan control signals SC2($n$) and SC2($n$+1) are turned off. Thus, a start time of an emission period $T_e$ may be defined after the second scan control signals SC2($n$) and SC2($n$+1) are turned off.

The emission control signals EM(n) and EM(n+1) may be maintained at an on-level for a particular time from after the second scan control signals SC2($n$) and SC2($n$+1) are at an off-level $L_{off}$ in the emission period $T_e$, and then may be turned off in the emission period $T_e$. In this instance, the particular time may be previously determined or adjusted. For example, in the display drive, the emission driver 13C may be configured to supply the emission control signals EM(n) and EM(n+1) that may be maintained at the on-level for the particular time from after the second scan control signals SC2($n$) and SC2($n$+1) are at the off-level $L_{off}$ in the emission period $T_e$, and then may be turned off in the emission period $T_e$.

During the programming period $T_p$, the $n^{th}$ pixel line $L_n$ may be programmed by the first and second scan control signals SC1($n$), SC2($n$), and SC2($n$+1). Then, the $(n+1)^{th}$ pixel line $L_n$+1 may be programmed by first and second scan control signals SC1($n$+1), SC2($n$) and SC2($n$+1).

In the emission period $T_e$, the $n^{th}$ and $(n+1)^{th}$ pixel lines $L_n$ and $L_n$+1 may be simultaneously reset in response to the emission control signals EM(n) and EM(n+1), and then may simultaneously emit light. Because an emission period of the emission control signals EM(n) and EM(n+1) may be adjusted, the duty may be variable.

According to the above-described configuration, embodiments can reduce or prevent a kickback phenomenon. Because an off-level section of the emission control signals EM(n) and EM(n+1) may be variably adjusted, the pulse duty drive can be performed.

For example, the emission control signal EM output from one stage of the emission driver 13C of a gate driver 13 may be configured to allow pixels belonging to a two-line pixel group disposed on two adjacent pixel lines to simultaneously emit light. For example, the pixels belonging to the two-line pixel group may be configured to simultaneously receive the reference voltage $V_{ref}$ in response to the second scan control signal SC2 output from one stage of the second scan driver 13B of the gate driver 13. Alternatively, the pixel lines may be respectively connected to stages of the first scan driver 13A, and may receive the first scan control signal SC1 in a line sequential manner.

Figure 19:
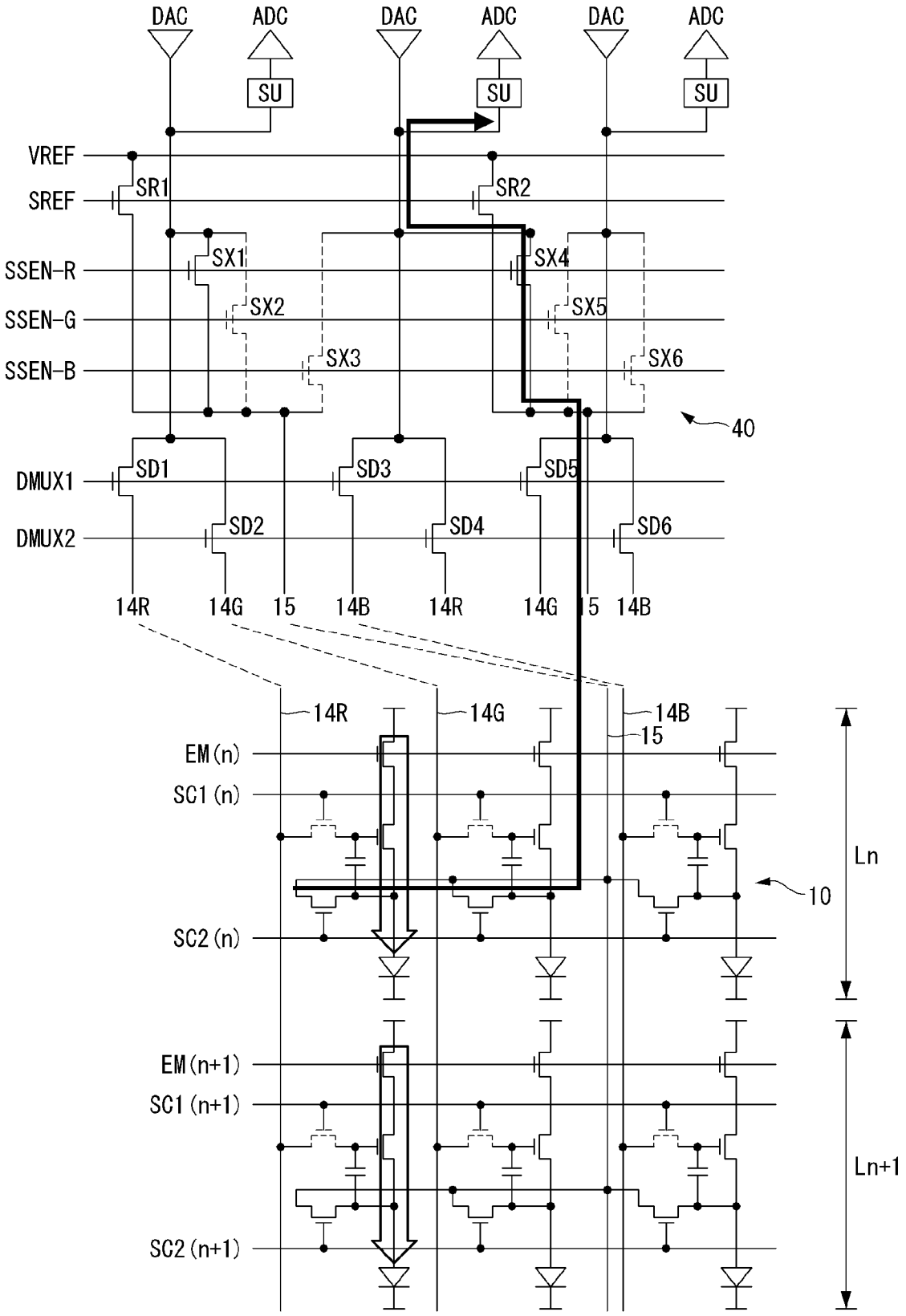
FIG. 19 is a circuit diagram illustrating a sensing drive in accordance with the pixel of FIG. 10 and the source driver of FIG. 16.
Figure 20:
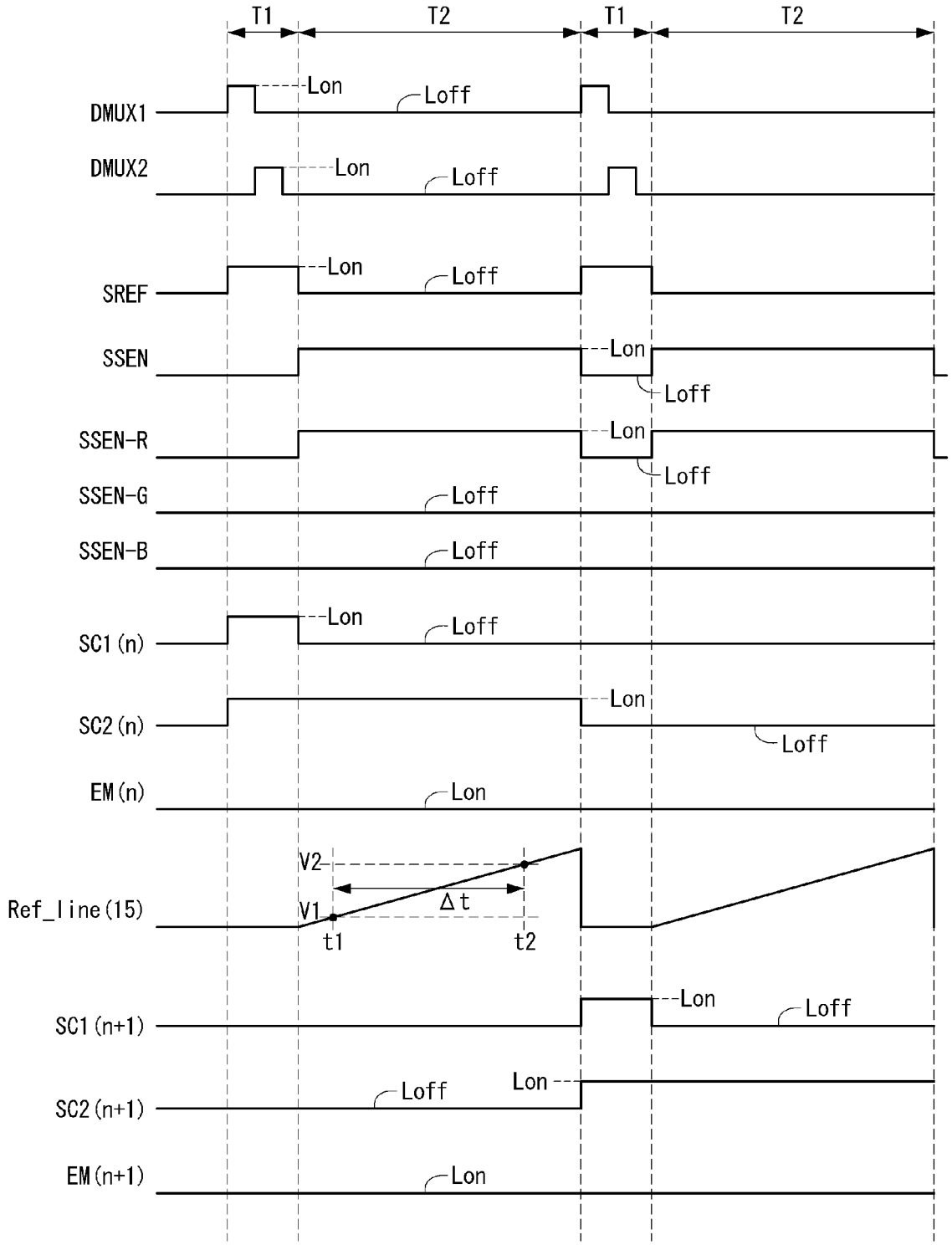
FIG. 20 is a waveform diagram illustrating operation of the sensing drive of FIG. 19.

FIG. 19 is a circuit diagram illustrating a sensing drive in accordance with the pixel of FIG. 10 and the source driver of FIG. 16. FIG. 20 is a waveform diagram illustrating operation of the sensing drive of FIG. 19.

A sensing drive device of an OLED display according to an example embodiment is described below with reference to FIGS. 19 and 20. In a sensing drive device of an OLED display according to an example embodiment, a data voltage supply unit 20 may generate a sensing data voltage through a DAC under the control of a timing controller 11, and then may supply the sensing data voltage to output channels CH1 to CH3 through first mux switches SA1 to SA6. The sensing data voltage may be applied to a gate electrode of a driving TFT included in each pixel in the sensing drive.

The sensing data voltage may be previously determined as a first value for first pixels each including a red OLED, a second value for second pixels each including a green OLED, and a third value for third pixels each including a blue OLED. In embodiments disclosed herein, the first to third values may be equal to one another, or may be different from one another. Embodiments are not limited to the color examples described herein.

For example, because a first pixel including a red OLED, a second pixel including a green OLED, and a third pixel including a blue OLED may share one reference line 15 in the sensing drive, sensing timing of the first to third pixels may be time-divided. For example, after the sensing drive sequentially senses a pixel array on a per pixel line basis to complete the sensing of all the first pixels, the sensing drive may sequentially sense the pixel array on a per pixel line basis to complete the sensing of all the second pixels, and then may sequentially sense the pixel array on a per pixel line basis to complete the sensing of all the third pixels. However, sensing order is not limited to these examples, and may be implemented by various methods.

The sensing drive is described below using an $n^{th}$ pixel line $L_n$ as an example. The sensing drive may be implemented to include a first period $T_1$ during which pixels may be initialized, and a second period $T_2$ during which electrical characteristics of the pixels may be sensed.

During the first period $T_1$, pixels to be sensed (hereinafter, referred to as "sensing target pixels") and pixels not to be sensed (hereinafter, referred to as "non-sensing target pixels") on the $n^{th}$ pixel line $L_n$ may be programmed differently. In embodiments disclosed herein, the non-sensing target pixel may be a pixel sharing the reference line 15 with the sensing target pixel. During the first period $T_1$, a sensing data voltage of an on-level may be applied to the sensing target pixel, and the sensing target pixel may be programmed so that a driving current may flow therein. On the other hand, during the first period $T_1$, a sensing data voltage of an off-level may be applied to the non-sensing target pixel, and the non-sensing target pixel may be programmed so that the driving current may not flow therein.

To this end, during the first period $T_1$, the sensing data voltage of the on-level and the sensing data voltage of the off-level, that may be selectively input to pixels of the $n^{th}$ pixel line $L_n$, may be supplied to data lines 14R, 14G, and 14B by an operation of first mux switches SA1 to SA6 in response to first mux control signals SOE1 and SOE2 and an operation of third mux switches SD1 to SD6 in response to third mux control signals DMUX1 and DMUX2. During the first period $T_1$, the reference voltage $V_{ref}$ may be supplied to the reference lines 15 through reference voltage supply switches SR1 and SR2. During the first period $T_1$, in response to a first scan control signal SC1(*n*) for the sensing drive, the sensing data voltage of the on-level may be applied to the sensing target pixels of the $n^{th}$ pixel line $L_n$, and the sensing data voltage of the off-level may be applied to the non-sensing target pixels of the $n^{th}$ pixel line $L_n$. During the first period T1, the reference voltage $V_{ref}$ may be commonly applied to all the pixels of the $n^{th}$ pixel line $L_n$ in response to a second scan control signal SC2(*n*) for the sensing drive.

During the second period T2, the sensing first scan control signal SC1(*n*) may be turned off, the sensing second scan control signal SC2(*n*) may maintain a turn-on state, and the supply of the reference voltage $V_{ref}$ may be cut off. Therefore, a potential of each reference line 15 may increase by the driving current flowing in the sensing target pixels of the $n^{th}$ pixel line $L_n$. In this instance, embodiments may selectively turn on fourth mux switches SX1 to SX6 and second mux switches SS1 to SS6 corresponding to the sensing target pixels, and may sample a change in the potential of the reference line 15, for example, two times (e.g., a voltage $V_1$ at a time $t_1$ and a voltage $V_2$ at a time $t_2$). The two sampling values $V_1$ and $V_2$ for the sensing target pixel may be used to calculate a change in a threshold voltage and a change in electron mobility of the sensing target pixel in the timing controller 11.

Figure 21:
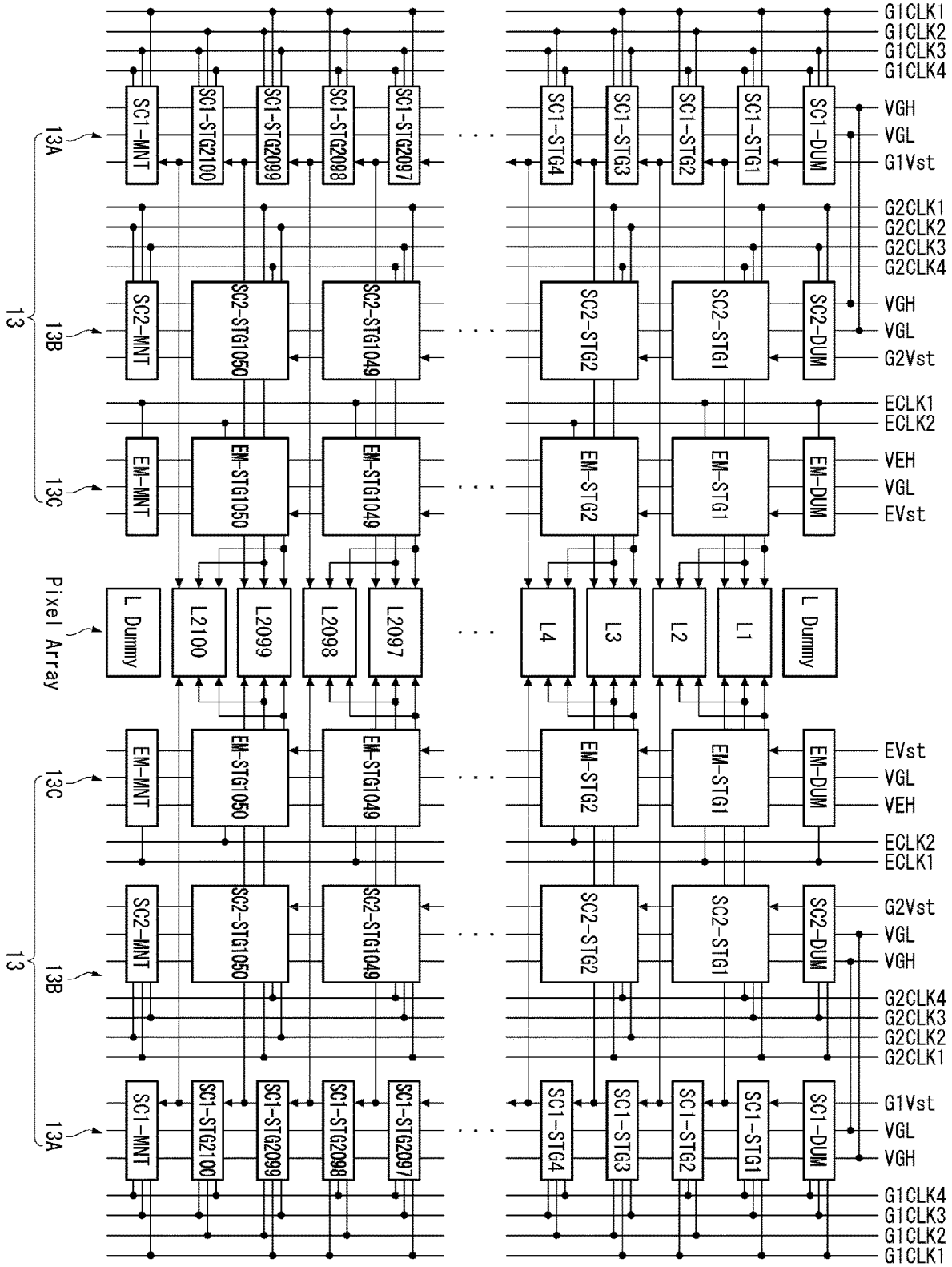
FIG. 21 is a circuit diagram illustrating an example configuration of a gate driver capable of supplying control signals for the display drive and the sensing drive illustrated in FIGS. 16 to 20.

FIG. 21 is a circuit diagram illustrating an example configuration of a gate driver capable of supplying control signals for the display drive and the sensing drive illustrated in FIGS. 16 to 20.

A gate driver of an OLED display according to an example embodiment is described below with reference to FIG. 21. A gate driver 13 according to an example embodiment may include a first scan driver 13A generating a first scan control signal SC1 to be supplied to first gate lines 16*a*, a second scan driver 13B generating a second scan control signal SC2 to be supplied to second gate lines 16*b*, and an emission driver 13C generating an emission control signal EM to be supplied to third gate lines 16*c*.

For example, the gate driver 13 may include the first scan driver 13A having as many stages as pixel lines of a pixel array, e.g., stages SC1-STG1 to SC1-STG2100 and pixel lines L1 to L2100, the second scan driver 13B having stages, e.g., SC2-STG1 to SC2-STG1050, corresponding to half of the number of pixel lines, e.g., pixel lines L1 to L2100, and the emission driver 13C having stages, e.g., stages EM-STG1 to EM-STG1050, corresponding to half of the number of pixel lines, e.g., pixel lines L1 to L2100. The number of stages and pixel lines are only examples, and embodiments are not limited thereto.

In FIG. 21, "SC1-DUM," "SC2-DUM," "EM-DUM," "SC1-MNT," "SC2-MNT," and "EM-MNT" denote dummy stages; "L Dummy" denotes a dummy pixel line; and "VGH," "VEH," and "VGL" denote driving voltages applied to the stages. However, embodiments are not limited thereto. For example, the dummy stage may be selectively included or excluded. The dummy stage and the dummy pixel line may be disposed at a first edge (e.g., an upper side) and a second edge (e.g., a lower side) of the pixel array. A signal of a pixel line adjacent to the dummy pixel line may be stabilized by the dummy stage and the dummy pixel line of the pixel array. Hence, the dummy stage and the dummy pixel line may help in reducing kickback of the pixel line adjacent to the dummy pixel line. Pixels of the dummy pixel line may be similar to pixels of the pixel array, but may be configured not to emit light. For example, the pixel of the dummy pixel line may not include an OLED or may not receive the data voltage or the scan control signal.

The first scan driver 13A may be implemented as a shift register that may generate the first scan control signal SC1 in response to a gate control signal GDC in a display drive, and may generate the sensing first scan control signal SC1 in response to the gate control signal GDC in a sensing drive. The first scan control signal SC1 for the display drive may be different from the sensing first scan control signal SC1 for the sensing drive.

For example, the stages SC1-STG1 to SC1-STG2100 of the first scan driver 13A may be respectively individually connected to the pixel lines L1 to L2100. Each of the stages SC2-STG1 to SC2-STG1050 of the second scan driver 13B may be individually connected to two pixel lines. Each of the stages EM-STG1 to EM-STG1050 of the emission driver 13C may be individually connected to two pixel lines. For example, embodiments can implement a narrow bezel by reducing the number of stages of the second scan driver 13B and the number of stages of the emission driver 13C.

The stages SC1-STG1 to SC1-STG2100 of the first scan driver 13A may sequentially shift a first start pulse G1Vst in response to first gate clock groups G1CLK1 to G1CLK4, and may generate the first scan control signal SC1 or the sensing first scan control signal SC1.

The second scan driver 13B may be implemented as a shift register that may generate the second scan control signal SC2 in response to the gate control signal GDC in the display drive, and may generate the sensing second scan control signal SC2 in response to the gate control signal GDC in the sensing drive. The second scan control signal SC2 for the display drive may be different from the sensing second scan control signal SC2 for the sensing drive.

For example, the stages SC2-STG1 to SC2-STG1050 of the second scan driver 13B may sequentially shift a second start pulse G2Vst in response to second gate clock groups G2CLK1 to G2CLK4, and may generate the second scan control signal SC2 or the sensing second scan control signal SC2.

The emission driver 13C may be implemented as a shift register that may generate the emission control signal EM in response to the gate control signal GDC in the display drive, and may generate the sensing emission control signal EM in response to the gate control signal GDC in the sensing drive. The emission control signal EM for the display drive may be different from the sensing emission control signal EM for the sensing drive.

For example, the stages EM-STG1 to EM-STG1050 of the emission driver 13C may sequentially shift a third start pulse EVst in response to third gate clock groups ECLK1 and ECLK2, and may generate the emission control signal EM or the sensing emission control signal EM.

According to the above-described configuration, because the number of stages constituting the second scan driver 13B, as well as the number of stages constituting the emission driver 13C, may be reduced to a half of a vertical resolution, a width of the gate driver 13 can be reduced. Further, embodiments can achieve a narrow bezel, and at the same time may reduce kickback, thereby reducing or preventing the generation of hump and performing the pulse duty drive.

In some embodiments, the gate drivers 13 may be formed in left and right bezel areas with the pixel array interposed between them. However, embodiments are not limited thereto. In some embodiments, the gate driver 13 may be formed only in a left bezel area of the pixel array or only in a right bezel area of the pixel array. However, embodiments are not limited thereto. In some embodiments, the shift registers constituting the gate driver 13 may be directly formed in a bezel area of the display panel 10 through a TFT process of a gate driver in panel (GIP) manner, to simplify the manufacturing process and reduce the manufacturing cost. However, embodiments are not limited thereto.

Figure 22:
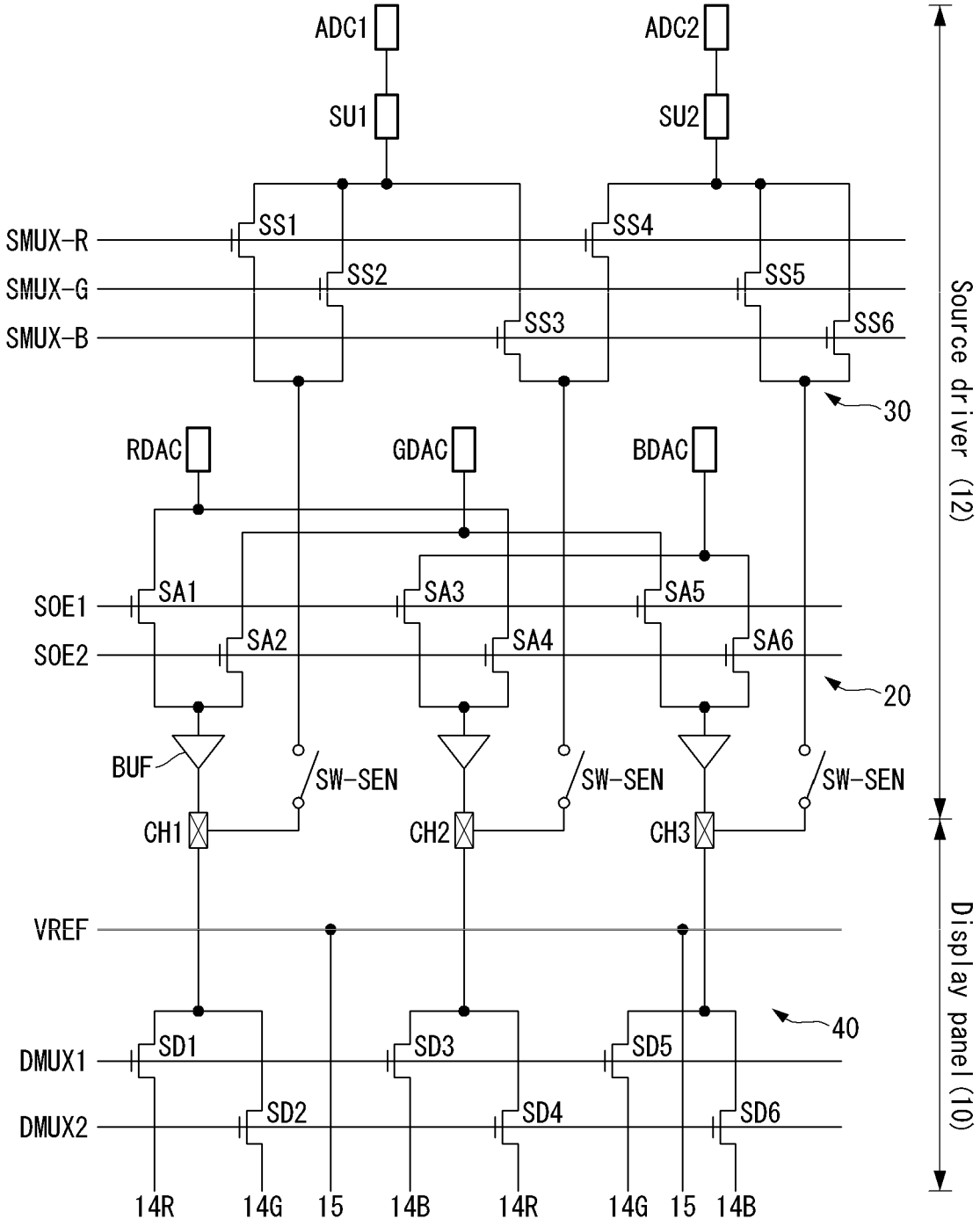
FIG. 22 is a circuit diagram illustrating configuration of a source driver and configuration of a switch array of a display panel capable of being coupled to the pixel structure of FIG. 14.

FIG. 22 is a circuit diagram illustrating configuration of a source driver and configuration of a switch array of a display panel capable of being coupled to the pixel structure of FIG. 14.

With reference to FIG. 22, a source driver 12 and a switch array 40 of a display panel 10 of an OLED display according to an example embodiment are described below. The OLED display according to an example embodiment may include the display panel 10, which may include the switch array 40, and the source driver 12, which may include a sensor 30. The OLED display according to an example embodiment may be configured to selectively perform a display drive and a sensing drive.

The source driver 12 shown in the FIG. 22 example may be substantially similar to the source driver 12 shown in the FIG. 16 example. The switch array 40 of the display panel 10 illustrated in FIG. 22 has structural characteristics different from the switch array 40 illustrated in FIG. 16. Third mux switches SD1 to SD6 shown in the example of FIG. 22 may be substantially similar to the third mux switches SD1 to SD6 shown in the example of FIG. 16. Therefore, duplicate description is omitted for convenience.

However, because the switch array 40 shown in the example of FIG. 22 may operate with respect to pixels using data lines as sensing lines, the switch array 40 shown in the FIG. 22 example may not require the fourth mux switches SX1 to SX6 and the reference voltage supply switches SR1 and SR2 of the switch array 40 shown in the example of FIG. 16. Further, in the switch array 40 shown in the FIG. 22 example, a reference power source VREF may be directly connected to reference lines 15.

In addition, the switch array 40 shown in the example of FIG. 22 may correspond to the pixels and the driving method shown in the examples of FIGS. 13 and 14. Thus, the switch array 40 shown in the FIG. 22 example may operate in an inverse gamma grayscale representation manner.

According to the above-described configuration, because the fourth mux switches SX1 to SX6 and the reference voltage supply switches SR1 and SR2 may be excluded from the switch array 40 shown in the FIG. 22 example, the configuration illustrated in FIG. 22 may have an additional advantage of a reduction in a width of a bezel of the display panel 10 corresponding to a formation area of the source driver 12. Further, the configuration illustrated in FIG. 22 may equally have the advantages of the configuration illustrated in FIG. 16.

Figure 23:
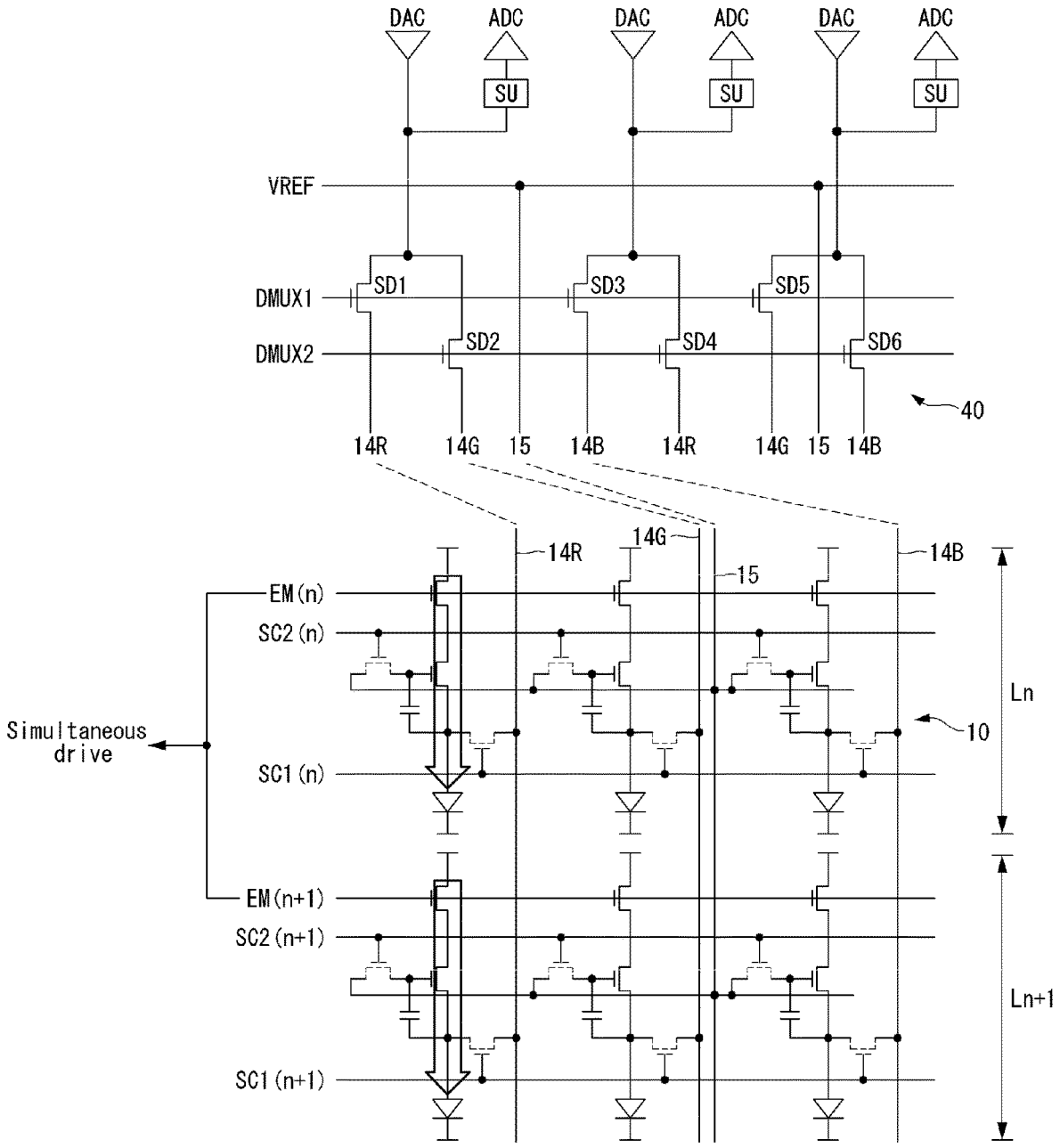
FIG. 23 is a circuit diagram illustrating a display drive in accordance with the pixel of FIG. 14 and the source driver of FIG. 22.
Figure 24:
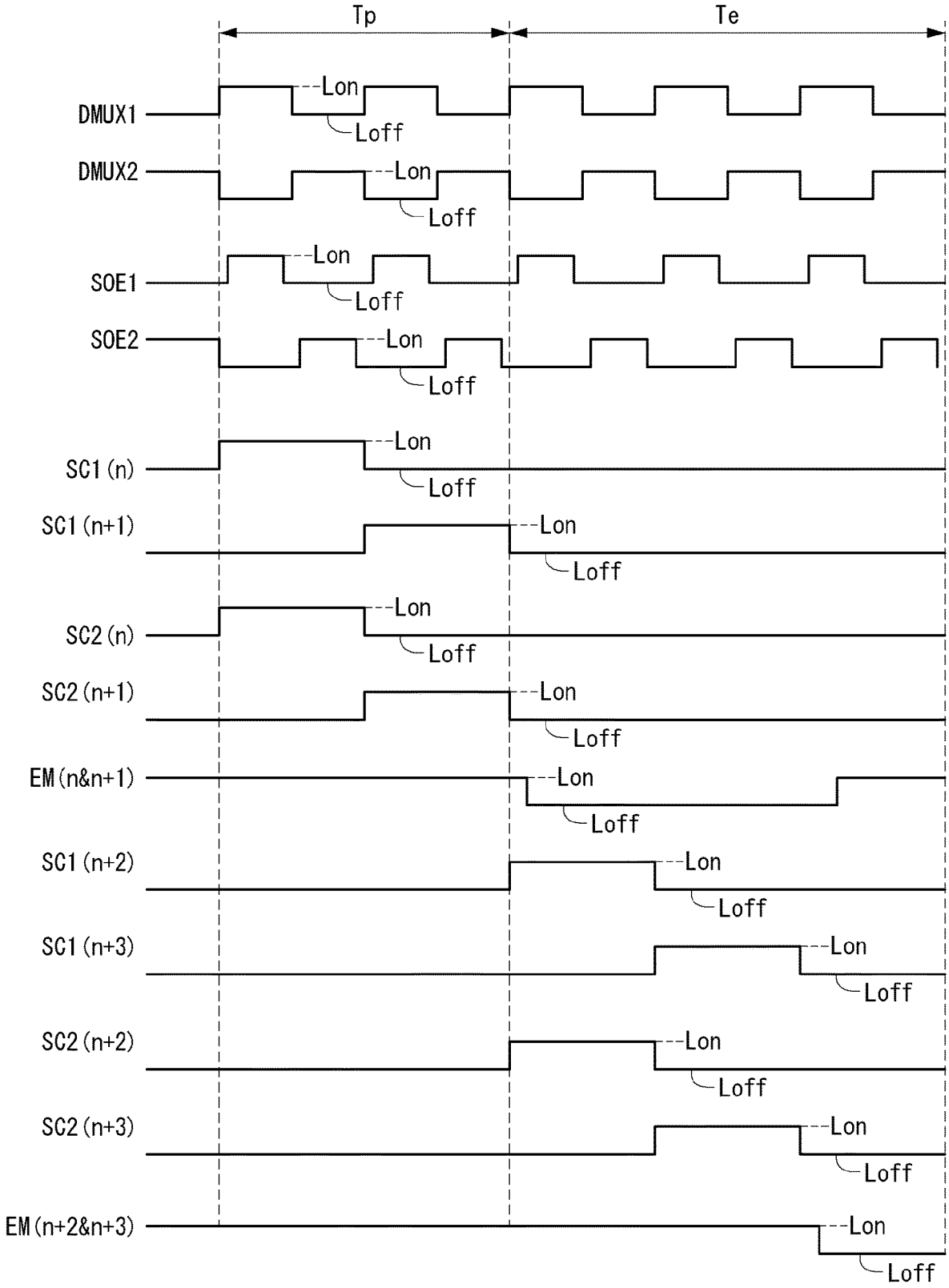
FIG. 24 is a waveform diagram illustrating operation of the display drive of FIG. 23.

FIG. 23 is a circuit diagram illustrating a display drive in accordance with the pixel of FIG. 14 and the source driver of FIG. 22. FIG. 24 is a waveform diagram illustrating operation of the display drive of FIG. 23.

A display device of an OLED display according to an example embodiment is described below with reference to FIGS. 23 and 24. The OLED display according to an example embodiment may be configured to control an emission operation every two adjacent pixel lines in a display drive.

In the display drive, first mux control signals SOE1 and SOE2 shown in the example of FIG. 24 may be substantially similar to the first mux control signals SOE1 and SOE2 shown in the example of FIG. 18. Further, third mux control signals DMUX1 and DMUX2 shown in the FIG. 24 example may be substantially similar to the third mux control signals DMUX1 and DMUX2 shown in the FIG. 18 example. Duplicate description is omitted for convenience.

A switch array 40 shown in FIG. 24 may not include fourth mux switches SX1 to SX6 and reference voltage supply switches SR1 and SR2. In this instance, reference lines 15 may be configured to supply a reference voltage $V_{ref}$.

In the display drive, an emission control signal EM may be simultaneously applied to two adjacent pixel lines, and a data voltage $V_{data}$ and the reference voltage $V_{ref}$ may be sequentially applied to each pixel line. For example, an emission driver 13C may be configured to supply the emission control signal EM simultaneously applied to the two adjacent pixel lines.

Because pixels of the OLED display according to an example embodiment may operate in an inverse gamma grayscale representation manner, the data voltage $V_{data}$ may be applied to a source node of a driving TFT. Further, the reference voltage $V_{ref}$ may be applied to a gate node of a driving TFT.

Supply timing of the reference voltage $V_{ref}$ and the data voltage $V_{data}$ for the programming may be individually set with respect to each pixel line. For example, the pixel lines may be respectively connected to stages of a first scan driver 13A. Thus, a first scan control signal SC1 may be sequentially applied to the pixel lines. Further, the pixel lines may be respectively connected to stages of a second scan driver 13B. Thus, a second scan control signal SC2 may be sequentially applied to the pixel lines.

The display drive is described below using an $n^{th}$ pixel line $L_n$ and a $(n+1)^{th}$ pixel line $L_n+1$ that may be adjacent to each other, as an example. To perform the display drive, a first scan control signal SC1(*n*) and a second scan control signal SC2(*n*) may be applied to the $n^{th}$ pixel line $L_n$, and a first scan control signal SC1(*n*+1) and a second scan control signal SC2(*n*+1) may be applied to the $(n+1)^{th}$ pixel line $L_n+1$. Further, emission control signals EM(n) and EM(n+1) may be commonly applied to the $n^{th}$ and $(n+1)^{th}$ pixel lines $L_n$ and $L_n+1$. Because the emission control signals EM(n) and EM(n+1) illustrated in FIG. 24 may be substantially similar to the emission control signals EM(n) and EM(n+1) illustrated in FIG. 18, duplicate description is omitted for convenience.

In the display drive, the reference voltage $V_{ref}$ may be continuously supplied to the reference lines 15. During a programming period $T_p$, after the $n^{th}$ pixel line $L_n$ is programmed by the first scan control signal SC1(*n*) and the second scan control signal SC2(*n*), the $(n+1)^{th}$ pixel line $L_n+1$ may be programmed by the first scan control signal SC1(*n*+1) and the second scan control signal SC2(*n*+1). During an emission period $T_e$, the $n^{th}$ and $(n+1)^{th}$ pixel lines $L_n$ and $L_n+1$ may be simultaneously reset by the emission control signals EM(n) and EM(n+1), and then may simultaneously emit light.

According to the above-described configuration, a kick-back phenomenon can be reduced. Further, a section of an off-level $L_{off}$ of the emission control signals EM(n) and EM(n+1) may be variably adjusted. Thus, a pulse duty drive can be performed.

Figure 25:
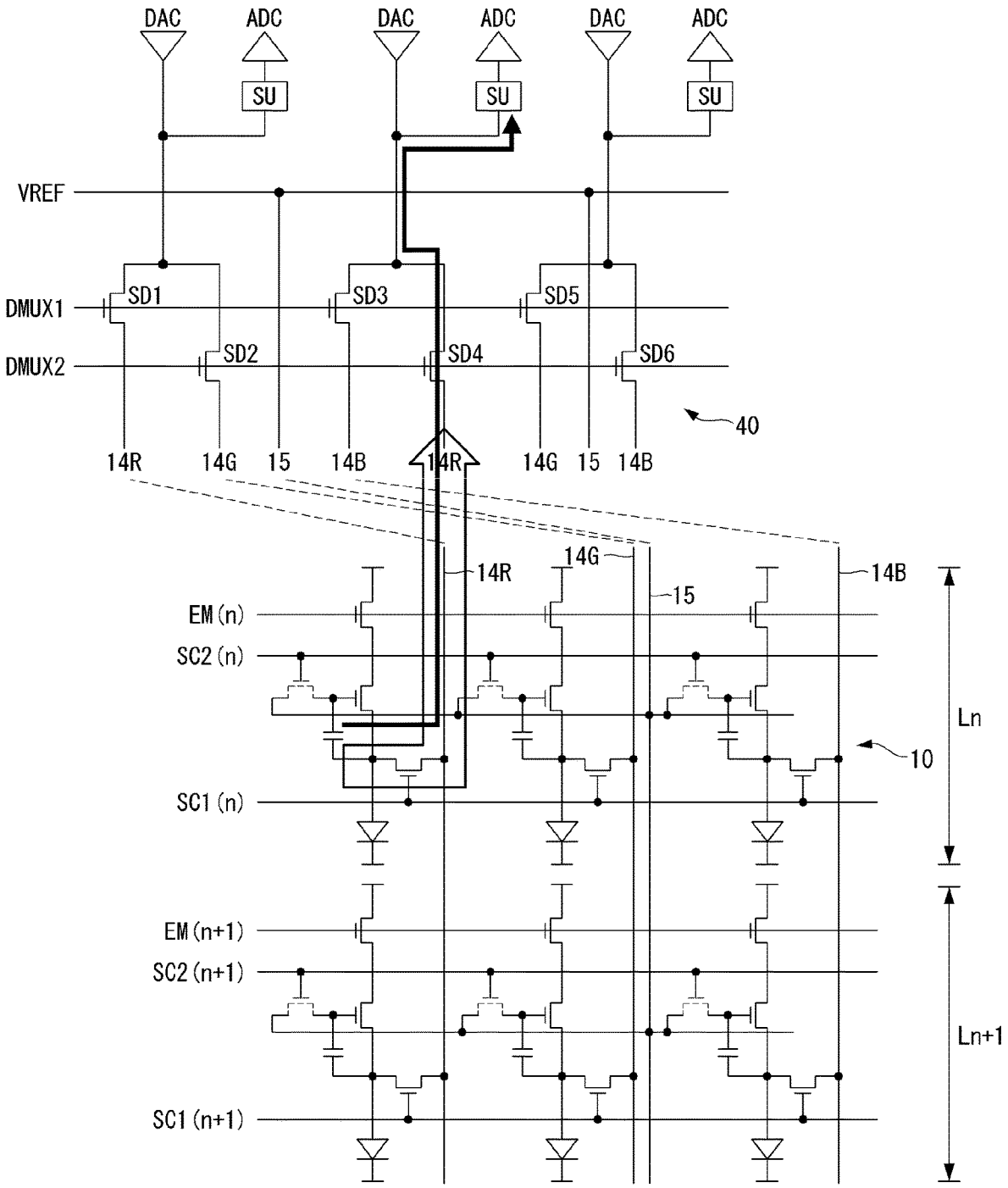
FIG. 25 is a circuit diagram illustrating a sensing drive in accordance with the pixel of FIG. 14 and the source driver of FIG. 22.
Figure 26:
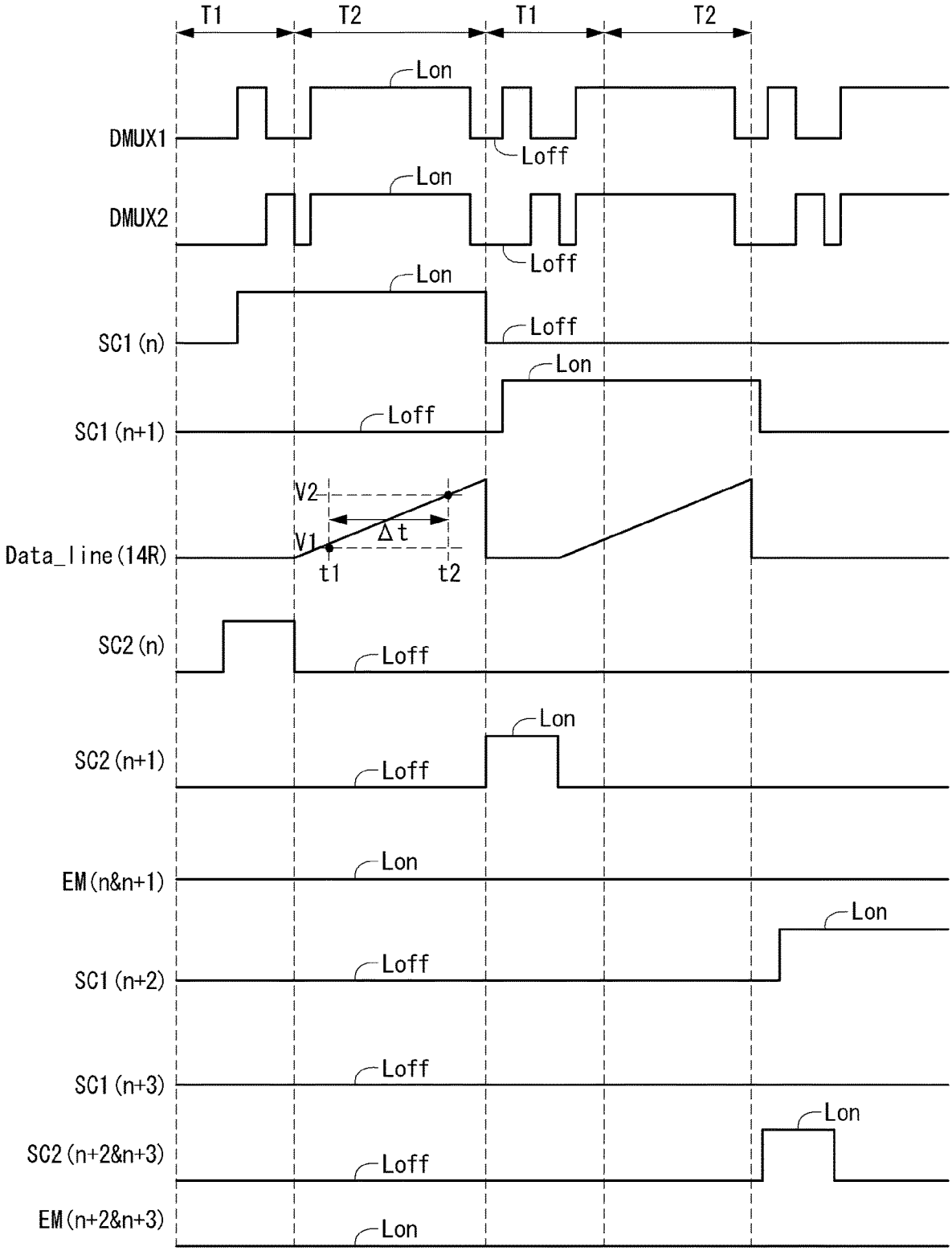
FIG. 26 is a waveform diagram illustrating a sensing drive of FIG. 25.

FIG. 25 is a circuit diagram illustrating a sensing drive in accordance with the pixel of FIG. 14 and the source driver of FIG. 22. FIG. 26 is a waveform diagram illustrating operation of the sensing drive of FIG. 25.

A sensing device of an OLED display according to an example embodiment is described below with reference to FIGS. 25 and 26. In a sensing device of an OLED display according to an example embodiment, because data lines 14R, 14G, and 14B may be used as sensing lines, it may be easier to set sensing timing than when reference lines 15 are used as the sensing lines. In the sensing device according to an example embodiment, a reference voltage $V_{ref}$ may be directly supplied to the reference lines 15. Duplicate description with FIGS. 19 and 20 is omitted in FIGS. 25 and 26, and a difference between them is described below.

The sensing drive is described below using an $n^{th}$ pixel line $L_n$ as an example. The sensing drive may be implemented to include a first period $T_1$ during which pixels may be initialized, and a second period $T_2$ during which electrical characteristics of the pixels may be sensed.

During the first period $T_1$, a sensing data voltage of an on-level may be simultaneously applied to odd-numbered pixels of the $n^{th}$ pixel line $L_n$, and then the sensing data voltage of the on-level may be simultaneously applied to even-numbered pixels of the $n^{th}$ pixel line $L_n$. Hence, during the first period $T_1$, all the pixels of the $n^{th}$ pixel line $L_n$ may be programmed so that a driving current may flow therein.

To this end, during the first period $T_1$, the sensing data voltage of the on-level, that may be input to the pixels of the $n^{th}$ pixel line $L_n$, may be time-divided by an operation of third mux switches SD1 to SD6 in response to third mux control signals DMUX1 and DMUX2, and may be supplied to the data lines 14R, 14G, and 14B. During the first period $T_1$, in response to a sensing first scan control signal SC1(*n*), the sensing data voltage of the on-level may be applied to the odd-numbered pixels of the $n^{th}$ pixel line $L_n$, and then may be applied to the even-numbered pixels of the $n^{th}$ pixel line $L_n$. During the first period $T_1$, the reference voltage $V_{ref}$ may be simultaneously applied to all the pixels in response to a sensing second scan control signal SC2(*n*).

During the second period $T_2$, the sensing second scan control signal SC2(*n*) may be turned off, the sensing first scan control signal SC1(*n*) may maintain a turn-on state, and the supply of the sensing data voltage may be cut off (e.g., the electrical connection between the output channels and the DACs of the source driver 12 may be released, and the output channels and the sensing units SU may be electrically connected). Therefore, a potential of each of the data lines 14R, 14G, and 14B may increase by a driving current flowing in the pixels of the $n^{th}$ pixel line $L_n$. In this instance, embodiments may sample a change in the potential of each of the data lines 14R, 14G, and 14B, for example, two times (e.g., a voltage $V_1$ at a time $t_1$ and a voltage $V_2$ at a time $t_2$). The two sampling values, e.g., voltages $V_1$ and $V_2$, for each pixel may be used to calculate a change in a threshold voltage and a change in electron mobility of the pixel in the timing controller.

Figure 27:
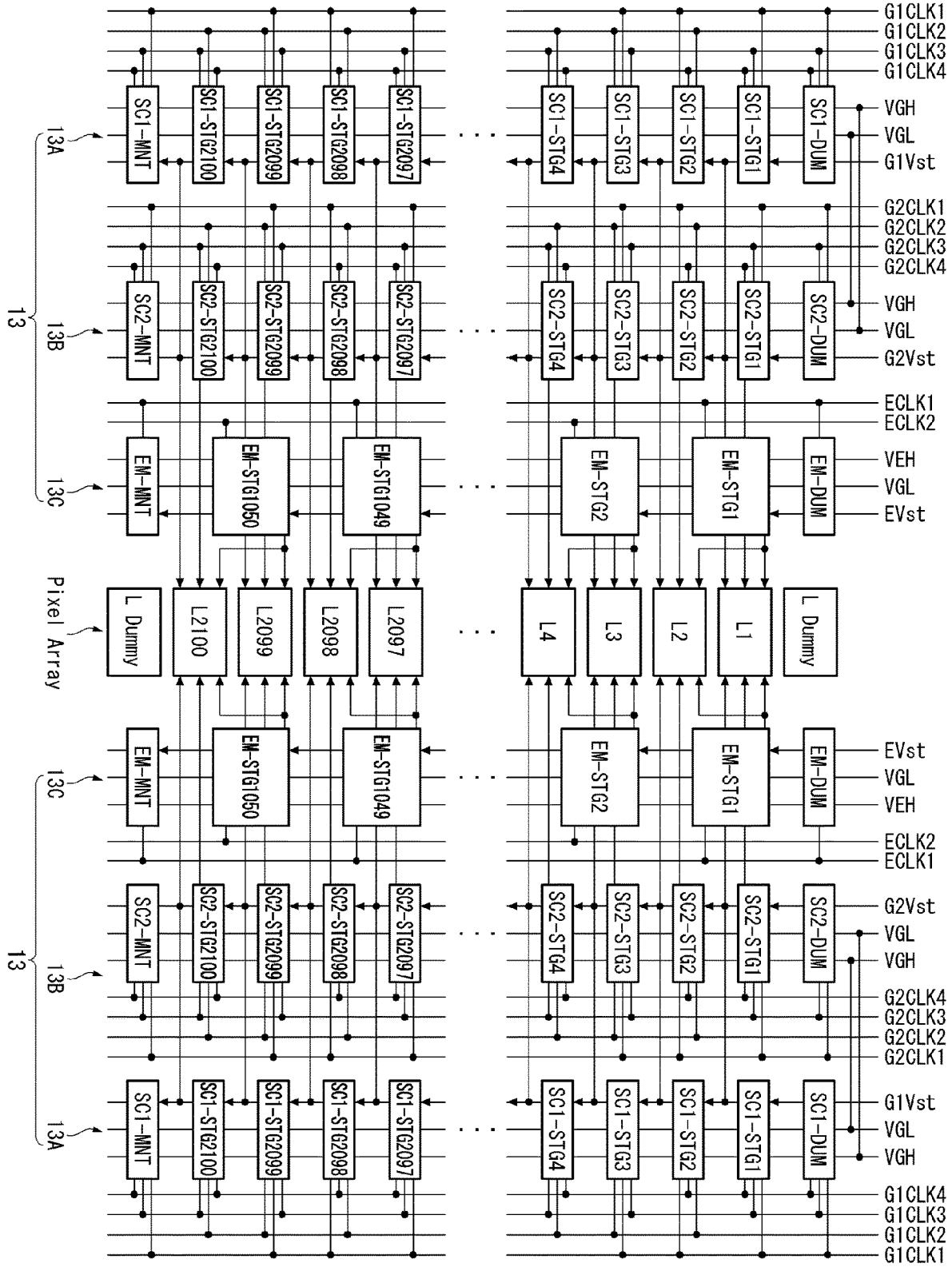
FIG. 27 is a circuit diagram illustrating an example configuration of a gate driver capable of supplying control signals for the display drive and the sensing drive illustrated in FIGS. 22 to 26.

FIG. 27 is a circuit diagram illustrating an example configuration of a gate driver capable of supplying control signals for the display drive and the sensing drive illustrated in FIGS. 22 to 26.

A gate driver of an OLED display according to an example embodiment is described below with reference to FIG. 27. A first scan driver 13A shown in the example of FIG. 27 may be substantially similar to the first scan driver 13A shown in the example of FIG. 21. Further, an emission driver 13C shown in the FIG. 27 example may be substantially similar to the emission driver 13C shown in the FIG. 21 example. Accordingly, duplicate description is omitted for convenience.

A gate driver 13 according to an example embodiment may include the first scan driver 13A having as many stages, e.g., stages SC1-STG1 to SC1-STG2100, as pixel lines, e.g., pixel lines L1 to L2100, of a pixel array, a second scan driver 13B having as many stages, e.g., stages SC2-STG1 to SC2-STG2100, as the pixel lines, e.g., pixel lines L1 to L2100, of the pixel array, and the emission driver 13C having stages, e.g., stages EM-STG1 to EM-STG1050, corresponding to a half of the number of pixel lines, e.g., pixel lines L1 to L2100. The stages, e.g., stages SC2-STG1 to SC2-STG2100, constituting the second scan driver 13B may be respectively individually connected to the pixel lines, e.g., pixel lines L1 to L2100.

The stages SC2-STG1 to SC2-STG2100 of the second scan driver 13B may sequentially shift a second start pulse G2Vst in response to second gate clock groups G2CLK1 to G2CLK4, and may generate the second scan control signal SC2 or the sensing second scan control signal SC2. According to the above-described configuration, the number of stages constituting the emission driver 13C can be reduced to a half of a vertical resolution (e.g., the number of pixel lines of the display panel), and two pixel lines can be driven using one stage. Hence, a bezel area can decrease.

For example, example embodiments may be described once more as follows. An OLED display according to an example embodiment may include a plurality of pixels that may each include a driving TFT, a first switching TFT, a second switching TFT, and an emission control TFT, which may be configured to sequentially operate in a programming period and an emission period in which a pulse duty drive is able to be performed, and may be disposed on at least an $n^{th}$ pixel line and a $(n+1)^{th}$ pixel line; and a gate driver including a first scan driver configured to control the first switching TFT, a second scan driver configured to control the second switching TFT, and a third scan driver configured to control the emission control TFT, wherein the third scan driver may be configured to control so that all of a plurality of emission control TFTs corresponding to the $n^{th}$ pixel line and the $(n+1)^{th}$ pixel line may be turned on in the programming period, may maintain a turn-on state for a particular time of the emission period following the programming period, and may adjust a turn-on period depending on an adjustable turn-off period after the particular time.

In the programming period, the first scan driver may be configured to supply first scan control signals each having a different turn-on section to the $n^{th}$ pixel line and the $(n+1)^{th}$ pixel line. The first scan driver may be configured to sequentially turn on the plurality of first switching TFTs corresponding to the $n^{th}$ pixel line and the $(n+1)^{th}$ pixel line on a per pixel line basis in the programming period and turn off all of the plurality of first switching TFTs corresponding to the $n^{th}$ pixel line and the $(n+1)^{th}$ pixel line in the emission period.

The first scan driver may include a plurality of stages respectively corresponding to the plurality of pixel lines. One stage of the third scan driver and one stage of the second scan driver may be configured to correspond to two stages of the first scan driver and drive one pixel line while reducing kickback.

A data voltage applied to a gate node of the driving TFT may be in a range greater than a reference voltage applied to a source node of the driving TFT. A gate node-to-source node voltage of the driving TFT may be configured to operate in a gamma grayscale manner.

In the programming period, a turn-on section of a second scan control signal simultaneously supplied to the $n^{th}$ pixel line and the $(n+1)^{th}$ pixel line by the second scan driver may be substantially the same as a sum of turn-on sections of the first scan control signals respectively supplied to the $n^{th}$ pixel line and the $(n+1)^{th}$ pixel line. The second scan driver may be configured to turn on all of the plurality of second switching TFTs corresponding to the $n^{th}$ pixel line and the $(n+1)^{th}$ pixel line in the programming period and turn off all of the plurality of second switching TFTs corresponding to the $n^{th}$ pixel line and the $(n+1)^{th}$ pixel line in the emission period.

The second scan driver may include a plurality of stages corresponding to a pair of adjacent pixel lines. The number of stages of the first scan driver may be more than the number of stages of the second scan driver. A data voltage applied to a source node of the driving TFT may be in a range less than a reference voltage applied to a gate node of the driving TFT. A gate node-to-source node voltage of the driving TFT may be configured to operate in an inverse gamma grayscale manner.

In the programming period, a turn-on section of a second scan control signal supplied to the $n^{th}$ pixel line by the second scan driver may be substantially the same as a turn-on section of a first scan control signal supplied to the $n^{th}$ pixel line by the first scan driver. Further, a turn-on section of the second scan control signal supplied to the $(n+1)^{th}$ pixel line by the second scan driver may be substantially the same as a turn-on section of the first scan control signal supplied to the $(n+1)^{th}$ pixel line by the first scan driver. The second scan driver may be configured to sequentially turn on the plurality of second switching TFTs corresponding to the $n^{th}$ pixel line and the $(n+1)^{th}$ pixel line on a per pixel line basis in the programming period and turn off all of the plurality of second switching TFTs corresponding to the $n^{th}$ pixel line and the $(n+1)^{th}$ pixel line in the emission period.

The second scan driver may include a plurality of stages respectively corresponding to the plurality of pixel lines. The number of stages of the first scan driver in each pixel line may be the same as the number of stages of the second scan driver in each pixel line.

For example, embodiments may be described once more as follows. An OLED display according to an example embodiment may include a plurality of pixel lines that may include a plurality of pixels each including a driving TFT, a first switching TFT connected to the driving TFT, a second switching TFT connected to the driving TFT, and an emission control TFT connected to the driving TFT and may at least include an $n^{th}$ pixel line and a $(n+1)^{th}$ pixel line; a first scan driver configured to control a plurality of first switching TFTs corresponding to the $n^{th}$ pixel line and the $(n+1)^{th}$ pixel line; a second scan driver configured to control a plurality of second switching TFTs corresponding to the $n^{th}$ pixel line and the $(n+1)^{th}$ pixel line; and a third scan driver configured such that all of a plurality of emission control TFTs corresponding to the $n^{th}$ pixel line and the $(n+1)^{th}$ pixel line may be turned on in a programming period, may maintain a turn-on state for a particular time of an emission period following the programming period, and may be able to adjust an on-time duty of the emission period after the particular time.

The $n^{th}$ pixel line and the $(n+1)^{th}$ pixel line may be configured to operate at the same on-time duty by the third scan driver. The first scan driver may include a plurality of stages configured to drive the $n^{th}$ pixel line and the $(n+1)^{th}$ pixel line, and the second scan driver may include a plurality of stages configured to drive the $n^{th}$ pixel line and the $(n+1)^{th}$ pixel line. The third scan driver may include a plurality of stages configured to drive the $n^{th}$ pixel line and the $(n+1)^{th}$ pixel line. One of the plurality of stages of the third scan driver may be configured to simultaneously drive the $n^{th}$ pixel line and the $(n+1)^{th}$ pixel line.

The OLED display according to an example embodiment may further include a third gate line connecting the plurality of emission control TFTs of the $n^{th}$ pixel line and the $(n+1)^{th}$ pixel line to a corresponding stage of the third scan driver. The third scan driver may be configured to simultaneously apply an emission control signal corresponding to the programming period and the emission period to the emission control TFTs of the $n^{th}$ pixel line and the $(n+1)^{th}$ pixel line.

The plurality of stages of the first scan driver may be configured to respectively drive the plurality of pixel lines corresponding to the plurality of stages. The OLED display according to an example embodiment may further include a plurality of first gate lines connecting the first switching TFTs of the $n^{th}$ pixel line and the $(n+1)^{th}$ pixel line to a corresponding stage of the first scan driver.

The first scan driver may be configured to sequentially apply first scan control signals corresponding to the programming period and the emission period to the first switching TFTs of the $n^{th}$ pixel line and the $(n+1)^{th}$ pixel line. One of the plurality of stages of the second scan driver may be configured to simultaneously drive the $n^{th}$ pixel line and the $(n+1)^{th}$ pixel line.

The OLED display according to an example embodiment may further include a second gate line connecting the plurality of second switching TFTs of the $n^{th}$ pixel line and the $(n+1)^{th}$ pixel line to a corresponding stage of the second scan driver. The second scan driver may be configured to simultaneously apply a second scan control signal corresponding to the programming period and the emission period to the second switching TFTs of the $n^{th}$ pixel line and the $(n+1)^{th}$ pixel line.

A data voltage applied to the $n^{th}$ pixel line and the $(n+1)^{th}$ pixel line may have a gamma gray level. The plurality of stages of the second scan driver may be configured to respectively drive the plurality of pixel lines corresponding to the plurality of stages. The OLED display according to an example embodiment may further include a plurality of second gate lines connecting the second switching TFTs of the $n^{th}$ pixel line and the $(n+1)^{th}$ pixel line to a corresponding stage of the second scan driver.

The second scan driver may be configured to sequentially apply second scan control signals corresponding to the programming period and the emission period to the second switching TFTs of the $n^{th}$ pixel line and the $(n+1)^{th}$ pixel line. A data voltage applied to the $n^{th}$ pixel line and the $(n+1)^{th}$ pixel line may implement an inverse gamma gray level. The emission control signal of the third scan driver may maintain a turn-on state for a particular time after both the first scan control signal and the second scan control signal are turned off, and then may be turned off, thereby reducing kickback.

The OLED display according to an example embodiment may further include a dummy pixel line positioned adjacent to one side of the $n^{th}$ pixel line or the $(n+1)^{th}$ pixel line. The OLED display according to an example embodiment may further include a sensor connected to the plurality of pixels and may be configured to sequentially perform a sensing drive and a display drive.

Figure 28:
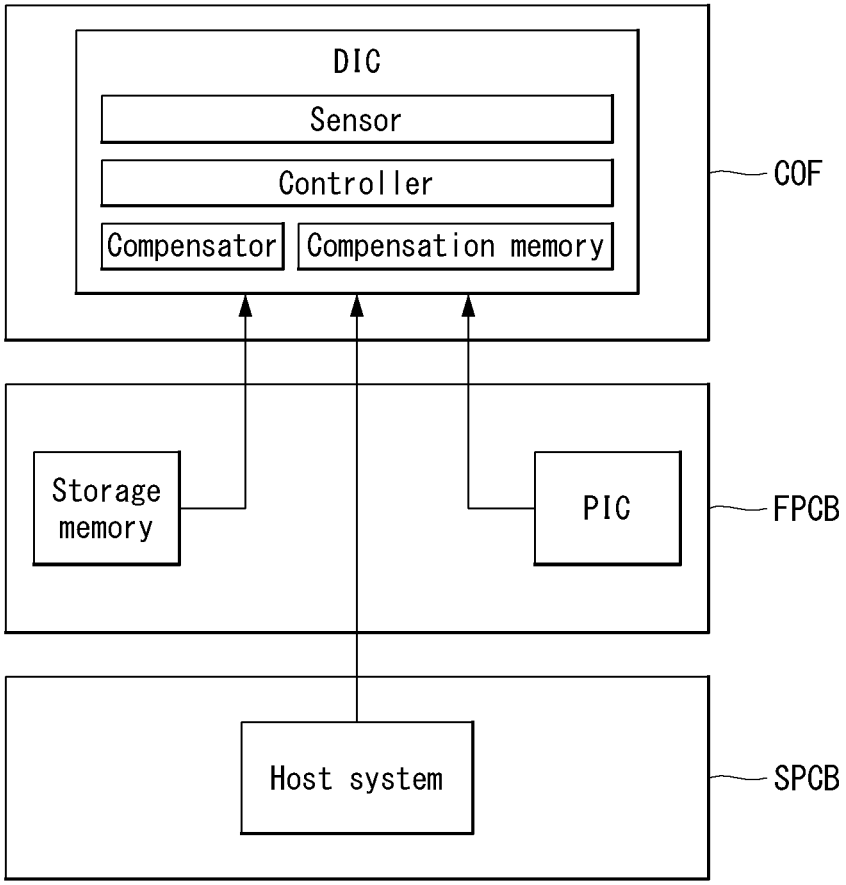
FIGS. 28 to 30 illustrate various examples of an external compensation module.
Figure 29:
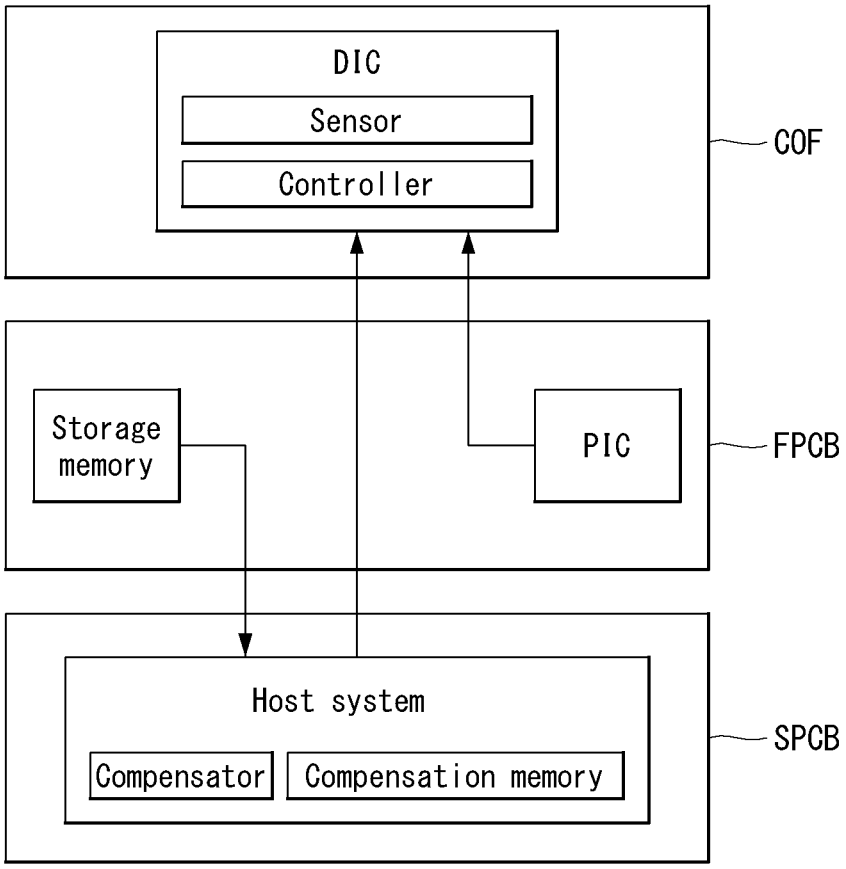
Figure 30:
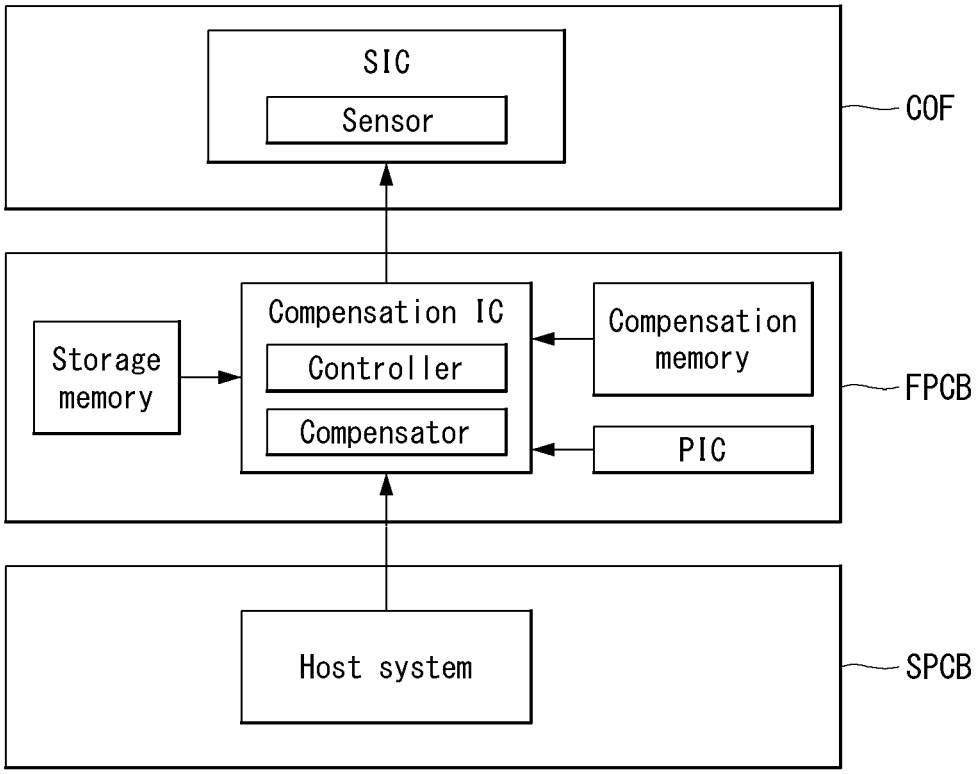

FIGS. 28 to 30 illustrate various examples of an external compensation module.

With reference to FIG. 28, an OLED display according to an example embodiment may include a driver integrated circuit (IC) DIC mounted on a chip-on film COF, a storage memory and a power IC PIC mounted on a flexible printed circuit board FPCB, and a host system mounted on a system printed circuit board SPCB, to implement an external compensation module.

The driver IC DIC may be formed by implementing the above-described source driver 12 and the above-described timing controller 11 into one chip, and may include a sensor, a controller, a compensator, and a compensation memory. As described above, the sensor may include a plurality of sensing units SU1 and SU2, a plurality of ADCs ADC1 and ADC2, and the like. The controller may calculate a compensation parameter capable of compensating for a change in electrical characteristics of a driving TFT based on digital sensing values input from the sensor in a sensing drive, and may store the compensation parameter in the storage memory. The controller may generate various control signals used in an operation of a gate driver. The compensator may read the compensation parameter from the storage memory in a display drive, and may store the compensation parameter in the compensation memory. The compensator may correct digital data of an input image based on the compensation parameter. The controller and the compensator may correspond to the above-described timing controller 11. The storage memory may be implemented as a read-only memory (ROM). For example, the storage memory may be a flash memory. The compensation memory may be implemented as a random access memory (RAM). For example, the compensation memory may be a double data rate synchronous dynamic RAM (DDR SDRAM). Embodiments are not limited to these examples.

The power IC PIC may generate various driving power levels used to operate the external compensation module. The host system may transmit timing signals, such as a vertical sync signal Vsync, a horizontal sync signal Hsync, a dot clock signal DCLK, and a data enable signal DE, and the digital data DATA of the input image, to the driver IC DIC.

With reference to FIG. 29, an OLED display according to an example embodiment may include a driver IC DIC mounted on a chip-on film COF, a storage memory and a power IC PIC mounted on a flexible printed circuit board FPCB, and a host system mounted on a system printed circuit board SPCB, to implement an external compensation module. The external compensation module of the FIG. 29 example is different from the external compensation module of the FIG. 28 example in that a compensator and a compensation memory may not be mounted on the driver IC DIC, and may be mounted on the host system. The external compensation module of FIG. 29 may simplify configuration of the driver IC DIC.

With reference to FIG. 30, an OLED display according to an example embodiment may include a source IC SIC mounted on a chip-on film COF; a storage memory, a compensation IC, a compensation memory, and a power IC PIC mounted on a flexible printed circuit board FPCB; and a host system mounted on a system printed circuit board SPCB, to implement an external compensation module. In the external compensation module of the example of FIG. 30, configuration of the source IC SIC may be further simplified by mounting only a sensor on the source IC SIC, and a controller and a compensator may be mounted on a separate compensation IC. It may be simple to upload and download compensation parameters by mounting the compensation IC, the storage memory, and the compensation memory on the flexible printed circuit board FPCB.

The effects according to example embodiments are not limited by the above description. As described above, example embodiments may reduce or prevent an effect of kickback in the emission period for the image display, and may prevent or compensate for the luminance distortion, and may thereby improve the image quality.

Example embodiments can reduce the manufacturing cost and be flexibly adapted for high-resolution display devices by reducing an area of the source driver occupied by the circuits for sensing the electrical characteristics of the driving TFT. Example embodiments can minimize the size of edges, e.g., the left and right edge portions, of the display surface, to which no image is output, by reducing the size of the gate driver directly formed at the display panel.

In other words, example embodiments can improve the image quality by reducing or preventing an effect of kickback in the emission period for the image display and preventing or compensating for the luminance distortion. Example embodiments can improve the luminance uniformity between pixels in the image display and increase the image quality.

Example embodiments can reduce the manufacturing cost and be flexibly adapted for high resolution display devices while implementing the narrow bezel by reducing a portion of the bezel area occupied by a driving circuit capable of compensating for the luminance distortion and the luminance uniformity between pixels.

It will be apparent to those skilled in the art that various modifications and variations may be made in the present disclosure without departing from the technical idea or scope of the disclosure. Thus, it is intended that embodiments of the present disclosure cover the modifications and variations of the disclosure provided they come within the scope of the appended claims and their equivalents.

What is claimed is:

1. An organic light-emitting diode (OLED) display, comprising:

a plurality of pixel lines each connected to a plurality of pixels, the plurality of pixel lines including at least an $n^{th}$ pixel line and an $(n+1)^{th}$ pixel line, where n is a natural number, each pixel including:

a driving thin film transistor (TFT);

a first switching TFT connected to the driving TFT;

a second switching TFT connected to the driving TFT; and an emission control TFT connected to the driving TFT;

a first scan driver configured to control the first switching TFTs included in pixels corresponding to the $n^{th}$ pixel line and the $(n+1)^{th}$ pixel line;

a second scan driver configured to control the second switching TFTs included in the pixels corresponding to the $n^{th}$ pixel line and the $(n+1)^{th}$ pixel line; and a third scan driver configured such that all of the emission control TFTs included in the pixels corresponding to the $n^{th}$ pixel line and the $(n+1)^{th}$ pixel line:

are turned on in a programming period;

maintain a turn-on state for a portion of time of an emission period following the programming period; and are able to adjust an on-time duty of the emission period after the portion of time, wherein an emission control signal of the third scan driver maintains the turn-on state for the particular portion of time after both the first switching TFT and the second switching TFT are turned off, and then be turned off to reduce kickback.

2. The organic light-emitting diode display of claim 1, wherein:

the $n^{th}$ pixel line and the $(n+1)^{th}$ pixel line are configured to operate at a same on-time duty of the emission period by the third scan driver;

the first scan driver includes a plurality of stages configured to drive the $n^{th}$ pixel line and the $(n+1)^{th}$ pixel line;

the second scan driver includes a plurality of stages configured to drive the $n^{th}$ pixel line and the $(n+1)^{th}$ pixel line; and the third scan driver includes a plurality of stages configured to drive the $n^{th}$ pixel line and the $(n+1)^{th}$ pixel line.

3. The organic light-emitting diode display of claim 2, wherein one of the plurality of stages of the third scan driver is configured to simultaneously drive the $n^{th}$ pixel line and the $(n+1)^{th}$ pixel line.

4. The organic light-emitting diode display of claim 3, further comprising a third gate line connecting the emission control TFTs of the $n^{th}$ pixel line and the $(n+1)^{th}$ pixel line to a corresponding stage of the third scan driver.

5. The organic light-emitting diode display of claim 3, wherein the third scan driver is configured to simultaneously apply an emission control signal corresponding to the programming period and the emission period to the emission control TFTs of the $n^{th}$ pixel line and the $(n+1)^{th}$ pixel line.

6. The organic light-emitting diode display of claim 2, wherein each of the plurality of stages of the first scan driver is configured to respectively drive the plurality of pixel lines corresponding to the plurality of stages.

7. The organic light-emitting diode display of claim 6, further comprising a plurality of first gate lines connecting the first switching TFTs of the $n^{th}$ pixel line and the $(n+1)^{th}$ pixel line to a corresponding stage of the first scan driver.

8. The organic light-emitting diode display of claim 6, wherein the first scan driver is configured to sequentially apply first scan control signals corresponding to the programming period and the emission period to the first switching TFTs of the $n^{th}$ pixel line and the $(n+1)^{th}$ pixel line.

9. The organic light-emitting diode display of claim 2, wherein one of the plurality of stages of the second scan driver is configured to simultaneously drive the $n^{th}$ pixel line and the $(n+1)^{th}$ pixel line.

10. The organic light-emitting diode display of claim 9, further comprising a second gate line connecting the second switching TFTs of the $n^{th}$ pixel line and the $(n+1)^{th}$ pixel line to a corresponding stage of the second scan driver.

11. The organic light-emitting diode display of claim 9, wherein the second scan driver is configured to simultaneously apply a second scan control signal corresponding to the programming period and the emission period to the second switching TFTs of the $n^{th}$ pixel line and the $(n+1)^{th}$ pixel line.

12. The organic light-emitting diode display of claim 2, wherein each of the plurality of stages of the second scan driver is configured to respectively drive the plurality of pixel lines corresponding to the plurality of stages.

13. The organic light-emitting diode display of claim 12, further comprising a plurality of second gate lines connecting the second switching TFTs of the $n^{th}$ pixel line and the $(n+1)^{th}$ pixel line to a corresponding stage of the second scan driver.

14. The organic light-emitting diode display of claim 12, wherein a data voltage applied to the $n^{th}$ pixel line and the $(n+1)^{th}$ pixel line implements an inverse gamma gray level.

15. An organic light-emitting diode (OLED) display including a programming period and an emission period, comprising:

a first switching TFT between a gate node of a driving thin film transistor (TFT) and a data line, the first switching TFT being configured to supply a data voltage to the gate node in the programming period;

a second switching TFT between a source node of the driving TFT and a reference line, the second switching TFT being configured to bypass a transient current, that is supplied through the driving TFT, to the reference line in the programming period;

an emission control TFT between a drain node of the driving TFT and a high potential driving voltage supply line, the emission control TFT being configured to supply a high potential driving voltage to the drain node in the programming period;

a storage capacitor between the gate node and the source node, the storage capacitor being configured to charge a gate node-to-source node voltage of the driving TFT in the programming period; and an organic light-emitting diode connected to the source node, the OLED being configured to maintain a non-emission state in the programming period, wherein the emission control TFT is further configured to:

be turned on during the programming period, maintain a turn-on state for a portion of time of the emission period, and adjust an on-time duty of the emission period after the portion of time, and wherein the emission control TFT maintains the turn-on state for the particular portion of time after both the first switching TFT and the second switching TFT are turned off, and then be turned off to reduce kickback.

16. The organic light-emitting diode display of claim 15, wherein the drain node is not in a floating state in the programming period, and is not in a floating state for the portion of time of the emission period to reduce kickback.

17. The organic light-emitting diode display of claim 15, wherein, in the emission period, the emission control TFT maintains a turn-off state for a particular time from the portion of time and then is turned on.

18. The organic light-emitting diode display of claim 17, wherein, in the emission period, the emission control TFT operates in a pulse duty drive in which a variable duty is adjustable.

* * * * *